US006447093B1

(12) United States Patent
Asakawa et al.

(10) Patent No.: US 6,447,093 B1
(45) **Date of Patent: *Sep. 10, 2002**

(54) LIQUID DISCHARGE HEAD HAVING A PLURALITY OF LIQUID FLOW CHANNELS WITH CHECK VALVES

(75) Inventors: Yoshie Asakawa, Hotaka-machi; Hiroyuki Ishinaga, Tokyo; Toshio Kashino, Chigasaki; Akira Nagashima, Tokyo; Aya Yoshihira, Yokohama; Kiyomitsu Kudo, Yokohama; Yoichi Taneya, Yokohama, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/891,325

(22) Filed: Jul. 10, 1997

(30) Foreign Application Priority Data

| | | |
|---|---|---|
| Jul. 12, 1996 | (JP) | 8-183040 |
| Jul. 12, 1996 | (JP) | 8-183577 |
| Jul. 12, 1996 | (JP) | 8-183750 |
| Jul. 4, 1997 | (JP) | 9-179998 |

(51) Int. Cl.[7] ..... B41J 2/05
(52) U.S. Cl. ..... 347/21; 347/65; 347/85
(58) Field of Search ..... 347/21, 56, 65, 347/84, 85

(56) References Cited

U.S. PATENT DOCUMENTS

| | | | |
|---|---|---|---|
| 4,480,259 A | 10/1984 | Kruger et la. | |
| 4,496,960 A | 1/1985 | Fischbeck | |
| 4,509,063 A | 4/1985 | Sugitani et al. | |
| 4,514,742 A | 4/1985 | Suga et al. | |
| 4,558,333 A | 12/1985 | Sugitani et al. | |
| 4,568,953 A | 2/1986 | Aoki et al. | |
| 4,611,219 A | 9/1986 | Sugitani et al. | |
| 4,698,645 A | 10/1987 | Inamoto | |
| 4,723,129 A | 2/1988 | Endo et al. | |
| 4,723,136 A | 2/1988 | Suzumura | 347/65 |
| 4,940,995 A | 7/1990 | Hine et al. | |

(List continued on next page.)

FOREIGN PATENT DOCUMENTS

| | | |
|---|---|---|
| EP | 0436047 | 7/1991 |
| EP | 0443798 | 8/1991 |
| EP | 0496533 | 7/1992 |
| EP | 0538147 | 4/1993 |
| EP | 0 614 952 | 9/1994 |
| EP | 0 655 337 | 5/1995 |
| EP | 0 678 388 | 10/1995 |
| EP | 0 739 734 | 10/1996 |
| EP | 0 764 528 | 3/1997 |
| JP | 61-59914 | 2/1980 |

(List continued on next page.)

*Primary Examiner*—Robert Beatty
(74) *Attorney, Agent, or Firm*—Fitzpatrick, Cella, Harper & Scinto

(57) ABSTRACT

A liquid discharge head comprises discharge ports for discharging the liquid, a bubble producing area for producing an air bubble in the liquid of liquid flow channels, and a movable member, which is disposed toward the bubble producing area, and displaceable between a first position and a second position farther away from the bubble producing area than the first position, the liquid discharge head discharging the liquid in such a manner that the movable member is displaced from the first position to the second position by a pressure due to a bubble produced in the bubble producing area, and the bubble is more greatly expanded downstream than upstream in a direction toward the discharge port, due to the displacement of the movable member. The head has a check valve disposed in a liquid supply passage leading to the liquid flow channels.

19 Claims, 52 Drawing Sheets

$P_1, P_2 < P_3$

U.S. PATENT DOCUMENTS

| | | | | | |
|---|---|---|---|---|---|
| 4,994,825 | A | | 2/1991 | Saito et al. | |
| 5,175,565 | A | | 12/1992 | Ishinaga et al. | |
| 5,208,604 | A | | 5/1993 | Watanabe et al. | |
| 5,262,802 | A | | 11/1993 | Karita et al. | |
| 5,278,585 | A | | 1/1994 | Karz et al. | |
| 5,296,875 | A | | 3/1994 | Suda | 347/89 |
| 5,389,957 | A | | 2/1995 | Kimura et al. | 347/20 |
| 5,467,112 | A | * | 11/1995 | Mitani | |
| 5,485,184 | A | | 1/1996 | Nakagomi et al. | 347/63 |
| 5,602,576 | A | | 2/1997 | Murooka et al. | 347/59 |
| 5,821,962 | A | * | 10/1998 | Kudo et al. | 347/65 |
| 5,838,351 | A | * | 11/1998 | Weber | 347/85 |
| 5,880,752 | A | * | 3/1999 | Weber et al. | 347/15 |
| 6,007,187 | A | * | 12/1999 | Kashino et al. | 347/65 |
| 6,084,616 | A | * | 7/2000 | Nakata et al. | 347/65 |
| 6,095,639 | A | * | 8/2000 | Uetsuki et al. | 347/65 |

FOREIGN PATENT DOCUMENTS

| | | |
|---|---|---|
| JP | 55-81172 | 6/1980 |
| JP | 61-69467 | 4/1986 |
| JP | 61-110557 | 5/1986 |
| JP | 62-156969 | 7/1987 |
| JP | 62-48585 | 10/1987 |
| JP | 62-197652 | 8/1988 |
| JP | 63-199972 | 8/1988 |
| JP | 2-113950 | 4/1990 |
| JP | 2-258263 | 10/1990 |
| JP | 3-81155 | 4/1991 |
| JP | 5-124189 | 5/1993 |
| JP | 5-229122 | 9/1993 |
| JP | 6-31918 | 2/1994 |
| JP | 6-87214 | 3/1994 |

* cited by examiner

LIQUID DISCHARGE HEAD HAVING A PLURALITY OF LIQUID FLOW CHANNELS WITH CHECK VALVES

BACKGROUND OF THE INVENTION

1. Field of the Invention

The present invention relates to a liquid discharge head for discharging the desired liquid due to a bubble produced by applying heat energy to the liquid, a head cartridge using the liquid discharge head, and a liquid discharge apparatus, and more particularly to a liquid discharge head having a movable member which is displaceable using the produced bubble, a head cartridge using the liquid discharge head, and a liquid discharge apparatus.

Also, this invention is applicable to a printer for recording onto the recording medium such as paper, thread, fiber, cloths, leather, metal, plastics, glass, wood, and ceramics, a copying machine, a facsimile apparatus having a communication system, a word processor having a printer unit, as well as an industrial recording apparatus in combination with a variety of processors.

By the term "recording" as used in this invention is meant depositing not only a significant image such as a character or figure onto the recording medium, but also a less significant image such as a pattern thereon.

2. Related Background Art

Conventionally, an ink jet recording method, a so-called a bubble jet recording method, has been well known wherein an image is formed on the recording medium in such a manner as to apply the thermal energy to the ink to bring about a state change in the ink which will cause a steep volume change (or produce a bubble) in the ink, and discharge the ink from the discharge ports under the working force produced by this state change. A recording apparatus using this bubble jet recording method has integrally arranged therein a discharge port for discharging the ink, an ink flow passage communicating to this discharge port, and an electricity-heat converter as energy generating means for discharging the ink which is disposed within an ink flow passage, as disclosed in U.S. Pat. No. 4,723,129.

With such a recording method, there are a number of advantages that a high-quality image can be recorded at high speed and with low noise, and a high resolution image or a color image can be easily recorded by a compact apparatus, because a head for use with this recording method can have discharge ports for discharging the ink arranged at high density. Therefore, this bubble jet recording method has been recently applied to numerous office equipments such as a printer, a copying machine, and a facsimile, as well as even an industrial system such as a printing apparatus for cloths.

Thus, as the bubble jet technology has been utilized in various fields of products, numerous requirements as described below have been further raised in recent years.

For example, to cope with the requirements for higher energy efficiency, the optimization of a heat generating member by adjusting the thickness of a protective membrane can be considered. This method is effective in improving the efficiency of transferring generated heat to the liquid.

Also, to obtain a high-quality image, a drive condition for effecting a liquid discharge method with which the ink discharge can be excellently made at high speed of ink discharge and based on stable production of bubble has been proposed, or from the viewpoint of high speed recording, there has been proposed a liquid discharge head having an improved shape of flow passage to attain a higher speed of refilling the discharged liquid into liquid flow passages.

Of the shapes of flow passage, a flow passage structure as shown in FIGS. 63A and 63B, has been described in Japanese Patent Application Laid-open No. 63-199972. The flow passage structure or head manufacturing method as described in this patent paid attention to a back wave (pressure propagating in a direction opposite to the direction toward the discharge port, i.e., pressure toward a liquid chamber 2012) which is yielded with the production of bubble. This back wave is well known as a loss energy as this wave does not propagate in the discharge direction.

The invention as illustrated in FIGS. 63A and 63B discloses a valve 2010 located away from the area of producing a bubble to be formed by a heating element 2002, and opposite the discharge port 2011 with respect to the heating element 2002.

In FIG. 63B, this valve 2010 is disclosed as having an initial position where it is attached to a ceiling of a flow passage 2003 according to a manufacturing method using a plate, and this valve is hung down in the flow passage 2003 with the production of bubble. This invention is disclosed as suppressing the energy loss by controlling part of the back wave as above mentioned with the valve 2010.

However, it will be understood that with this constitution, it is not practical for the discharge of liquid to suppress part of the back wave with the valve 2010, by investigating when the bubble is produced within the flow passage 2003 holding the liquid to be discharged.

The back wave as such is not directly involved in discharging, as previously described. At the time when this back wave occurs within the flow passage 2003, the pressure of bubble directly involved in discharging is ready to discharge the liquid from within the flow passage 2010, as shown in FIG. 63A. Accordingly, it is clear that suppressing part of the back wave has no significant effect on the discharge.

On the other hand, in the bubble jet recording method, because the heating is repeated in the state where the heat generating member is in contact with the ink, there occur deposits on the surface of the heat generating member, due to burning of the ink, but a large amount of deposits might occur, depending on the type of ink, thereby resulting unstable production of bubble, which made it difficult to perform excellent ink discharge. Also, a method is desired wherein even when the liquid to be discharged is likely to degrade due to heat, or is not sufficiently bubbled, the ink can be discharged excellently without changing the quality of the light to be discharged.

From such a viewpoint, a method wherein using the liquid for bubbling due to heat (bubbling liquid) and the liquid for discharging (discharge liquid) which are different, the discharge liquid is discharged by transferring a pressure due to bubbling to the discharge liquid has been disclosed in Japanese Patent Application Laid-open No. 61-69467, Japanese Patent Application Laid-open No. 55-81172, and U.S. Pat. No. 4,480,259. In these patents, the ink which is the discharge liquid and the bubbling liquid are completely separated via a flexible membrane of e.g. silicone rubber to prevent the discharge liquid from making direct contact with the heat generating member, and the pressure due to bubble generation of the bubbling liquid is transferred to the discharge liquid owing to deformation of the flexible membrane. By such constitution, to prevent the deposits on the surface of heat generating member can be attained, with a greater degree of freedom in selecting the discharge liquid.

However, in a head in which the discharge liquid and the bubbling liquid are completely separated, as previously described, the pressure due to bubbling will be considerably absorbed by the flexible membrane as the pressure in bubbling is transferred to the discharge liquid, owing to expansion and deformation of flexible membrane. Also, there was a risk that the energy efficiency or discharge power may be lowered, because the deformation of flexible membrane is not very great, even though there is any effect in separating the discharge liquid and the bubbling liquid.

As above described, in a liquid discharge head for discharging the liquid due to a pressure caused by a bubble produced, it is important to bring about film boiling evenly. If there is any dispersion in forming the bubble, the discharge of liquid will become unstable.

Also, the liquid flow passage is divided into two portions for the discharge liquid and the bubbling liquid, a bubble is produced in the bubbling liquid by generating the heat with the heat generating member in the liquid flow passage for the bubbling liquid, and a pressure due to the bubble produced is transferred to the liquid flow passage for the discharge liquid owing to displacement of a movable member provided between the liquid flow passage for discharge liquid and the liquid flow passage for bubbling liquid, whereby there was a problem that when there is any residual bubble present in the bubble generating area, it may disorder the displacing operation of the movable member.

Herein, there are some cases where the gas is dissolved in the bubbling liquid, so that the gas dissolved is precipitated outside due to temperature elevation of the liquid in the continuous discharge to make the bubbling unstable, but this can be resolved by deaeration of the liquid to some extent.

However, there is a problem that when the liquid discharge head is left away for a long term, the gas may be mixed again into the liquid remaining near the discharge ports or the liquid chamber.

Also, in the liquid discharge head using the movable member as above described, there is a risk that the displacing operation of the movable member as such can not be obtained when driven at high rates of 10 kHz or more, depending on the liquid used.

Still, there is a further problem that where the discharge liquid is weak to the heat, there occur burnt deposits on the heat generating member, if the discharge liquid is entered into the liquid flow passage for bubbling liquid, thereby making it difficult to stably produce the bubble in the bubble producing area, and resulting in unstable discharge.

A main subject of the present invention is to raise the fundamental discharge characteristics of the system of discharging the liquid fundamentally by forming a conventional bubble (especially a bubble caused by film boiling) in the liquid flow passage to the conventionally unexpected level from the viewpoint not conceived conventionally.

The inventors effortfully made acute researches to provide a new liquid droplet discharge method using the bubble which has not been obtained conventionally by returning to the principle of discharging the liquid droplet, and a head for use therewith. Hereby, we made a first technological analysis based on the operation of a movable member in the liquid flow passage such as analyzing the principle of the mechanism of the movable member in the flow passage, a second technological analysis based on the liquid droplet discharge principle with the bubble, and a third technological analysis based on the bubble forming area of the heat generating member for forming the bubble.

From these analyses, we established a completely new technology for actively controlling the bubble in such a manner that in the positional relation between the fulcrum of movable member and the free end, the free end is located on the discharge port side, or downstream, and the movable member is disposed toward the heat generating member or the bubble producing area.

Then, considering the energy that the bubble itself applies in the amount of discharge, we came to realize that the growth component of bubble on the downstream side is the greatest factor for enhancing the discharge characteristics remarkably. That is, we found that if the growth component of bubble on the downstream side is transmitted to the discharge direction efficiently, the discharge efficiency or discharge speed will be increased. From this, the inventors reached a very high technical level, as compared with the conventional technical level of transferring the growth component of bubble on the downstream side toward the free end of the movable member.

Further, we found that it is preferable to take into consideration the structural elements such as a movable member or a liquid flow passage involving in the growth of bubble in the heat generating area for forming the bubble, e.g., downstream from the central line passing through the area center of the electricity-heat converter in the liquid flow direction, or downstream from the bubble such as on the area center of the face governing the bubble generation.

On the other hand, we found that the refill rate can be greatly increased by considering the disposition of movable member and the structure of liquid supply passage.

Further, we found that the head having a movable member using that technology can take a structure of two liquid flow passages consisting of a first liquid flow passage communicating to the discharge port and a second liquid flow passage containing the bubble producing area because the gas producing area is separated from the discharge port area, whereby there are provided a two-liquid type head using two liquids of the discharge liquid and the bubbling liquid (different from the discharge liquid) and a one-liquid type head using a common liquid for the discharge liquid and the bubbling liquid (which is practically the discharge liquid but different from the discharge liquid in the head of two-liquid type).

And especially in the head of two-liquid type as above described, a discharge liquid of high viscosity may be used, or the flow resistance of the liquid flow passage on the bubble generation side may be increased. Also, we found that in such a case, with a recovery method, as performed in a head of conventional bubble jet method, of sucking bubbles within the head or the dirt near the orifices from the orifice plate face with a pump of suction type, it is difficult to recover sufficiently both the bubbling liquid and the discharge liquid.

SUMMARY OF THE INVENTION

The inventors and the applicant have applied a superior liquid discharge principle, the knowledge thus obtained in the researches and the comprehensive viewpoint, but the present inventors came to recollect a more preferable idea on the premise of this invention.

A point that the present inventors have recognized, especially the present invention, resides in providing a liquid discharge head and a head cartridge which can relieve a burden on the recovery system of the main device while preventing the mixture or diffusion of two liquids for use to make the discharge power more stable.

A first object of the present invention is to provide a simple and self-recoverable liquid discharge head, and a head cartridge, which can relieve a load on the recovery system of the main device, while preventing the mixture or diffusion of two liquids to make the discharge power more stable.

A second object of the present invention is to provide a liquid discharge head, and a head cartridge, which can greatly reduce the heat accumulation on the liquid over the heat generating member while increasing the discharge efficiency and the discharge pressure, and can effect the excellent liquid discharge by reducing the residual bubble over the heat generating member.

A third object of the present invention is to provide a liquid discharge head, and a head cartridge, which has a higher refill frequency and an increased printing speed by reducing the recession amount of meniscus with the valve function of movable member, while suppressing the inertial force acting in a direction opposite to the liquid supply direction owing to back wave.

A fourth object of the present invention is to provide a liquid discharge head, and a heat cartridge, which can reduce the deposits onto the head generating member, and use the discharge liquid in various ways, with a sufficiently high discharge efficiency or discharge power.

A fifth object of the present invention is to provide a liquid discharge head, and a head cartridge, which can raise the degree of freedom in selecting the discharge liquid.

A sixth object of the present invention is to provide a liquid discharge head, and a head cartridge, which can be easily manufactured as previously described.

To accomplish the above objects, the present invention provides a liquid discharge head comprising discharge ports for discharging the liquid, a bubble producing area for producing an air bubble in the liquid of liquid flow channels, and a movable member, disposed toward the bubble producing area, which is displaceable between a first position and a second position farther away from the bubble producing area than the first position, the liquid discharge head discharging the liquid in such a manner that the movable member is displaced from the first position to the second position owing to a pressure caused by a bubble produced in the bubble producing area, and the bubble is more greatly expanded downstream than upstream in a direction toward the discharge port, due to the displacement of the movable member, characterized by having a check valve disposed in a liquid supply passage leading to the liquid flow channels.

Also, the invention provides a liquid discharge head comprising discharge ports for discharging the liquid, liquid flow channels each having a heating element for applying heat to the liquid to produce a bubble in the liquid, and a supply passage for supplying the liquid onto the heating element from the upstream side of the heating element along the heating element, and a movable member, provided toward the heating element, with a free end on the discharge port side, for displacing the free end due to a pressure caused by the bubble produced to conduct the pressure to the discharge port side, characterized by having a check valve disposed in the liquid supply passage.

Also, the invention provides a liquid discharge head comprising discharge ports for discharging the liquid, a heating element for applying heat to the liquid to produce a bubble in the liquid, a movable member, provided toward the heating element, with a free end on the discharge port side, for displacing the free end due to a pressure caused by the bubble produced to conduct the pressure to the discharge port side, and a supply passage for supplying the liquid onto the heating element from the upstream side thereof along the face of the movable member closer to the heating element, characterized by having a check valve disposed in the liquid supply passage.

Also, the invention provides a liquid discharge head comprising a first liquid flow channel communicating to a discharge port, a second liquid flow channel having a bubble producing area for producing a bubble in the liquid by applying heat to the liquid, and a movable member, disposed between the first liquid flow channel and the bubble producing area, with a free end on the discharge port side, for displacing the free end toward the first liquid flow channel due to a pressure caused by the bubble produced within the bubble producing area to conduct the pressure to the discharge port side of the first liquid flow channel, characterized by having a check valve disposed in a liquid supply passage leading to either one of the first and second liquid flow channels.

Also, the invention provides a liquid discharge head comprising a first liquid flow channel communicating to a discharge port, a second liquid flow channel having a bubble producing area for producing a bubble in the liquid by applying heat to the liquid, and a movable member, disposed between the first liquid flow channel and the bubble producing area, with a free end on the discharge port side, for displacing the free end toward the first liquid flow channel due to a pressure caused by the bubble produced within the bubble producing area to conduct the pressure to the discharge port side of the first liquid flow channel, characterized by having a check valve disposed in a liquid supply passage leading to the first and second liquid flow channels.

Also, the invention provides a liquid discharge head comprising:

a grooved member having as a piece a plurality of discharge ports for discharging the liquid, a plurality of channels for making up a plurality of first liquid flow channels directly communicating to and corresponding to respective discharge ports, and a recess portion for constituting a first common liquid chamber for supplying the liquid to the plurality of first liquid flow channels;

an element substrate having a plurality of heating elements arranged for producing a bubble in the liquid by applying heat to the liquid; and a separation wall, disposed between the grooved member and the element substrate, for composing a part of a wall for the second liquid flow channel corresponding to the heating element, and having a movable member which is displaceable toward the first liquid flow channel by a pressure due to a bubble produced at the position opposed to the heating element, characterized by having a check valve disposed in a liquid supply passage leading to either one of the first and second liquid flow channels.

Also, the invention provides a liquid discharge head comprising:

a grooved member having as a piece a plurality of discharge ports for discharging the liquid, a plurality of channels for making up a plurality of first liquid flow channels directly communicating to and corresponding to respective discharge ports, and a recess portion for constituting a first common liquid chamber for supplying the liquid to the plurality of first liquid flow channels;

an element substrate having a plurality of heating elements arranged for producing a bubble in the liquid by applying heat to the liquid; and a separation wall, disposed between the grooved member and the element substrate, for composing a part of a wall for the second liquid flow channel corresponding to the heating element, and having a movable member which is displaceable toward the first liquid flow channel by a pressure due to a bubble produced at the position opposed to the heating element, characterized by having a check valve disposed in a liquid supply passage leading to either one of the first and second liquid flow channels.

Also, the invention provides a liquid discharge head characterized in that the check valve provided on the liquid supply passage to the first liquid flow channel and the check valve provided on the liquid supply passage to the second liquid flow channel have different characteristics.

Also, the invention provide a liquid discharge head characterized in that the check valve operates with a pressure different between liquids on both sides of the check valve.

Also, the invention provides a liquid discharge head characterized by comprising offset means for offsetting the pressure different on which the check valve operates.

Also, the invention provides a liquid discharge head characterized in that the offset means is a rib which is provided to be in contact with the check valve.

Also, the invention provides a liquid discharge head characterized in that the check valve is formed integrally with the separation wall.

Also, the invention provides a liquid discharge head comprising discharge ports for discharging the liquid, a bubble producing area for producing an air bubble in the liquid of liquid flow channels, and a movable member, disposed toward the bubble producing area, which is displaceable between a first position and a second position farther away from the bubble producing area than the first position, the liquid discharge head discharging the liquid in such a manner that the movable member is displaced from the first position to the second position by a pressure due to a bubble produced in the bubble producing area, and the bubble is more greatly expanded downstream than upstream in a direction toward the discharge port, due to the displacement of the movable member, characterized by having a valve for preventing the liquid on the side of the liquid flow channel and the liquid on the opposite side from the liquid flow channel from mixing within a liquid supply passage into the liquid flow channels.

Also, the invention provides a liquid discharge head comprising discharge ports for discharging the liquid, liquid flow channels each having a heating element for applying heat to the liquid to produce a bubble in the liquid, and a supply passage for supplying the liquid onto the heating element from the upstream side of the heating element along the heating element, and a movable member, provided toward the heating element, with a free end on the discharge port side, for displacing the free end due to a pressure caused by the bubble produced to conduct the pressure to the discharge port side, characterized by having a valve for preventing the liquid on the side of the liquid flow channel and the liquid on the opposite side from the liquid flow channel from mixing within a liquid supply passage into the liquid flow channel.

Also, the invention provides a liquid discharge head comprising discharge ports for discharging the liquid, a heating element for applying heat to the liquid to produce a bubble in the liquid, a movable member, provided toward the heating element, with a free end on the discharge port side, for displacing the free end due to a pressure caused by the bubble produced to conduct the pressure to the discharge port side, and a supply passage for supplying the liquid onto the heating element from the upstream side thereof along the face of the movable member closer to the heating element, characterized by having a valve for preventing the liquid on the side of the liquid flow channel and the liquid on the opposite side from the liquid flow channel from mixing within a liquid supply passage into the liquid flow channel.

Also, the invention provides a liquid discharge head comprising a first liquid flow channel communicating to a discharge port, a second liquid flow channel having a bubble producing area for producing a bubble in the liquid by applying heat to the liquid, and a movable member, disposed between the first liquid flow channel and the bubble producing area, with a free end on the discharge port side, for displacing the free end toward the first liquid flow channel due to a pressure caused by the bubble produced within the bubble producing area to conduct the pressure to the discharge port side of the first liquid flow channel, characterized by having a valve for preventing the liquid on the side of the liquid flow channel and the liquid on the opposite side from the liquid flow channel from mixing within a liquid supply passage leading to either one of the first and second liquid flow channels.

Also, the invention provides a liquid discharge head comprising a first liquid flow channel communicating to a discharge port, a second liquid flow channel having a bubble producing area for producing a bubble in the liquid by applying heat to the liquid, and a movable member, disposed between the first liquid flow channel and the bubble producing area, with a free end on the discharge port side, for displacing the free end toward the first liquid flow channel due to a pressure caused by the bubble produced within the bubble producing area to conduct the pressure to the discharge port side of the first liquid flow channel, characterized by having a valve for preventing the liquid on the side of the liquid flow channel and the liquid on the opposite side from the liquid flow channel from mixing within a liquid supply passage leading to the first and second liquid flow channels.

Also, the invention provides a liquid discharge head comprising:

a grooved member having integrally a plurality of discharge ports for discharging the liquid, a plurality of channels for making up a plurality of first liquid flow channels directly communicating to and corresponding to respective discharge ports, and a recess portion for constituting a first common liquid chamber for supplying the liquid to the plurality of first liquid flow channels;

an element substrate having a plurality of heating elements arranged for producing a bubble in the liquid by applying heat to the liquid; and a separation wall, disposed between the grooved member and the element substrate, for composing a part of a wall for the second liquid flow channel corresponding to the heating element, and having a movable member which is displaceable toward the first liquid flow channel by a pressure due to a bubble produced at the position opposed to the heating element, characterized by having a valve for preventing the liquid on the side of the liquid flow channel and the liquid on the opposite side from the liquid flow channel from mixing within a liquid supply passage leading to either one of the first and second liquid flow channels.

Also, the invention provides a liquid discharge head comprising:

a grooved member having integrally a plurality of discharge ports for discharging the liquid, a plurality of channels for making up a plurality of first liquid flow channels directly communicating to and corresponding to respective discharge ports, and a recess portion for constituting a first common liquid chamber for supplying the liquid to the plurality of first liquid flow channels;

an element substrate having a plurality of heating elements arranged for producing a bubble in the liquid by applying heat to the liquid; and a separation wall disposed between the grooved member and the element substrate, for composing a part of a wall for the second liquid flow channel corresponding to the heating element, and having a movable member which is displaceable toward the first liquid flow channel by a pressure due to a bubble produced at the position opposed to the heating element, characterized by having a valve for preventing the liquid on the side of the liquid flow channel and the liquid on the opposite side from the liquid flow channel from mixing within a liquid supply passage leading to the first and second liquid flow channels.

Also, the invention provides a liquid discharge head characterized in that the valve provided on the liquid supply passage to the first liquid flow channel and the valve provided on the liquid supply passage to the second liquid flow channel have different characteristics.

Also, the invention provides a liquid discharge head characterized in that the valve operates with a pressure difference between liquids on both sides of the valve.

Also, the invention provides a liquid discharge head characterized in that the valve opens only when the pressure of liquid on the side of the liquid flow channel is lower than that on the opposite side of the liquid flow channel.

Also, the invention provides a liquid discharge head characterized in that the ratio between the discharge amount of liquid into the first liquid flow channel and that into the second liquid flow channel is controlled by the difference in characteristics between the check valves.

Also, the invention provides a liquid discharge head characterized in that the ratio between the discharge amount of liquid passed into the first liquid flow channel and that into the second liquid flow channel is controlled by the difference in characteristics between the valves.

Also, the invention provides a liquid discharge head characterized by comprising a liquid tank having a positive pressure not exceeding a pressure applied onto the valve from the liquid flow channel, when the valve begins to open.

Also, the invention provides a liquid discharge head comprising discharge ports for discharging the liquid, a bubble producing area for producing an air bubble in the liquid of liquid flow channels, and a movable member, disposed toward the bubble producing area, which is displaceable between a first position and a second position farther away from the bubble producing area than the first position, the liquid discharge head discharging the liquid in such a manner that the movable member is displaced from the first position to the second position by a pressure due to a bubble produced in the bubble producing area, and the bubble is more greatly expanded downstream than upstream in a direction toward discharge port, due to the displacement of the movable member, characterized by having a valve, disposed in a liquid supply passage leading to the liquid flow channels, which can be opened or closed owing to the bubble produced by the heating element.

Also, the invention provides a liquid discharge head comprising discharge ports for discharging the liquid, liquid flow channels each having a heating element for applying heat to the liquid to produce a bubble in the liquid, and a supply passage for supplying the liquid onto the heating element from the upstream side of the heating element along the heating element, and a movable member, provided toward the heating element, with a free end on the discharge port side, for displacing the free end due to a pressure caused by the bubble produced to conduct the pressure to the discharge port side, characterized by having a valve, disposed in the liquid supply passage, which can be opened or closed owing to the bubble produced by the heating element.

Also, the invention provides a liquid discharge head comprising discharge ports for discharging the liquid, a heating element for applying heat to the liquid to produce a bubble in the liquid, a movable member, provided toward the heating element, with a free end on the discharge port side, for displacing the free end due to a pressure caused by the bubble produced to conduct the pressure to the discharge port side, and a supply passage for supplying the liquid onto the heating element from the upstream side thereof along the face of the movable member closer to the heating element, characterized by having a valve disposed in the liquid supply passage, which can be opened or closed owing to the bubble produced by the heating element.

Also, the invention provides a liquid discharge head comprising a first liquid flow channel communicating to a discharge port, a second liquid flow channel having a bubble producing area for producing a bubble in the liquid by applying heat to the liquid, and a movable member, disposed between the first liquid flow channel and the bubble producing area, with a free end on the discharge port side, for displacing the free end toward the first liquid flow channel due to a pressure caused by the bubble produced within the bubble producing area to conduct the pressure to the discharge port side of the first liquid flow channel, characterized by having a valve, disposed in a liquid supply passage leading to each of the liquid flow channels, which can be opened or closed owing to the bubble produced by the heating element.

Also, the invention provides a liquid discharge head comprising:

a grooved member having integrally a plurality of discharge ports for discharging the liquid, a plurality of channels for making up a plurality of first liquid flow channels directly communicating to and corresponding to respective discharge ports, and a recess portion for constituting a first common liquid chamber for supplying the liquid to the plurality of first liquid flow channels;

an element substrate having a plurality of heating elements arranged for producing a bubble in the liquid by applying heat to the liquid; and a separation wall, disposed between the grooved member and the element substrate, for composing a part of a wall for the second liquid flow channel corresponding to the heating element, and having a movable member which is displaceable toward the first liquid flow channel by a pressure due to a bubble produced at the position opposed to the heating element, characterized by having a valve, disposed in a liquid supply passage into the liquid flow channels, which can be opened or closed owing to the bubble produced by the heating element.

Also, the invention provides a liquid discharge head characterized in that the valve opens only when the bubble has been disapeard.

Also, the invention provides a liquid discharge head characterized in that the valve opens only when liquid is supplied into the liquid flow channel.

Also, the invention provides a liquid discharge head comprising discharge ports for discharging the liquid, a bubble producing area for producing an air bubble in the liquid of liquid flow channels, and a movable member, disposed toward the bubble producing area, which is displaceable between a first position and a second position farther away from the bubble producing area than the first position, the liquid discharge head discharging the liquid in such a manner that the movable member is displaced from the first position to the second position by a pressure due to a bubble produced in the bubble producing area, and the bubble is more greatly expanded downstream than upstream in a direction toward discharge port, due to the displacement of the movable member, characterized by having a pressure pump disposed in a liquid supply passage into the liquid flow channels.

Also, the invention provides a liquid discharge head comprising discharge ports for discharging the liquid, liquid flow channels each having a heating element for applying heat to the liquid to produce a bubble in the liquid, and a supply passage for supplying the liquid onto the heating element from the upstream side of the heating element along the heating element, and a movable member, provided toward the heating element, with a free end on the discharge port side, for displacing the free end due to a pressure caused by the bubble produced to conduct the pressure to the discharge port side, characterized by having a pressure pump disposed in the liquid supply passage.

Also, the invention provides a liquid discharge head comprising discharge ports for discharging the liquid, a heating element for applying heat to the liquid to produce a bubble in the liquid, a movable member, provided toward the heating element, with a free end on the discharge port side, for displacing the free end due to a pressure caused by the bubble produced to conduct the pressure to the discharge port side, and a supply passage for supplying the liquid onto the heating element from the upstream side thereof along the face of the movable member closer to the heating element, characterized by having a pressure pump disposed in the liquid supply passage.

Also, the invention provides a liquid discharge head comprising a first liquid flow channel communicating to a discharge port, a second liquid flow channel having a bubble producing area for producing a bubble in the liquid by applying heat to the liquid, and a movable member, disposed between the first liquid flow channel and the bubble producing area, with a free end on the discharge port side, for displacing the free end toward the first liquid flow channel due to a pressure caused by the bubble produced within the bubble producing area to conduct the pressure to the discharge port side of the first liquid flow channel, characterized by having a pressure pump disposed in a liquid supply passage into each of the liquid flow channels.

Also, the invention provides a liquid discharge head comprising:

a grooved member having integrally a plurality of discharge ports for discharging the liquid, a plurality of channels for making up a plurality of first liquid flow channels directly communicating to and corresponding to respect discharge ports, and a recess portion for constituting a first common liquid chamber for supplying the liquid to the plurality of first liquid flow channels;

an element substrate having a plurality of heating elements arranged for producing a bubble in the liquid by applying heat to the liquid; and a separation wall, disposed between the grooved member and the element substrate, for composing a part of a wall for the second liquid flow channel corresponding to the heating element, and having a movable member which is displaceable toward the first liquid flow channel by a pressure due to a bubble produced at the position opposed to the heating element, characterized by having a pressure pump disposed in a liquid supply passage into the liquid flow channels.

Also, the invention provides a liquid discharge head comprising discharge ports for discharging the liquid, a bubble producing area for producing an air bubble in the liquid of liquid flow channels, and a movable member, disposed toward the bubble producing area, which is displaceable between a first position and a second position farther away from the bubble producing area than the first position, the liquid discharge head discharging the liquid in such a manner that the movable member is displaced from the first position to the second position by a pressure due to a bubble produced in the bubble producing area, and the bubble is more greatly expanded downstream than upstream in a direction toward discharge port, due to the displacement of the movable member, characterized in that the recovery operation for the discharge ports is performed by discharging the liquid from the discharge ports owing to pressure.

Also, the invention provides a liquid discharge head comprising discharge ports for discharging the liquid, liquid flow channels each having a heating element for applying heat to the liquid to produce a bubble in the liquid, and a supply passage for supplying the liquid onto the heating element from the upstream side of the heating element along the heating element, with a free end on the discharge port side, for displacing the free end due to a pressure caused by the bubble produced to conduct the pressure to the discharge port side, characterized in that the recovery operation for the discharge port is performed by discharging the liquid from the discharge ports owing to pressure.

Also, the invention provides a liquid discharge head comprising discharge ports for discharging the liquid, a heating element for applying heat to the liquid to produce a bubble in the liquid, a movable member, provided toward the heating element, with a free end on the discharge port side, for displacing the free end due to a pressure caused by the bubble produced to conduct the pressure to the discharge port side, and a supply passage for supplying the liquid onto the heating element from the upstream side thereof along the face of the movable member closer to the heating element, characterized in that the recovery operation for the discharge ports is performed by discharging the liquid from the discharge ports owing to pressure.

Also, the invention provides a liquid discharge head comprising a first liquid flow channel communicating to a discharge port, a second liquid flow channel having a bubble producing area for producing a bubble in the liquid by applying heat to the liquid, and a movable member, disposed between the first liquid flow channel and the bubble producing area, with a free end on the discharge port side, for displacing the free end toward the first liquid flow channel due to a pressure caused by the bubble produced within the bubble producing area to conduct the pressure to the discharge port side of the first liquid flow channel, characterized in that the recovery operation for the discharge ports is performed by discharging the liquid from the discharge ports owing to pressure.

Also, the invention provides a liquid discharge head comprising:

a grooved member having integrally a plurality of discharge ports for discharging the liquid, a plurality of channels for making up a plurality of first liquid flow channels directly communicating to and corresponding to respective discharge ports, and a recess portion for constituting a first common liquid chamber for supplying the liquid to the plurality of first liquid flow channels;

an element substrate having a plurality of heating elements arranged for producing a bubble in the liquid by applying heat to the liquid; and a separation wall, disposed between the grooved member and the element substrate, for composing a part of a wall for the second liquid flow channel corresponding to the heating element, and having a movable member which is displaceable toward the first liquid flow channel by a pressure due to a bubble produced at the position opposed to the heating element, characterized in that the recovery operation for the discharge ports is performed by discharging the liquid from the discharge ports owing to pressure.

Also, the invention provides a liquid discharge head characterized in that after the recovery operation, the printing operation is performed by discharging the liquid from the discharge ports.

Also, the invention provides a liquid discharge head characterized in that after the recovery operation, the printing operation is performed by discharging the liquid from the discharge ports.

Also, the invention provides a liquid discharge head comprising discharge ports for discharging the liquid, a bubble producing area for producing an air bubble in the liquid of liquid flow channels, and a movable member, disposed toward the bubble producing area, which is displaceable between a first position and a second position farther away from the bubble producing area than the first position, the liquid discharge head discharging the liquid in such a manner that the movable member is displaced from the first position to the second position by a pressure due to a bubble produced in the bubble producing area, and the bubble is more greatly expanded downstream than upstream in a direction toward discharge port, due to the displacement of the movable member, characterized by having a cap attached to the liquid discharge head which allows the opening or closing of the discharge ports freely.

Also, the invention provides a liquid discharge head comprising discharge ports for discharging the liquid, liquid flow channels each having a heating element for applying heat to the liquid to produce a bubble in the liquid, and a supply passage for supplying the liquid onto the heating element from the upstream side of the heating element along the heating element, and a movable member, provided toward the heating element, with a free end on the discharge port side, for displacing the free end due to a pressure caused by the bubble produced to conduct the pressure to the discharge port side, characterized by having a cap attached to the liquid discharge head which allows the opening or closing of the discharge ports freely.

Also, the invention provides a liquid discharge head comprising discharge ports for discharging the liquid, a heating element for applying heat to the liquid to produce a bubble in the liquid, a movable member, provided toward the heating element, with a free end on the discharge port side, for displacing the free end due to a pressure caused by the bubble produced to conduct the pressure to the discharge port side, and a supply passage for supplying the liquid onto the heating element from the upstream side thereof along the face of the movable member closer to the heating element, characterized by having a cap attached to the liquid discharge head which allows the opening or closing of the discharge ports freely.

Also, the invention provides a liquid discharge head comprising, a first liquid flow channel communicating to a discharge port, a second liquid flow channel having a bubble producing area for producing a bubble in the liquid by applying heat to the liquid, and a movable member, disposed between the first liquid flow channel and the bubble producing area, with a free end on the discharge port side, for displacing the free end toward the first liquid flow channel due to a pressure caused by the bubble produced within the bubble producing area to conduct the pressure to the discharge port side of the first liquid flow channel, characterized by further comprising, a cap attached to the liquid discharge head which allows the opening or closing of the discharge ports freely.

Also, the invention provides a liquid discharge head comprising, a grooved member having as a piece a plurality of discharge ports for discharging the liquid, a plurality of channels for making up a plurality of first liquid flow channels directly communicating to and corresponding to respective discharge ports, and a recess portion for constituting a first common liquid chamber for supplying the liquid to the plurality of first liquid flow channels, an element substrate having a plurality of heating elements arranged for producing a bubble in the liquid by applying heat to the liquid, and a separation wall, disposed between the grooved member and the element substrate, for composing a part of a wall for the second liquid flow channel corresponding to the heating element, and having a movable member which is displaceable toward the first liquid flow channel by a pressure due to a bubble produced at the position opposed to the heating element, characterized by further comprising, a cap attached to the liquid discharge head which allows the opening or closing of the discharge ports freely.

Also, the invention provides a liquid discharge head characterized in that the cap can open or close the discharge ports by sliding with respect to the discharge ports.

Also, the invention provides a liquid discharge head characterized in that the cap can open or close the discharge ports by revolving with respect to the discharge ports.

Also, the invention provides a liquid discharge head characterized in that the cap can open the discharge ports by separating away from the discharge ports, and close the discharge ports by making close contact with the discharge ports.

Also, the invention provides a liquid discharge head characterized in that the cap comprises a liquid holding member.

Also, the invention provides a liquid discharge head characterized in that the cap operate by movement of a carriage when the liquid discharge head is mounted on the carriage.

Also, the invention provides a liquid discharge head characterized in that the cap holds the liquid discharged from the discharge ports in the recovery operation for the discharge ports.

Also, the invention provides a liquid discharge head comprising, discharge ports from which the discharge liquid is discharged, first liquid flow channels for conducting the discharge liquid to the discharge ports, heating elements for generating heat to produce a bubble in the bubbling liquid, second liquid flow channels for conducting the bubbling liquid to the heating elements, and a separation wall having a movable member disposed along the heating element for separation between the first liquid flow channel and the second liquid flow channel, wherein the liquid discharge head discharges the discharge liquid from the discharge ports owing to a bubble produced, characterized in that the bubbling liquid contains the liquid which has been treated for bubble generation stabilization.

Also, the invention provides a liquid discharge head characterized in that the separation wall is made of metal, and the bubbling liquid is predeaerated.

Also, the invention provides a liquid discharge head characterized by further comprising deaerating means for deaerating the bubbling liquid.

Also, the invention provides a liquid discharge head characterized in that the deaerating means comprises a pump for sucking the gas from the bubbling liquid, a gas permeable membrane for permeating only the gas from the bubbling liquid, a gas exhauster for exhausting the gas which has passed through the gas permeable membrane, and a deaerated liquid supply port for supplying the bubbling liquid which has been deaerated into the second liquid flow channels.

Also, the invention provides a liquid discharge head characterized in that the bubbling liquid is added with a burnt deposites antisticking agent.

Also, the invention provides a liquid discharge head characterized in that the burnt deposites antisticking agent is a material having the effect of exfoliating the burnt deposites which have deposited on the heating element.

Also, the invention provides a liquid discharge head characterized in that the burnt deposits antisticking agent is a material for enhancing the wettability and having the effect of preventing the burnt deposites from sticking onto the heating element.

Also, the invention provides a liquid discharge head characterized in that the burnt deposites antisticking agent is a surfactant.

Also, the invention provides a liquid discharge head characterized in that the discharge liquid and the bubbling liquid are the same liquid.

Also, the invention provides a liquid discharge head characterized in that the discharge liquid and the bubbling liquid are different liquids from each other.

Also, the invention provides a liquid discharge head comprising, discharge ports from which the discharge liquid is discharged, first liquid flow channels for conducting the discharge liquid to the discharge ports, heating elements for generating heat to produce a bubble in the bubbling liquid, second liquid flow channels for conducting the bubbling liquid to the heating elements, and a separation wall having a movable member disposed toward the heating element for separation between the first liquid flow channel and the second liquid flow channel, wherein the liquid discharge head discharges the discharge liquid from the discharge ports in such a manner that the movable member is displaced from the first position to the second position by a pressure due to a bubble produced on the heating element, thereby more greatly expanding the bubble downstream than upstream in a direction toward the discharge ports, characterized in that the bubbling liquid contains the liquid which has been treated for bubble generation stabilization.

Also, the invention provides a liquid discharge head, characterized in that the separation wall is made of metal, and the bubbling liquid is predeaerated.

Also, the invention provides a liquid discharge head characterized by further comprising deaerating means for deaerating the bubbling liquid.

Also, the invention provides a liquid discharge head characterized in that the deaerating means comprises, a pump for sucking the gas from the bubbling liquid, a gas permeable membrane for permeating only the gas from the bubbling liquid, a gas exhauster for exhausting the gas which has passed through the gas permeable membrane, and a deaerated liquid supply port for supplying the bubbling liquid which has been deaerated into the second liquid flow channels.

Also, the invention provides a liquid discharge head characterized in that the bubbling liquid is added with a burnt deposites antisticking agent.

Also, the invention provides a liquid discharge head characterized in that the burnt deposites antisticking agent is a material having the effect of exfoliating the burnt deposites which have deposited on the heating elements.

Also, the invention provides a liquid discharge head characterized in that the burnt deposites antisticking agent is a material for enhancing the wettability and having the effect of preventing the burnt deposites from sticking onto the heating element.

Also, the invention provide a liquid discharge head characterized in that the burnt deposites antisticking agent is a surfactant.

Also, the invention provides a liquid discharge head characterized in that the discharge liquid and the bubbling liquid are the same liquid.

Also, the invention provides a liquid discharge head characterized in that the discharge liquid and the bubbling liquid are different liquids from each other.

Also, the invention provides a liquid discharge head characterized in that the gas permeable membrane is made of ethylene fluoride.

Also, the invention provides a liquid discharge head characterized by further comprising a valve disposed in a liquid supply passage into the liquid flow channel, which can be opened or closed owing to a bubble produced by the heating element.

Also, the invention provides a liquid discharge head characterized by further comprising pressure pump disposed in a liquid supply passage into the liquid flow channel.

Also, the invention provides a liquid discharge head characterized by further comprising a cap attached on the liquid discharge head, which allows the opening and closing of the discharge ports freely.

Also, the invention provides a liquid discharge head characterized by further comprising a cap attached on the liquid discharge head, which allows the opening and closing of the discharge ports freely.

Also, the invention provides a liquid discharge head characterized by further comprising a valve disposed in a liquid supply passage into the liquid flow channel, which can be opened or closed owing to a bubble produced by the heating element, a pressure pump disposed in a liquid supply passage into the liquid flow channel, and a cap attached on the liquid discharge head, which allows the opening and closing of the discharge ports freely.

Also, the invention provides a liquid discharge head characterized by further comprising a valve disposed in a liquid supply passage into the liquid flow channel, which can be opened or closed owing to a bubble produced by the heating element, a pressure pump disposed in a liquid supply passage into the liquid flow channel, a cap attached on the liquid discharge head, which allows the opening and closing of the discharge ports freely, and deaerating means for deaerating the liquid within the second liquid flow channel.

Also, the invention provides a head cartridge having the liquid discharge head, and characterized by a liquid vessel for holding the liquid to be supplied to the liquid discharge head.

Also, the invention provides a head cartridge, characterized in that the liquid discharge head and the liquid vessel are separable.

Also, the invention provides a head cartridge, characterized in that the liquid vessel is refilled with the liquid.

Also, the invention provides a head cartridge, characterized in that the liquid vessel is provided with a liquid inlet opening for refilling the liquid.

Also, the invention provides a head cartridge characterized by comprising the liquid discharge head and liquid vessels for holding the discharge liquid to be supplied into the first liquid flow channel and the bubbling liquid to be supplied into the second liquid flow channel.

Also, the invention provides a head cartridge, characterized in that the liquid vessel for holding the bubbling liquid is one for deaerating and bubbling liquid.

Also, the invention provides a liquid discharge apparatus for performing the recording with a liquid discharge head mounted on a carriage, the liquid discharge head comprising, a first liquid flow channel communicating to a discharge port, a second liquid flow channel containing a bubble producing area and disposed adjacent the first liquid flow channel, and a movable member, disposed toward the bubble producing area, which is displaceable between a first position and a second position farther away from the bubble producing area than the first position, wherein the liquid discharge head discharges the liquid from discharge ports in such a manner that the movable member is displaced from the first position to the second position due to a pressure caused by the bubble produced within the bubble producing area to conduct the pressure in a direction toward the discharge ports, characterized by further comprising, recovery means for supplying the liquid to the first and second liquid flow channels, independently, and exhausting the liquid from the discharge ports, and liquid reverse flow preventing means for preventing any reverse flow of liquid from occurring in the first and second liquid flow channels.

Also, the invention provides a liquid discharge apparatus characterized in that the liquid discharge head is provided with a supply system for receiving the supply from a first liquid vessel for containing the first liquid and a second liquid vessel for containing the second liquid, the recovery means is provided with liquid transport means for transporting the liquid to the first and second liquid flow channels, independently, and the liquid transport means transports the first liquid contained within the first liquid vessel to the first liquid flow channel, and the second liquid contained within the second liquid vessel to the second liquid flow channels, independently.

Also, the invention provides a liquid discharge apparatus characterized in that the liquid transport means is a pump for sucking the liquid from the first and second liquid vessels, and forcefully feeding the liquid to the first and second liquid flow channels.

Also, the invention provides a liquid discharge apparatus characterized in that the first and second liquid vessels and the liquid discharge head are connected via a tube, and the pump is a tube pump using the tube.

Also, the invention provides a liquid discharge apparatus characterized in that the liquid transport means is a pump for pressurizing the first and second liquid vessels and forcefully feeding the liquid to the first and second liquid flow channels.

Also, the invention provides a liquid discharge apparatus characterized in that the pump is a tube pump for feeding the air into the first and second liquid vessels.

Also, the invention provides a liquid discharge apparatus characterized in that the liquid discharge head and the first and second liquid vessels are integrally constituted.

Also, the invention provides a liquid discharge apparatus characterized in that the deformation of tube due to a roller of the tube pump is different between the first liquid flow channel side and the second liquid flow channel.

Also, the invention provides a liquid discharge apparatus characterized in that the tube pump is also used as the liquid reverse flow preventing means.

Also, the invention provides a liquid discharge apparatus characterized in that the liquid discharge head, the liquid vessel for supplying the liquid to the liquid discharge head, and the liquid transport means are mounted on a carriage.

Also, the invention provides a liquid discharge apparatus characterized in that the liquid discharge head and the liquid vessel for supplying the liquid to the liquid discharge head are mounted on the carriage, and the liquid transport means is secured to the device main body.

Also, the invention provides a liquid discharge apparatus characterized in that the liquid transport means is a pump for sucking the liquid from the liquid vessels, and forcefully feeding the liquid to the liquid discharge head.

Also, the invention provides a liquid discharge apparatus characterized in that the liquid transport means is a pump for pressurizing the liquid vessels and forcefully feeding the liquid to the liquid discharge head.

Also, the invention provides a liquid discharge apparatus characterized in that the liquid discharge head and the liquid vessels are integrally constituted.

Also, the invention provides a liquid discharge apparatus characterized by further comprising drive signal supply means for supplying a drive signal for discharging the liquid from the liquid discharge head.

Also, the invention provides a liquid discharge apparatus characterized by further comprising recording medium conveying means for conveying the recording medium for accepting the liquid discharged from the liquid discharge head.

Also, the invention provides a liquid discharge apparatus characterized in that the recording is performed in such a manner as to discharge the ink from the liquid discharge head and attach the ink onto the recording sheet.

Also, the invention provides a liquid discharge apparatus characterized in that the recording is performed in such a manner as to discharge the ink from the liquid discharge head and attach the ink onto the cloths.

Also, the invention provides a liquid discharge apparatus characterized in that the recording is performed in such a manner as to discharge the ink from the liquid discharge head and attach the ink onto the plastics.

Also, the invention provides a liquid discharge apparatus characterized in that the recording is performed in such a manner as to discharge the ink from the liquid discharge head and attach the ink onto the metal.

Also, the invention provides a liquid discharge apparatus characterized in that the recording is performed in such a manner as to discharge the ink from the liquid discharge head and attach the ink onto the wood.

Also, the invention provides a liquid discharge apparatus characterized in that the recording is performed in such a manner as to discharge the ink from the liquid discharge head and attach the ink onto the leather.

Also, the invention provides a liquid discharge apparatus characterized in that the color recording is performed in such a manner as to discharge a plurality of color recording liquids from the liquid discharge heads and attach the plurality of color recording liquids onto the recording medium.

Also, the invention provides a liquid discharge apparatus characterized in that the discharge ports are arranged over an entire width of the recordable area for the recording medium.

Also, the invention provides a liquid discharge apparatus having a liquid discharge head comprising discharge ports for discharging the liquid, a bubble producing area for producing an air bubble in the liquid of liquid flow channels, and a movable member, disposed toward the bubble producing area, which is displaceable between a first position and a second position farther away from the bubble producing area than the first position, the liquid discharge head discharging the liquid in such a manner that the movable member is displaced from the first position to the second position by a pressure due to a bubble produced in the bubble producing area to conduct the bubble in a discharge direction owing to displacement of the movable member, wherein the liquid discharge apparatus is provided, in a liquid supply passage into the liquid discharge head, with at least one of a reverse flow preventing valve for allowing only the liquid to be flowed in a head direction, a deaerator for removing the gas dissolved in the liquid, a liquid pump for transporting the liquid in the head direction, an active valve which is capable of controlling the opening and closing of valve, and a cap for accepting the liquid from the discharge ports of the liquid discharge head and openably by closably attached over the discharge ports of the head upon the operation of the carriage which mounts the head thereon, characterized in that the reliability of liquid discharge is enhanced with the above constitution.

Also, the invention provides a liquid discharge apparatus having a liquid discharge head comprising a first liquid channel communicating to discharge ports, a second liquid flow channel having a bubble producing area for producing an air bubble in the liquid by applying heat to the liquid, and a movable member, disposed between the first liquid flow channel and the bubble producing area, with a free end on the discharge port side, for displacing the free end to the first liquid flow channel due to a pressure caused by a bubble produced within the bubble producing area, to conduct the pressure to the discharge port side of the first liquid flow channel, wherein the liquid discharge apparatus is provided, in each liquid supply passage into the liquid discharge head, with at least one of a reverse flow preventing valve for allowing only the liquid to be flowed in a head direction, a deaerator for removing the gas dissolved in the liquid, a liquid pump for transporting the liquid in the head direction, an active valve which is capable of controlling the opening and closing of valve, and a cap for accepting the liquid from the discharge ports of the liquid discharge head and openably or closably attached over the discharge ports of the head upon the operation of the carriage which mounts the head thereon, characterized in that the reliability of liquid discharge is enhanced with the above constitution.

BRIEF DESCRIPTION OF THE DRAWINGS

FIGS. 40A and 40B are views for explaining a recovery device provided in the recording apparatus in a third example of the present invention, wherein FIG. 40A is a perspective view and FIG. 40B is a cross-sectional view.

FIGS. 41A and 41B are views for explaining the flow resistance of a tube pump, wherein FIG. 41A shows the fully closed state and FIG. 41B shows the not fully closed state.

FIGS. 44A and 44B are views for explaining the recovery device in a fourth example of the present invention, wherein FIG. 44A is a perspective view and FIG. 44B is a cross-sectional view.

FIGS. 45A and 45B are views for explaining the recovery device in a fifth example of the present invention, wherein FIG. 45A is a perspective view and FIG. 45B is a cross-sectional view.

FIGS. 46A and 46B are views showing the liquid discharge head and the liquid vessel which are integrally constituted, wherein FIG. 46A shows the tube pump mounted on the carriage, and FIG. 46B shows the tube pump secured to the main unit side of the recording apparatus.

FIGS. 47A and 47B are a view for explaining the recovery device in a sixth example of the present invention, wherein FIG. 47A is a perspective view and FIG. 47B is a cross-sectional view.

DETAILED DESCRIPTION OF THE PREFERRED EMBODIMENTS

Before describing the examples of the present invention, the liquid discharge principle for a liquid discharge head to which the invention is applied will be described below with reference to the drawings.

First Embodiment

First, an example of enhancing the discharge power or discharge efficiency by controlling the propagating direction of pressure owing to the bubble or the growth direction of bubble to discharge the liquid will be given below.

Figure 1A:
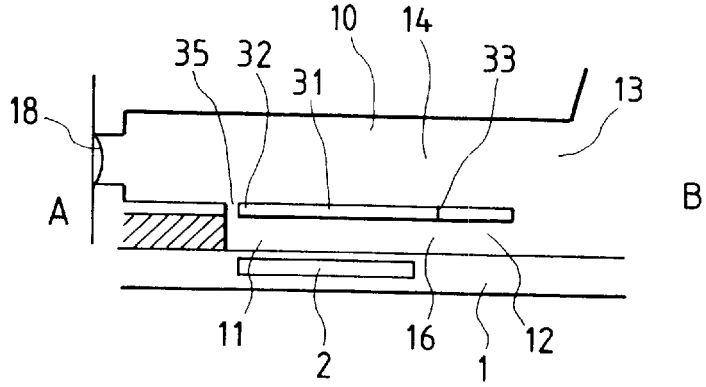
FIGS. 1A, 1B, 1C and 1D are typical cross-sectional views illustrating a liquid discharge head according to the present invention.
Figure 1B:
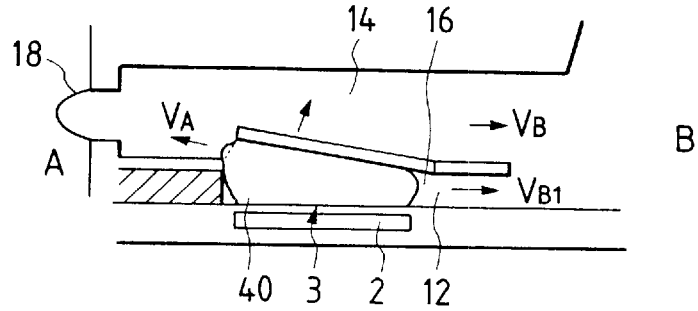
Figure 1C:
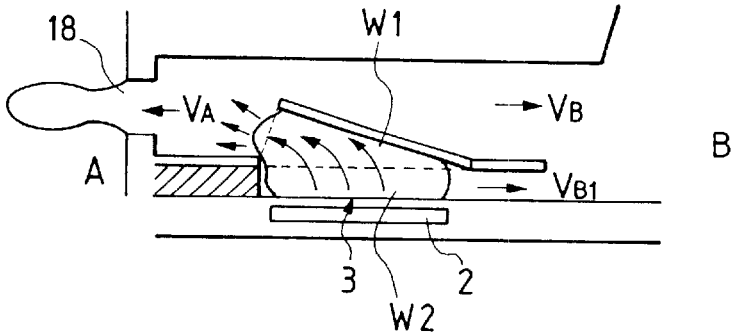
Figure 1D:
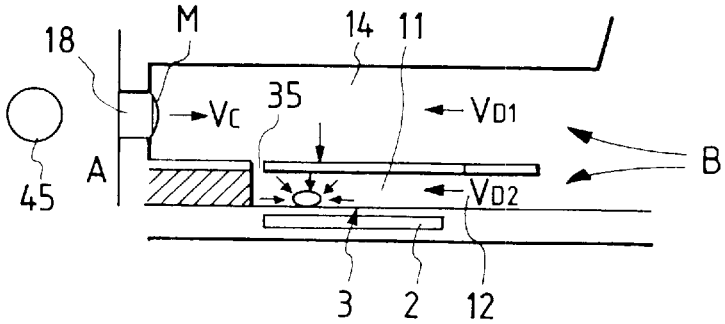
Figure 2:
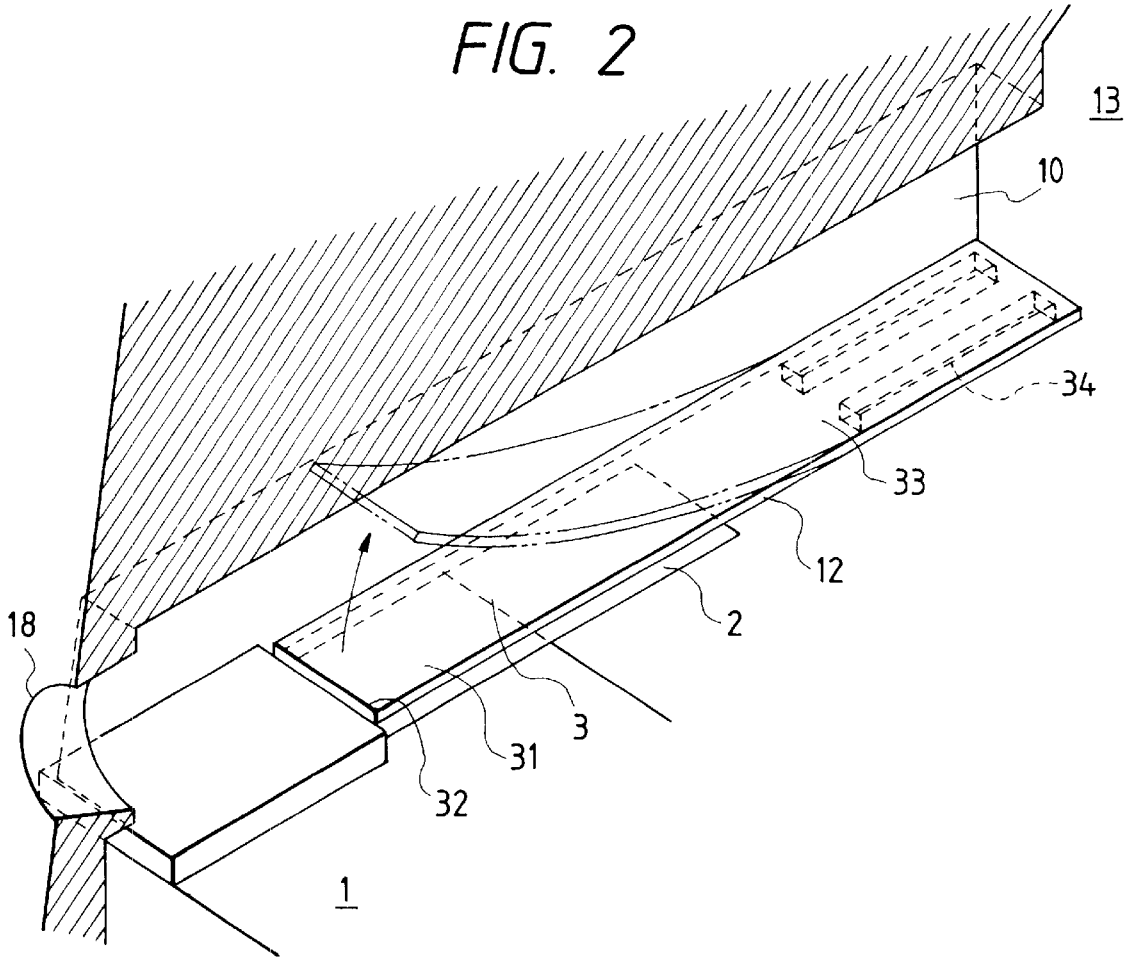
FIG. 2 is a partially cutaway perspective view of the liquid discharge head according to the present invention.

FIGS. 1A to 1D are typical cross-sectional views illustrating a liquid discharge head to which the present invention is applied, and FIG. 2 is a perspective view of the liquid discharge head, partially broken away, according to the invention.

The liquid discharge head in this embodiment has arranged the heating elements 2 (heating resistors having the shape of 40 μm×105 μm in this embodiment) for applying the thermal energy on the liquid as the discharge energy generating element to discharge the liquid, on an element substrate 1, with the liquid flow passages 10 disposed corresponding to respective heating elements 2 on the element substrate 1. A liquid flow passage 10 communicates to a discharge port 18, as well as to a common liquid chamber 13 for supplying the liquid to a plurality of liquid flow passages 10, the same amount of liquid as that discharged from the discharge ports 18 being received from this common liquid chamber 13.

On the element substrate 1 of the liquid flow passage 10, a plate-like movable member 31 made of an elastic material such as metal and having a planar portion is provided in cantilevered form, one end of the movable member 31 being secured to a base board (support member) 34 formed by patterning the photosensitive resin on the wall of liquid flow passage 10 or the element substrate 1. Thereby, the movable member 31 is retained and makes up a fulcrum (fulcrum portion) 33.

The movable member 31 is spaced a distance of about 15 μm away from the heating element 2 to cover the heating element 2 at a position facing the heating element 2, in such a manner as to have the fulcrum (fulcrum portion, fixed end) 33 upstream of the great flow passing from the common liquid chamber 13 via the movable member 31 to the discharge port 18, due to a discharge operation of liquid, and a free end (free end portion) 32 downstream from the fulcrum 33. The portion between the heating element 2 and the movable member 31 is a bubble producing area 11. It is to be noted that the kind or shape and the arrangement of the heating element 2 and the movable member 31 are not limited thereto, but they may be made in any shape and arrangement capable of controlling the growth of bubble or the propagation of pressure, as will be described later. Also, the liquid flow channel 10 as above described, is divided into two area, a first liquid flow passage 14 which is a portion directly communicating to the discharge port 18, with the movable member 31 as the boundary, and a second liquid flow passage 16 having the bubble producing area 11 and a liquid supply passage 12, for the explanation of liquid flow as will be considered later.

The liquid in the bubble producing area 11 between the movable member 31 and the heating element 2 is subjected to heat generated by the heating element 2 to produce a bubble 40 in the liquid owing to a film boiling phenomenon, as described in U.S. Pat. No. 4,723,129. A pressure owing to the bubble 40 produced and the bubble 40 will act preferentially on the movable member 31, so that the movable member 31 is greatly displaced around the fulcrum 33 to open toward the discharge port 18, as shown in FIGS. 1B and 1C or FIG. 2. The propagation of pressure owing to the bubble produced or the growth of bubble 40 itself occurs toward the discharge port by the displacement of the movable member 31 or the displaced state.

Herein, one of the discharge principles which is applied in the present invention will be described below.

One of the important discharge principles applied in the present invention is that the movable member 31 disposed to face the bubble 40 is displaced from the first position in the steady state to the second position which is a position after the displacement, owing to a pressure of the bubble 40 or the bubble 40 itself, so that the pressure by the development of bubble 40 or the bubble 40 itself is conducted downstream where the discharge port 18 is disposed by this displaced movable member 31.

This principle will be described below in greater detail, compared with the conventional liquid flow passage structure.

Figure 3:
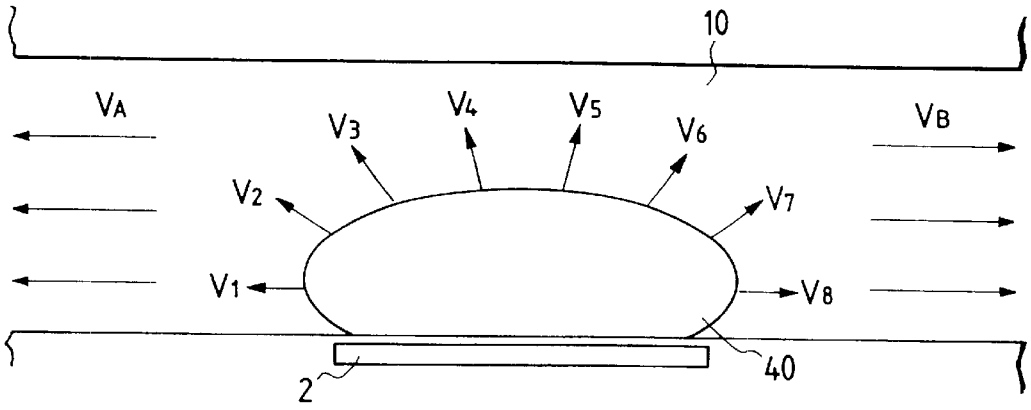
FIG. 3 is a typical view showing the pressure propagation from a bubble in the conventional head.
Figure 4:
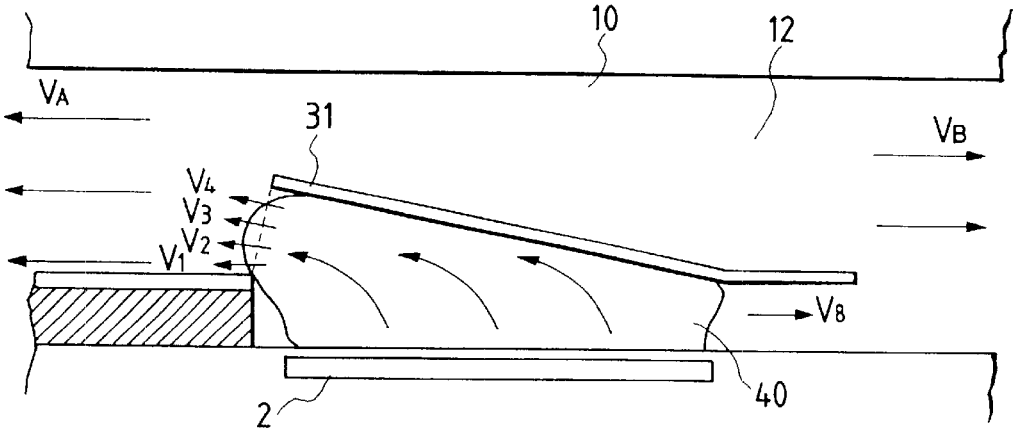
FIG. 4 is a typical view showing the pressure propagation from a bubble in the head according to the invention.

FIG. 3 is a typical view showing the propagation of pressure from the bubble in the conventional head, and FIG. 4 is a typical view showing the propagation of pressure from the bubble in the head which is applied in the invention. Herein, note that the propagation direction of pressure toward the discharge port is indicated by $V_A$, and the propagation direction of pressure upstream is indicated by $V_B$.

In the conventional head as shown in FIG. 3, there is no constitution of regulating the propagation direction of pressure due to the bubble 40 produced. Therefore, the pressure propagation direction of bubble 40 is the direction normal to the surface of bubble, as indicated by $V_1$ to $V_8$, and thus directed in various ways. Among them, the pressure propagation direction the component of which includes a $V_A$ direction with the greatest influence on the liquid discharge is $V_1$ to $V_4$, that is, directional components of pressure propagation from the substantial half portion of bubble closer to the discharge port, which is an important portion directly contributing to the liquid discharge efficiency, liquid discharge power and discharge speed. Further, $V_1$ which is closest to the discharge direction $V_A$ will most efficiently work, while $V_4$ has the smallest directional component toward $V_A$.

On the contrary, in the embodiment as shown in FIG. 4 which is applicable to the present invention, the movable member 31 conducts the pressure propagation directions $V_1$ to $V_4$ of bubble which were directed in various ways in FIG. 3 to the downstream side (discharge port side) and transforms them to a pressure propagation direction of $V_A$, whereby the pressure of bubble 40 will directly contribute to the discharge efficiently. And the bubble growth direction itself is also conducted downstream, as with the pressure propagation directions $V_1$ to $V_4$, so that the bubble will grow more greatly downstream than upstream. In this way, the fundamental improvements in the discharge efficiency, the discharge power or the discharge speed can be attained by controlling the bubble growth direction itself by means of the movable member, and thus the pressure propagation direction of bubble.

Turning back to FIGS. 1A to 1D, the discharge operation of the liquid discharge head in this embodiment will be described in greater detail.

FIG. 1A shows a state before the energy such as electrical energy is applied on the heating element 2, or before the heating element 2 generates the heat.

What is important herein is that the movable member 31 is provided at a position facing at least the downstream part of a bubble produced by heating of the heating element 2. Namely, the movable member 31 extends at least downstream of the area center 3 of the heating element 2 (downstream of the line orthogonal to the length direction of the flow passage passing through the area center 3 of the heating element) on the structure of liquid flow passage, so that the downstream part of bubble will act on the movable member 31.

FIG. 1B shows a state where the electrical energy is applied to the heating element 2 to cause the heating element 2 to generate the heat, and heat a part of the liquid filled within the bubble producing area 11 by the generated heat to produce a bubble 40 owing to film boiling.

Then, the movable member 31 is displaced from the first position to the second position, due to a pressure by the development of the bubble, to lead the pressure propagation direction of the bubble 40 toward the discharge port side. What is important herein is that at least a portion of the movable member 31 is faced to the downstream portion of the heating element 2 or the downstream part of the bubble 40, with the free end 32 of the movable member 31 disposed downstream (on the discharge port side) and the fulcrum 33 disposed upstream (on the common liquid chamber side), as previously described.

FIG. 1C shows a state where the bubble 40 has been further grown, wherein the movable member 31 is further displaced owing to a pressure by the development of the bubble 40. The developed bubble 40 more greatly grows downstream than upstream, and expands beyond the first position (as indicated by the dotted line) of the movable member 31. In this way, the movable member 31 is gradually displaced with the growing bubble 40 to force the pressure propagation direction of the bubble 40 or the direction along which the movement of deposites is more likely to occur, that is, the growth direction of the bubble to the free end, more uniformly toward the discharge port 18, which is supposed to enhance the discharge efficiency. The movable member 31 is no obstacle in conducting the bubble 40 or the bubble generation pressure toward the discharge port 18, and can control the pressure propagation direction or the growth direction of bubble 40 according to the magnitude of pressure to be propagated.

FIG. 1D shows a state where the bubble 40 shrinks due to a decrease in the internal pressure of bubble after film boiling, as previously mentioned, and disappears.

The movable member 31 which has been displaced up to the second position returns to the initial position (first position) as indicated in FIG. 1A, owing to a negative pressure by the contraction of bubble 40 and a restoring force of the elasticity of the movable member 31 itself. Also, when the bubble disappears, the liquid flows in, as indicated by the flows $V_{D1}$, $V_{D2}$ from the upstream side (B), i.e., the common liquid chamber 13, and a flow $V_C$ from the discharge port 18 to compensate for the contraction volume of bubble 40 in the bubble producing area 11, and to compensate for the volume of liquid which has been discharged.

Thus, the operation of the movable member owing to the development of bubble and the discharge operation of liquid have been described above, but the refill of the liquid in the liquid discharge head to which the present invention is applied will be described below in greater detail.

Referring now to FIGS. 1A to 1D, a liquid supply mechanism which is applied in the present invention will be described in greater detail.

After FIG. 1C, when the bubble 40 enters a bubble disappearance process via a state of the maximum volume, the liquid of the volume to make up the bubble-disappeared volume will flow into the bubble producing area 11 from the discharge port 18 side of the first liquid flow passage 14, as well as from the common liquid chamber 13 of the second liquid flow passage 16. In the conventional liquid flow passage structure without having the movable member 31, the amount of liquid flowing into the bubble disappearance position from the discharge port side and that flowing thereinto from the common liquid chamber depend on the flow passage resistance and the inertia of the liquid therein, which may be caused by the magnitude of flow resistance in the portion closer to the discharge port side than the bubble producing area and the portion closer to the common liquid chamber.

Therefore, when the flow resistance on the side closer to the discharge port is small, it follows that a quantity of liquid will flow from the discharge port side into the bubble disappearance position, resulting in a great recession of meniscus. Particularly, the smaller flow resistance near the discharge port side to enhance the discharge efficiency, the greater recession of meniscus M, when the bubble disappears, whereby it takes a longer refill time to impede the fast printing.

On the contrary, in this embodiment, because of the provision of the movable member 31, where the volume W of bubble is W1 for the upper portion from the first position of the movable member 31 as the boundary, and W2 for the bubble producing area 11, the recession of meniscus will stop at the time when the movable member 31 returns to an original position, in bubble disappearance, whereafter the supply of liquid amounting to the residual volume W2 is made mainly from the liquid of flow $V_{D2}$ in the second flow passage 16. Thereby, while conventionally about half of the volume W of bubble was the recession amount of meniscus, it became possible to suppress the recession amount of meniscus to as small as about half of W1.

Further, since the supply of liquid by the volume W2 can be forcefully made along the face of the movable member 31 to the heating element, mainly from the upstream side ($V_{D2}$) of the second liquid flow passage 16, by the use of pressure when the bubble disappears, the fast refill could be realized.

It is characteristic herein that when making the refill using the pressure in bubble disappearance, with the conventional head, the vibration of meniscus will be larger, resulting in the degraded image quality, whereas in the fast refill of this embodiment, the flow of the liquid through an area of the first liquid flow passage 14 at the discharge port 18 side and the bubble producing area 11 at the discharge port 18 side can be suppressed, thereby making the vibration of meniscus quite small.

In this way, the liquid discharge head to which the invention is applied allows for the improved image quality or the fast recording, when used for the stable discharge or fast repetitive discharge, or in the field of recording, by carrying out the compulsory refill into the bubble generation area via the liquid supply passage 12 of the second flow passage 16 and the fast refill by the recession of meniscus or the suppression of vibration as above described.

In the constitution of the liquid discharge head to which the invention is applied, the following effective functions are also provided.

It is to suppress the propagation (back wave) of pressure to the upstream side owing to development of a bubble. Of the bubble produced on the heating element 2, the pressure due to part of the bubble on the common liquid chamber 13 (upstream) side was mostly a force (back wave) pushing back the liquid to the upstream side. This back wave produces a pressure on the upstream side, the migration amount of liquid therewith, and an inertial force by the movement of liquid, which reduced the refill of liquid into the liquid flow passage and impeded the fast drive.

In the liquid discharge head of the invention, the refill supply ability is further increased by suppressing such action onto the upstream side by means of the movable member 31.

A further characteristic structure and effect of this embodiment will be described below.

The second liquid flow passage 16 in this embodiment comprises a liquid supply passage 12 having an inner wall (the surface of heating element being not greatly depressed) substantially flat leading to the heating element 2 and upstream of the heating element 2. In this case, the supply of liquid onto the bubble producing area 11 and the surface of the heating element 2 occurs along the face of the movable member 31 closer to the bubble producing area 11, as indicated by $V_{D2}$. Therefore, the sediment of liquid on the surface of heating element 2 is suppressed, the deposition of gas dissolved in the liquid or the so-called residual bubble remaining without being disappeared is easily removed, and there is no too high heat reserve into the liquid. Accordingly, the stabler development of bubble can be repeated at high rate. While in this embodiment, the liquid supply passage 12 has a substantially flat inner wall, it should be noted that the liquid supply passage may smoothly lead to the surface of the heating element 2, and have a smooth inner wall, with the shape causing no sediment of the liquid on the heating element 2 or no great turbulent in the supply of the liquid.

Also, the supply of liquid into the bubble producing area 11 is made from the side of the movable member 31 (via a slit 35), as indicated by $V_{D1}$. However, in the cases where a large movable member 31 as shown in FIG. 1 to cover the whole of the bubble producting area 11 (or the face of heating element) is used to conduct the pressure for producing the bubble to the discharge port 18 more effectively, and the flow resistance of liquid is increased in the bubble producing area 11 and the area of the first liquid flow passage 14 closer to the discharge port 18, when the movable member 31 returns to the first position, the flow of liquid toward the bubble producing area 11 from $V_{D1}$ as above mentioned is impeded. However, in the head structure of the invention, there is a flow $V_{D1}$ to supply the liquid to the bubble producing area 11, causing the supply performance of the liquid to be significantly increased, the supply performance of liquid is not degraded, even if a structure of covering the bubble producing area 11 with the movable member 31 seeking the enhanced discharge efficiency is adopted.

Figure 5:
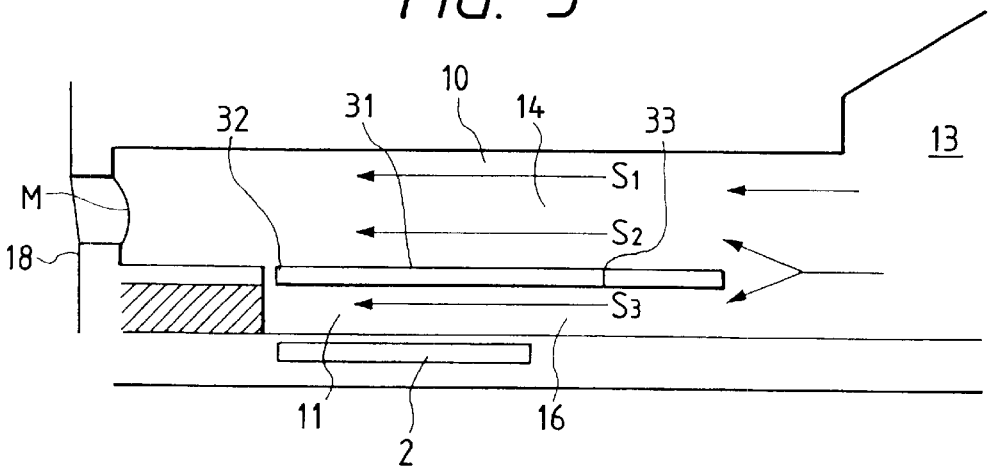
FIG. 5 is a typical view for explaining the flow of liquid in the liquid discharge head according to the invention.

FIG. 5 is a typical view for explaining the flow of liquid in the liquid discharge head to which the present invention is applied.

The positional relation of a free end 32 and a fulcrum 33 of the movable member 31 is such that the free end 32 is located downstream relative to the fulcrum 33. With such constitution, the function or effect of leading the pressure propagation direction or the growth direction of bubble when the bubble disappears as previously mentioned, toward the discharge port 18, can be efficiently realized. Further, this positional relation can accomplish not only the above function or effect for the discharge, but also the fast refill, with reduced flow resistance of the liquid flowing through a liquid flow passage 10 in supplying the liquid. This is because when a meniscus M recessed by the discharge returns to the discharge port 18 owing to a capillary force, or when the liquid is supplied upon bubble disappearance, the free end 32 and the fulcrum 33 are placed not to resist the flows $S_1$, $S_2$ and $S_3$ passing through the liquid flow passage 10 (including the first liquid flow passage 14 and the second liquid flow passage 16), as shown in FIG. 5.

Complementarily, in FIGS. 1A to 1D of this embodiment, the movable member 31 extends to the heating element 2, such that the free end 32 of the movable member 31 is located downstream of an area center 3 of halving the heating element 2 into an upstream area and a downstream area (the line orthogonal to the length direction of the liquid flow passage passing through the area central point (center) of the heating element), as previously described. Thereby, the movable member 31 can receive and conduct the pressure or bubble 40 greatly contributing to the discharge of liquid to be produced downstream of the area center 3 of the heating element 2, toward the discharge port 18, improving the discharge efficiency or the discharge power fundamentally.

Further, various effects can be obtained using the upstream side of bubble 40.

Also, in this embodiment, the free end of the movable member 31 experiencing a momentary mechanical displacement is considered to also effectively contribute to the discharge of liquid.

The head of completely separating the bubbling liquid and the discharge liquid according to the present invention will be described below.

Figure 6:
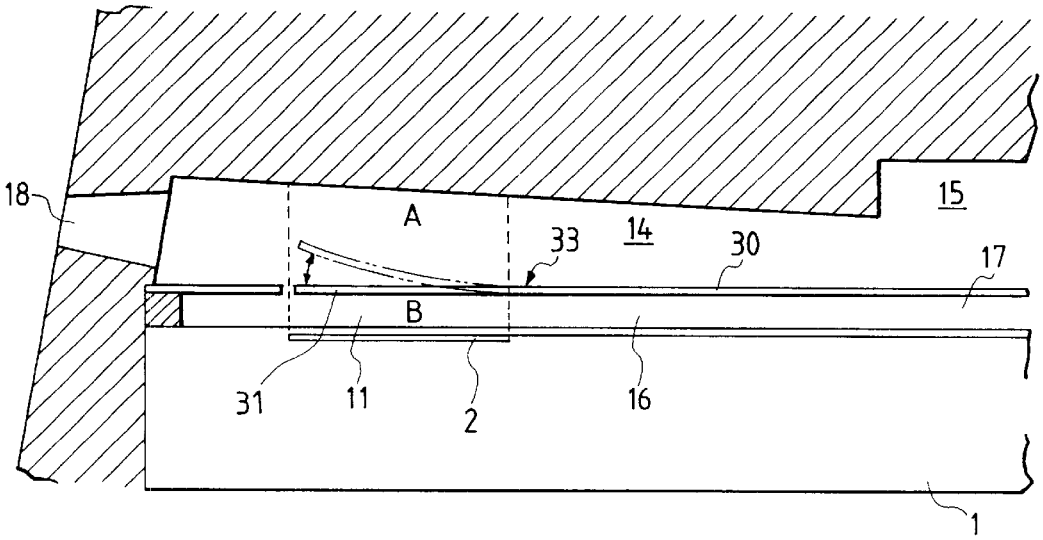
FIG. 6 is a cross-sectional view of a liquid discharge head (two flow passages) according to the present invention.
Figure 7:
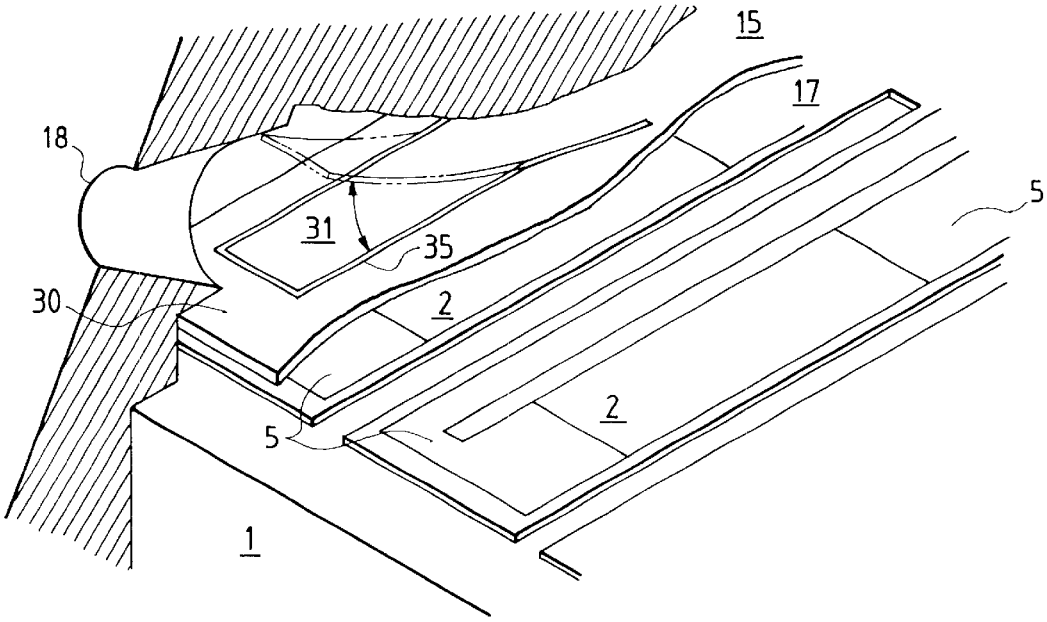
FIG. 7 is a partially cutaway perspective view of the liquid discharge head according to the invention.

FIG. 6 is a cross-sectional view of the liquid discharge head (two flow passages) according to the invention, taken along the flow path direction, and FIG. 7 is a partially cutaway perspective view of the liquid discharge head, as shown in FIG. 6.

A main discharge principle of liquid in this example is the same as in the previous example, except that a multiple liquid flow passage is constructed, and the heat is applied in this example, in order to distinguish between the liquid to be bubble-generated (bubbling liquid) and the liquid to be discharged (discharge liquid).

The liquid discharge head of this constitution is such that on an element substrate 1 with the heating elements 2 for generating the heat energy to produce a bubble in the liquid, the second liquid flow passages 16 for bubble generation are provided, and the first liquid flow passages 14 for discharge liquid directly communicating to the discharge ports 18 are disposed thereon.

The upstream side of the first liquid flow passages 14 is in communication to a first common liquid chamber 15 for supplying the discharge liquid to a plurality of first liquid supply passages 14, and the upstream side of the second liquid flow passages 16 is in communication to a second common liquid chamber 17 for supplying the bubbling liquid to a plurality of second liquid flow passages 16.

Between the first and second liquid flow passages, a separation wall 30 made of a material having elasticity such as metal is disposed to separate between the first liquid flow passages 14 and the second liquid flow passages 16. When the bubbling liquid and the discharge liquid is not to be mixed, the ventilation of liquid between the first liquid flow passages 14 and the second liquid flow passages 16 should be prevented by this separation wall 30 as complete as possible, but when there is no problem even though the bubbling liquid and the discharge liquid are mixed to some extent, it is unnecessary to provide the separation wall 30 with the complete separation function.

A portion of the separation wall 30 located in a projection space (hereinafter a discharge pressure producing area, area A and bubble producing area 11 of B in FIG. 6) upward from the face direction of heating element 2 is cantilevered from the movable member 31, with the free end positioned on the discharge port 18 side (downstream of the liquid flow) by a slit 35, and the fulcrum 33 on the common liquid chamber side (15, 17). This movable member 31, which is disposed facing the bubble producing area 11 of B in FIG. 6 operates to open toward the discharge port 18 and into the first liquid flow passage 14 by bubble generation of the bubbling liquid (as indicated by the arrow in the figure). Also in FIG. 7, the separation wall 30 is disposed via a space providing the second liquid flow passages on the element substrate 1 having arranged thereon the heating resistors as the heating elements and the wiring electrodes 5 for applying the electrical signal to these heating resistors.

The relation in arrangement between the fulcrum 33 and the free end 32 of the movable member 31 and the heating element 2 is the same as in the prior embodiment.

Also, while the structural relation between the liquid supply passage 12 and the heating element 2 was described in the prior embodiment, the structural relation between the second liquid flow passage 16 and the heating element 2 in this embodiment is not changed.

The operation of the liquid discharge head in this embodiment will be described below.

Figure 8A:
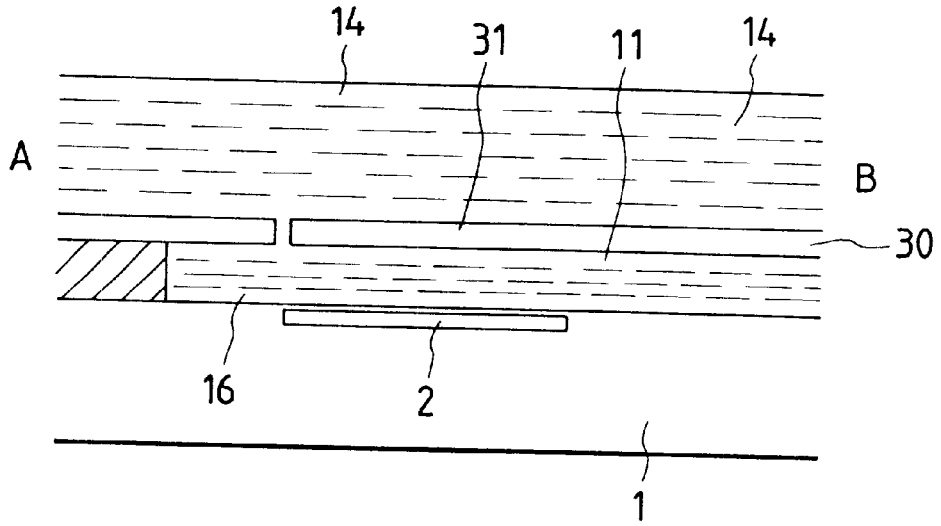
FIGS. 8A and 8B are views for explaining the operation of a movable member.
Figure 8B:
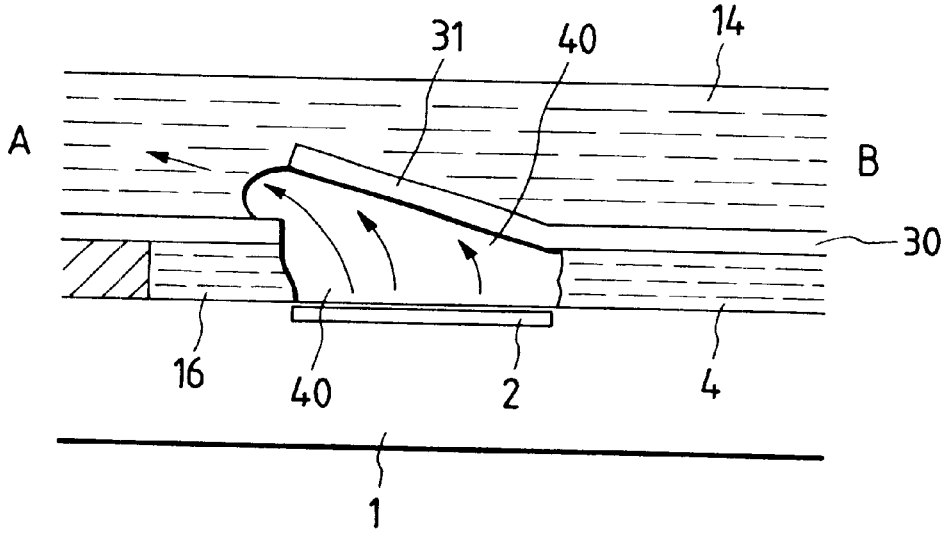

FIGS. 8A and 8B are views for explaining the operation of the movable member.

In driving the head, the same aqueous ink was used for the discharge liquid to be supplied to the first liquid flow passage 14 and the bubbling liquid to be supplied to the second liquid flow passage 16. As the heat generated by the heating element 2 acts on the bubbling liquid within the bubble producing area of the second liquid flow passage 16, a bubble 40 is produced in the bubbling liquid in the same manner as in the prior embodiment, owing to film boiling phenomenon, as described in U.S. Pat. No. 4,723,129.

In this embodiment, because the bubble generation pressure can not be escaped from three sides, except for the upstream side of the bubble producing area 11, the pressure due to development of this bubble is concentrated and propagated on the movable member 31 disposed in a discharge pressure generating portion, so that the movable member 31 is displaced toward the first liquid flow passage 14 from the state of FIG. 8A to that of FIG. 8B, with the growth of the bubble 40. By the operation of this movable member. 31, the first liquid flow passage 14 and the second liquid flow passage 16 are communicated to each other, so that the pressure due to development of the bubble 40 is mainly transferred in a direction (as indicated by A) toward the discharge port of the first liquid flow passage 14. The liquid is discharged from the discharge ports by the propagation of this pressure and the mechanical displacement of the movable member 31 as previously described.

Then, the movable member 31 returns to a position of FIG. 8A as the bubble contracts, and the first liquid flow passage 14 is supplied with the discharge liquid corresponding to the amount of discharge liquid which has been discharged from the upstream side. Also in this embodiment, this discharge liquid is supplied in a direction to allow the movable member to be closed as in the prior embodiment, so that the refill of the discharge liquid is not impeded by the movable member 31.

This embodiment is the same with the action or effect of the main portion regarding the propagation of bubble generation pressure due to displacement of the movable member 31, the growth direction of bubble, and the prevention of back wave as in the prior embodiment, but there are provided the following additional merits by taking the two flow passage construction of this embodiment.

That is, according to the constitution of the embodiment as above described, the discharge liquid and the bubbling liquid are made different, and the discharge liquid can be discharged by the pressure generated by bubble generation of the bubbling liquid. Therefore, conventionally, even with a highly viscous liquid such as polyethylene glycol, which is difficult to generate the bubble fully by applying the heat, with less sufficient discharge power, if this liquid is supplied to the first liquid supply passage, and a liquid for excellently bubble generation (about 1 to 2 cp of a mixture liquid of ethanol and water with the ratio of 4:6), or a liquid of low boiling point as the bubbling liquid is supplied to the second liquid flow passage 16, it is possible to discharge excellently.

Also, as the bubbling liquid, a liquid which will not produce any burnt deposites on the surface of the heating element by being subjected to the heat is selected, whereby the bubble generation is stabler to make the excellent discharge.

Further, in the head structure of the invention, a highly viscous liquid can be discharged with the higher discharge efficiency and higher discharge power to provide the effects as described in the prior embodiment.

Also, even with a liquid which is weak to heating, if this liquid is supplied into the first liquid flow passage 14 as the discharge liquid, and a liquid which is unliable to change in quality and can excellently generate the bubble is supplied into the second liquid flow passage 16, it is possible to discharge with the higher discharge efficiency and higher discharge power without thermally damaging the liquid which is weak to heating.

Second Embodiment

Figure 9:
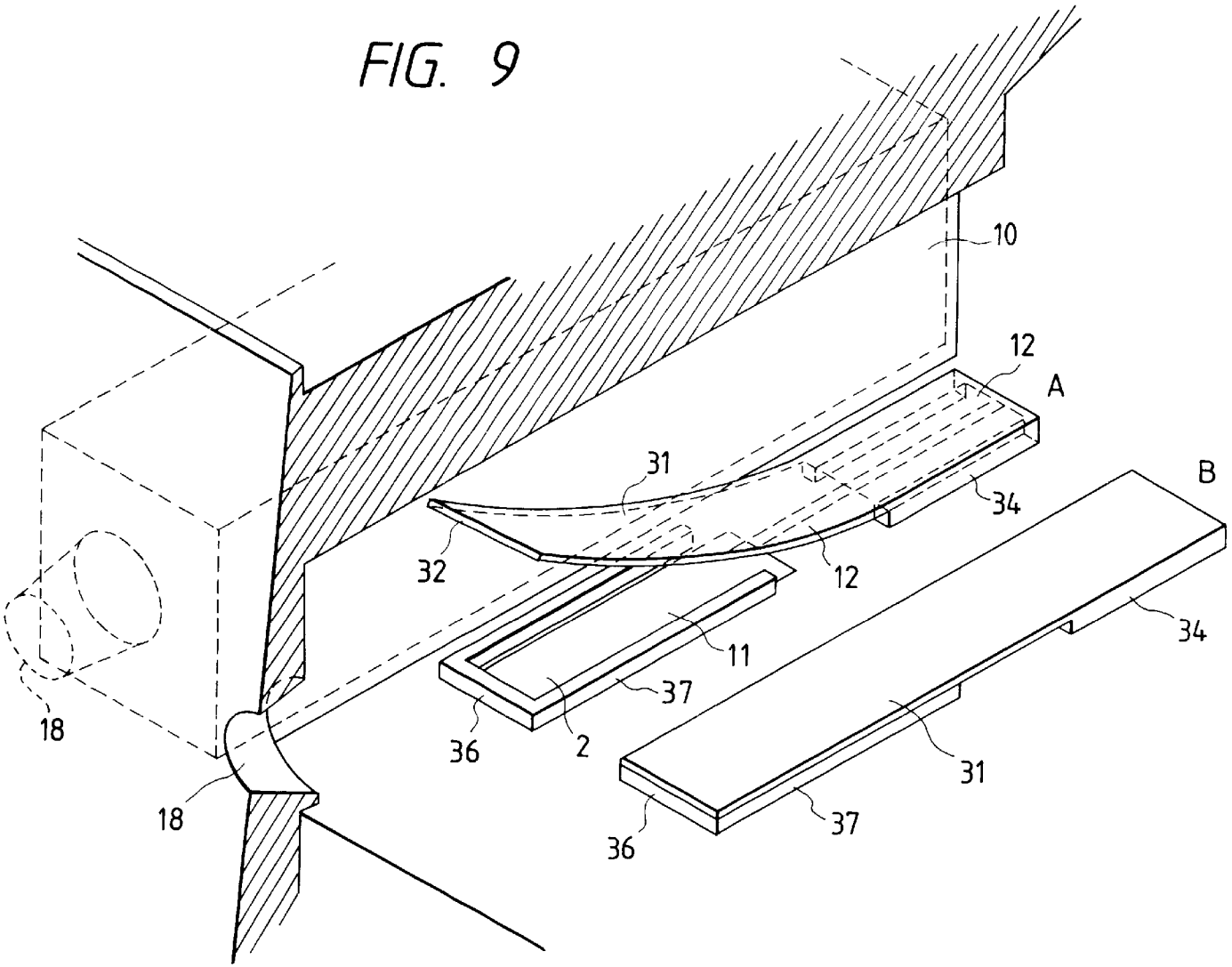
FIG. 9 is a partially cutaway perspective view of a liquid discharge head according to a second embodiment of the present invention.

FIG. 9 is a partially cutaway perspective view illustrating a liquid discharge head according to the second embodiment of the present invention.

In FIG. 9, A shows a state where a movable member 31 is displaced, and B shows a state where the movable member 31 is in an initial position (first position), in which B state a bubble producing area 11 is substantially enclosed against a discharge port 18 (a flow passage wall, though not shown herein, exists between A and B to separate between two flow passages).

The movable member 31 in FIG. 9 has two base boards 34 on the sides, and a liquid supply passage 12 between them. Thereby, the liquid can be supplied along the face on the heating element 2 side of the movable member 31 and from the liquid supply passage having a face substantially flush with or smoothly leading from the face of the heating element 2.

Herein, at the initial position (first position) of the movable member 31, the movable member 31 is proximate to or in close contact with a heating element downstream wall 36 disposed downstream of the heating element 2 and transversely, and a heating element side wall 37, and is substantially enclosed against the discharge port 18 side of the bubble producing area 11. Therefore, the pressure of a bubble when the bubble is generated, particularly, the pressure downstream of the bubble, can be concentrated toward the free end of the movable member 31, without leakage.

When the bubble disappears, the movable member 31 returns to the first position, and the supply of liquid onto the heating element 2 is made with the bubble producing area 11 substantially enclosed on the discharge port 18 side, whereby it is possible to obtain various effects which have been described in the previous embodiment such as suppressing the recession of meniscus. Also, regarding the refill, the same functions and effects can be obtained as in the previous embodiment.

In this embodiment, the base board 34 for supporting and securing the movable member 31 is disposed upstream away from the heating element 2, and in a smaller width than the liquid flow passage 10, as seen from FIG. 2 and FIG. 9, to supply the liquid into the liquid supply passage 12, as previously described. The base board 34 is not limited to the above shape, but may be of any shape as long as the refill can be smoothly made.

While the spacing between the movable member 31 and the heating element 2 is as large as about 15 $\mu$m in this embodiment, it should be noted that spacing may be made in the range in which the pressure due to development of the bubble can be transferred to the movable member.

Third Embodiment

Figure 10:
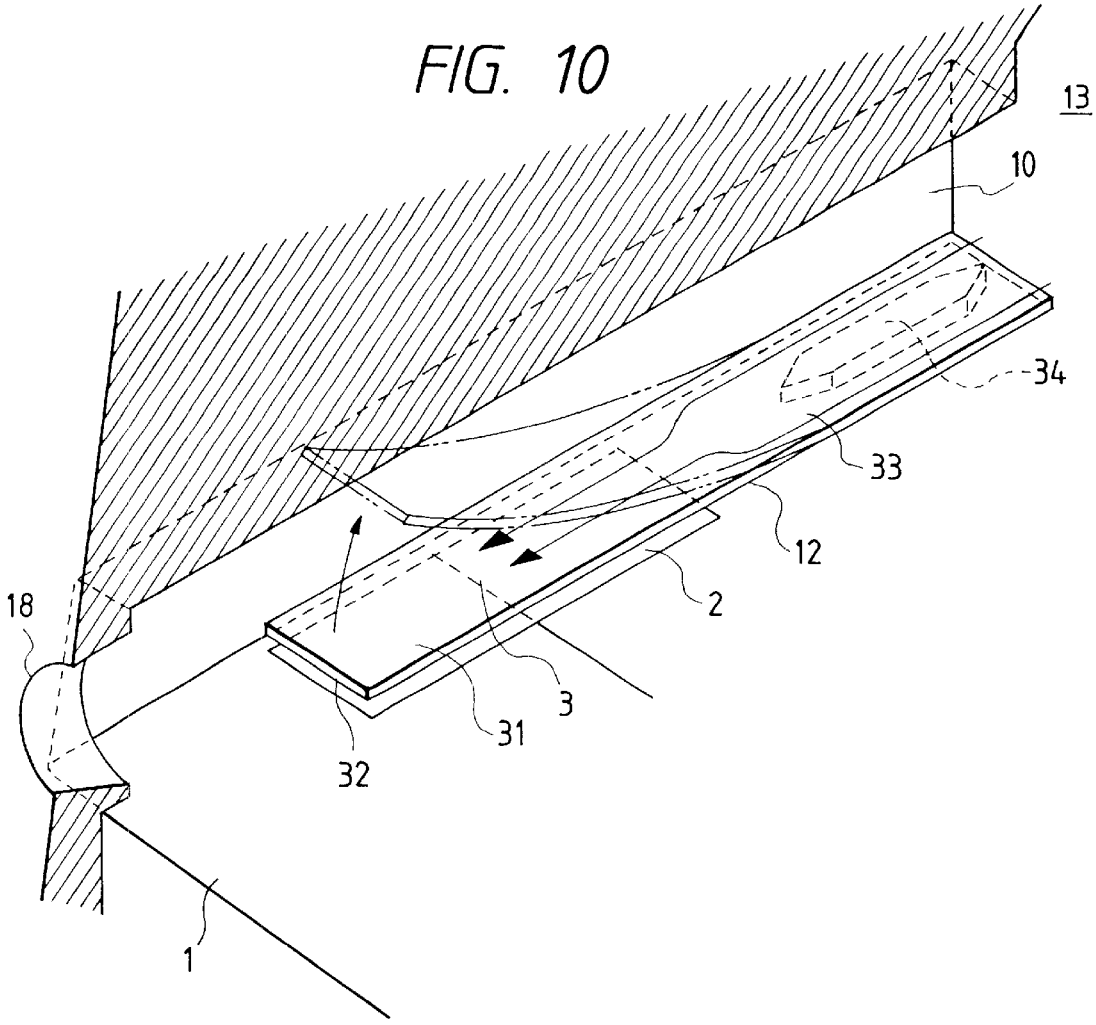
FIG. 10 is a partially cutaway perspective view of a liquid discharge head according to a third embodiment of the present invention.

FIG. 10 is a partially cutaway perspective view of a liquid discharge head according to a third embodiment of the present invention.

FIG. 10 shows the positional relation between a bubble producing area in one liquid flow passage, a bubble produced therein, and a movable member 31, to present a liquid discharge method and a refill method of this embodiment more clearly.

In most embodiments as previously described, the pressure of a bubble produced is concentrated on a free end of the movable member 31, so that the migration of the bubble is directed toward the discharge port 18 side at the same time with the rapid movement of the movable member 31.

On the contrary, in this embodiment, the downstream side of the bubble, which is the discharge port 18 side of bubble, directly acting on the discharge of a liquid droplet is regulated by the free end of the movable member, while affording the degree of freedom for the bubble produced.

Explaining about the constitution, in FIG. 10, as opposed to FIG. 2 (first embodiment) as previously described, there is not provided in this embodiment a recess portion (as indicated by the slant line portion) as a barrier located downstream of the bubble producing area provided on the element substrate 1 of FIG. 2. Namely, the free end area and the both side end areas of the movable member 31 leaves the bubble producing area open against the discharge port area, without substantially enclosing it, which is the constitution of this embodiment.

In this embodiment, since the growth of a bubble is allowed at the leading end of the downstream portion directly acting on the discharge of a liquid droplet of bubble, its pressure component is effectively utilized for the discharge. In addition, since at least the pressure (components of force $V_2$, $V_3$, $V_4$ in FIG. 3) directed upward on this downstream side is exerted in the free end portion of the movable member 31 to add to the growth of bubble at the leading end of the downstream side, the discharge efficiency can be enhanced as in the above embodiments. This embodiment is superior in the responsibility to the drive of the heating element 2 to the previous embodiment.

Also, this embodiment, which is simple in the construction, has the advantages on the manufacture.

A fulcrum portion of the movable member 31 in this embodiment is secured to a base board 34 of a smaller width than the face portion of the movable member 31. Accordingly, the supply of liquid into the bubble producing area 11, when the bubble disappears, occurs through both sides of this base board (see the arrows in the figure). This base board may take any structure as long as it can secure the supply ability.

The refill in supplying the liquid is superior to the conventional bubble producing structure using only the heating elements, because the flow of liquid passing into the bubble producing area from upward as the bubble disappears is controlled, owing to the presence of the movable member 31 in this embodiment. Of course, the recession of meniscus can be thereby reduced.

As a variation of this embodiment, the movable member 31 are substantially enclosed only at both side ends (or one end) for the free end thereof against the bubble producing area 11, which is preferable. According to this constitution, the pressure of the movable member 31 sideways can be utilized for the growth of bubble at the end portion thereof in the discharge port 18 side, as previously described, whereby the discharge efficiency can be further increased.

Fourth Embodiment

An example of enhancing the discharge power of liquid due to the mechanical displacement as previously described will be described below in this embodiment.

Figure 11:
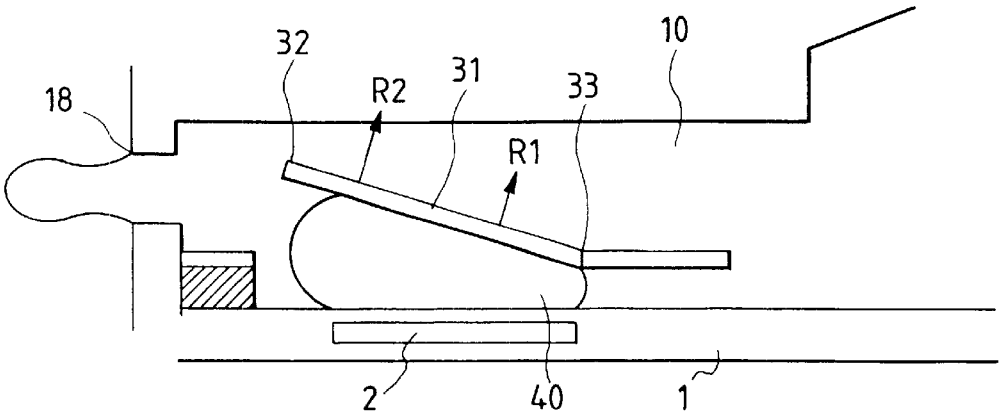
FIG. 11 is a cross-sectional view of a liquid discharge head according to a fourth embodiment of the present invention.

FIG. 11 is a cross-sectional vies of a liquid discharge head according to a fourth embodiment of the present invention.

In FIG. 11, a movable member 31 extends such that a free end 32 of the movable member 31 is located further downstream of a heating element 2. Thereby, the displacement rate of the movable member 31 at the free end 32 can be increased, and the higher discharge power due to the displacement of the movable member 31 can be further generated.

Also, the free end 32 is positioned closer to the discharge port 18 side than in the previous embodiments, making it possible to concentrate the growth of a bubble 40 in stabler directional components, so that the more excellent discharge can be performed.

Also, the movable member 31 is displaced at a displacement rate R1 in accordance with a bubble growth rate in the central portion of pressure of the bubble 40, but the free end 32 located farther away from a fulcrum 33 than this position is displaced at a higher rate R2. Thereby, the free end 32 is caused to mechanically act on the liquid at the higher rate to produce the liquid movement, thereby increasing the discharge efficiency.

Also, by making the shape of the free end normal to the liquid flow, as in FIG. 10, the pressure of the bubble 40 or the mechanical action of the movable member 31 can be made to contribute to the discharge more efficiently.

Fifth Embodiment

Figure 12A:
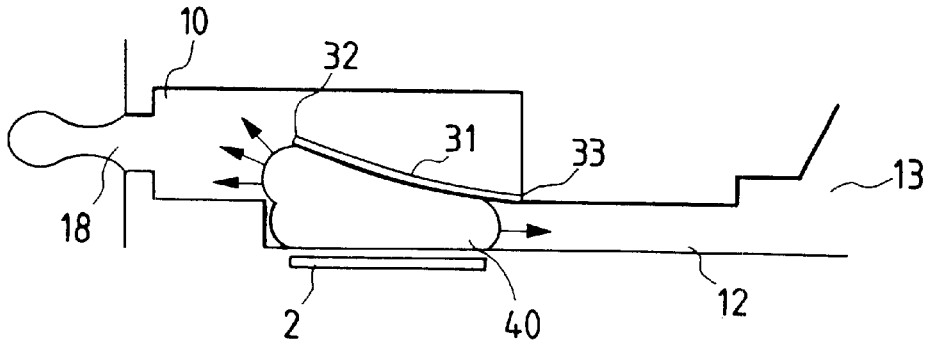
FIGS. 12A, 12B and 12C are typical cross-sectional views of the liquid discharge head according to a fifth embodiment of the present invention.
Figure 12B:
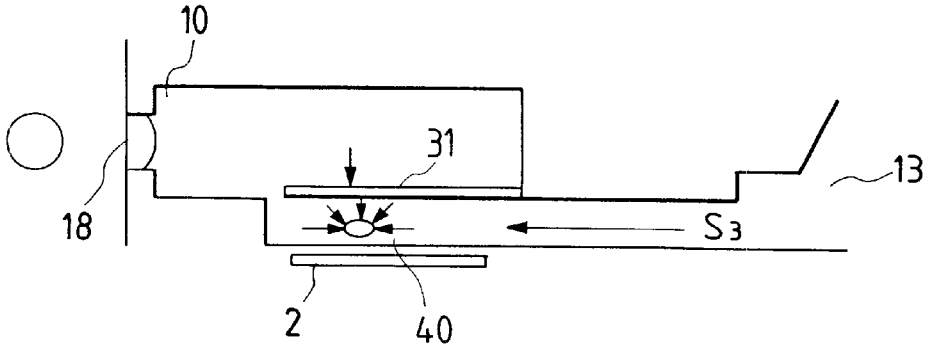
Figure 12C:
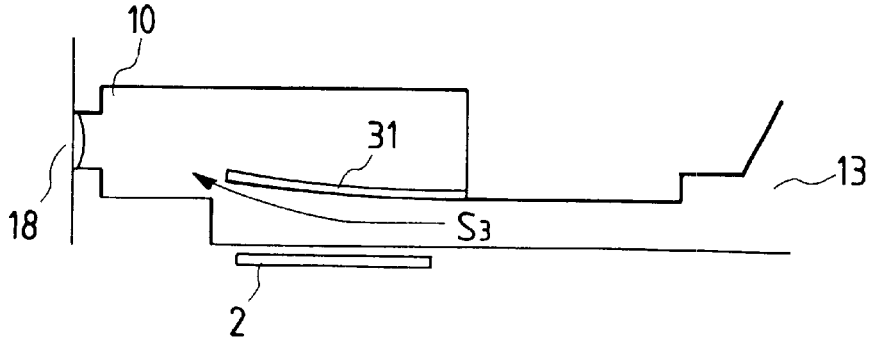

FIGS. 12A, 12B and 12C are typical cross-sectional views illustrating a liquid discharge head according to a fifth embodiment of the present invention.

A structure of this embodiment, different from that of the previous embodiment, has an area directly communicating to a discharge port 18 which is not of the shape of the flow passage in communication to a liquid chamber, whereby the simplification of the structure can be effected.

All the supply of liquid occurs only from a liquid supply passage 12 along the face of a movable member 31 on the bubble producing area side, the positional relation between the free end 32 or a fulcrum 33 of the movable member 31 and the discharge port 18, and the constitution that the movable member faces a heating element 2 are the same as in the previous embodiments.

This embodiment can accomplish the previously-mentioned effects such as discharge efficiency and liquid supply ability, but particularly, the compulsory refill is effected for almost all the supply of liquid, with the recession of meniscus suppressed, using the pressure when the bubble disappears.

FIG. 12A shows a state where the liquid is bubble-generated by the heating element 2, and FIG. 12B shows a state where the bubble is contracting, in which state the movable member 31 returns to an initial state and the supply of liquid occurs as at $S_3$.

FIG. 12C shows a state where a slight recession of meniscus M when the movable member 31 returns to the initial position is refilled owing to a capillary force near the discharge port 18 after the bubble disappears.

Other Embodiments

While the embodiments of the liquid discharge heads or the liquid discharge methods according to the present invention have been thus described in detail, another embodiment which is preferably applicable to those embodiments will be described below with reference to the drawings. The following explanation is applicable to either of one flow passage type and two flow passage type in some cases, but to both types, unless particularly specified.

<Ceiling Shape of Liquid Flow Passage>

Figure 13:
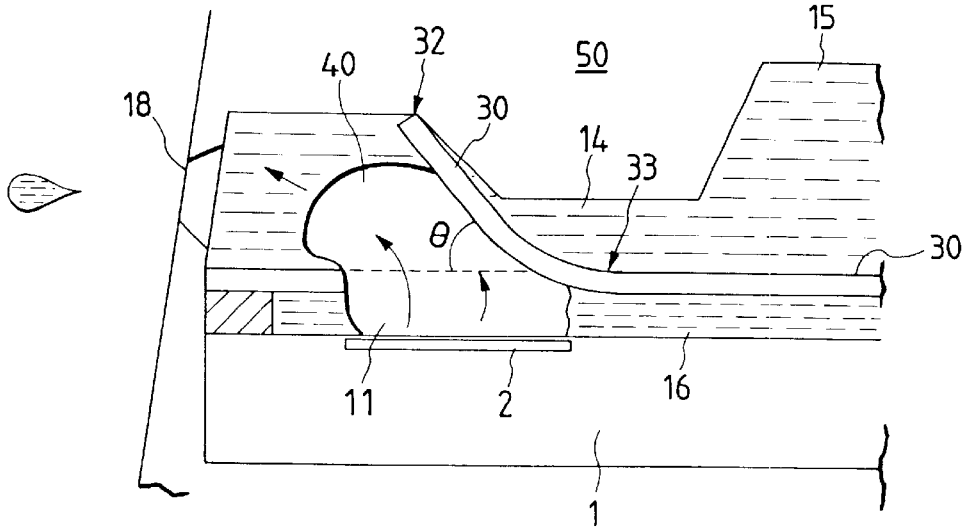
FIG. 13 is a view for explaining the structure of a movable member and a first liquid flow passage.

FIG. 13 is a view for explaining the structure of a movable member and a first liquid flow passage.

As illustrated in FIG. 13, a grooved member 50 having a groove for the first liquid flow passage 13 (or liquid flow passage 10 in FIGS. 1A to 1D) is provided on a separation wall 30. In this embodiment, the height of a ceiling of the flow passage near a free end 32 of the movable member is increased, thereby allowing for a greater operation angle θ of the movable member. The operational range of this movable member may be determined in consideration of the structure of liquid flow passage, the durability of the movable member, and the bubble generation force, but desirably includes the angles up to an axial angle of the discharge port.

As shown in this figure, the displacement height of the free end of the movable member is made greater than the diameter of the discharge port, so that the discharge power can be transferred more sufficiently. Since the height of the ceiling of liquid flow passage at a fulcrum 33 of the movable member 32 is below that of the ceiling of liquid flow passage at the free end 32 of the movable member, as shown in the figure, the leakage of pressure wave to the upstream side due to displacement of the movable member can be more effectively prevented.

<Configurational Relation Between Second Liquid Flow Passage and Movable Member>

Figure 15A:
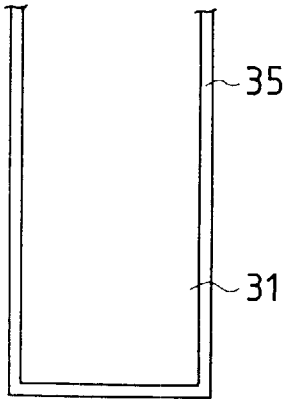
FIGS. 15A, 15B and 15C are views for explaining the other shape of the movable member.
Figure 15B:
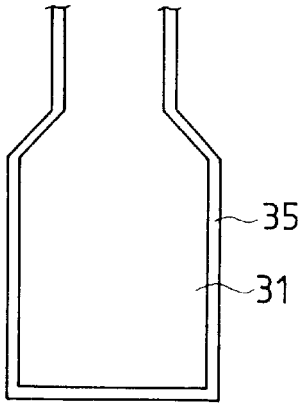
Figure 15C:
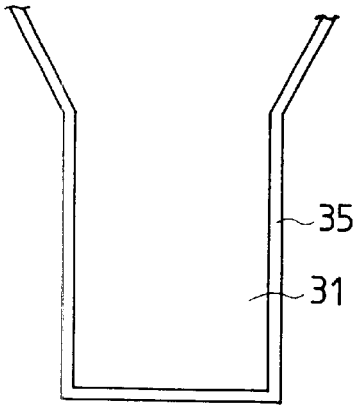

FIGS. 15A, 15B and 15C are views for explaining the structure of the movable member and the liquid flow passage, wherein FIG. 15A is a view around the separation wall 30 and the movable member 31, as looked from the above, FIG. 15B is a view of a second liquid flow passage 16, with the separation wall 30 removed, as looked from the above, and FIG. 15C is a view typically showing the configurational relation between the movable member 6 and the second liquid flow passage 16, each of these components being superposed. Note that the front face of the discharge port is located on the lower side of the figure in each case.

The second liquid flow passage 16 of this embodiment has a bottleneck portion 19 on the upstream side of the heating element 2 (by the upstream side as used herein is meant one in a large stream passing from a second common liquid chamber via the heating element, the movable member and the first flow passage toward the discharge port), with the structure of chamber (bubble generation chamber) suppressing the pressure at the time of bubble generation easily leaking to the upstream side of the second liquid flow passage 16.

As with the conventional head, a head in which the flow passage for bubble generation is the same as the flow passage for discharging the liquid, and having the bottleneck portion for preventing the pressure produced in the liquid chamber by the heating element from leaking to the common liquid chamber, was necessary to construct such that the cross sectional area of the bottleneck portion is not too small in full consideration of the refill of liquid.

In this embodiment, however, since most of the liquid to be discharged can be the discharge liquid within the first liquid flow passage, and the bubbling liquid within the second liquid flow passage, where the heating element is provided may not be consumed too much, the filling amount of bubbling liquid into the bubble producing area 11 of the second liquid flow passage may be small. Accordingly, since the spacing at the above bottleneck portion can be as narrow as several μm to several tens μm, the pressure at the time of bubble generation produced in the second liquid flow passage can be prevented from leaking around too much, and concentrated onto the movable member. And since this pressure can be utilized as the discharge power via the movable member 31, the higher discharge efficiency and discharge power can be achieved. Note that the shape of the first liquid flow passage 16 is not limited to the above structure, but may be of any shape as long as the pressure by development of the bubble can be effectively transferred to the movable member.

As shown in FIG. 15C, the lateral portion of the movable member 31 covers part of a wall of the second flow liquid passage, thereby preventing the movable member 31 from dropping into the second liquid flow passage. Thus, the separation between the discharge liquid and the bubbling liquid, as previously described, can be further made. Also, since the bubble can be restrained from escaping via a slit, the discharge pressure or discharge efficiency can be further increased.

Though a part of the bubble produced in the bubble producing area of the second liquid flow passage extends to the first liquid flow passage 14, with the displacement of the movable member 6 to the first liquid flow passage 14, in FIG. 13 and FIGS. 32A to 32D, a higher discharge power can be further obtained by making the height of the second flow passage to allow the bubble to extend than when the bubble does not extend. In this way, in order to allow the bubble to extend to the first liquid flow passage 14, it is desirable that the height of the second liquid flow passage 16 is lower than that of the maximum bubble, this height being preferably several μm to 30 μm. Note that this height was 15 μm in this embodiment.

<Movable Member and Separation Wall>

FIGS. 15A, 15B and 15C are views for explaining other shapes of the movable member, wherein FIG. 15A is a view showing a rectangular shape, FIG. 15B is a view showing a shape which is slender on the fulcrum side to facilitate the operation of the movable member, and FIG. 15C is a view showing a shape which is wider on the fulcrum side to raise the durability of the movable member.

Figure 14A:
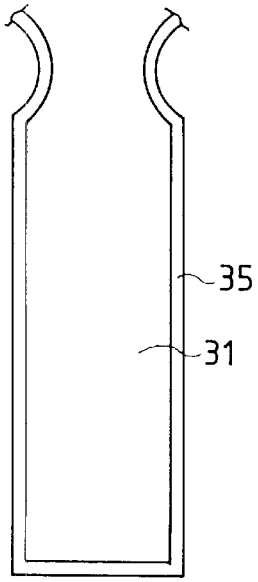
FIGS. 14A, 14B and 14C are views for explaining the structure of the movable member and the liquid flow passage.
Figure 14B:
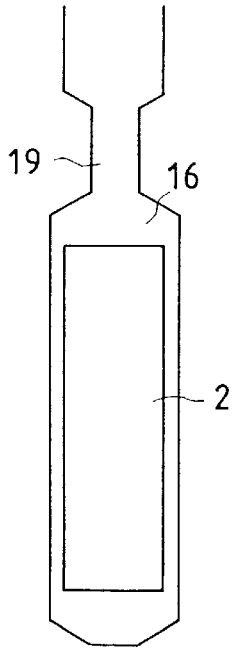
Figure 14C:
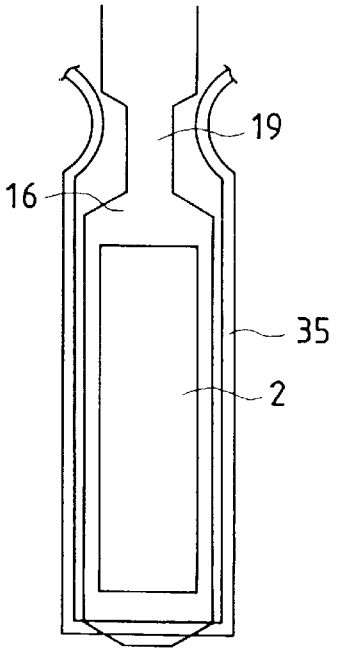

In FIGS. 15A to 15C, 35 is a slit provided on the separation wall, which forms the movable member 31. As the shape for easier operation and with good durability, a shape having a width on the fulcrum side which is circularly narrowed, as shown in FIG. 14A, is preferable, but the shape of the movable member may be arbitrary as long as it is easily operated and has good durability, without entering the second liquid flow passage.

While in the previous embodiments, the plate movable member 31 and the separation wall 5 with this movable member were made of nickel having 5 μm, it should be noted that the movable member and the separation wall may be made of materials being solvent resistant to the bubbling liquid and the discharge liquid, and having the elasticity to satisfactorily operate as the movable member, with which a fine slit can be formed.

Examples of the materials for the movable member may include durable metals such as silver, nickel, gold, iron, titanium, aluminum, platinum, tantalum, stainless steel, phosphor bronze, and their alloys, or resins having nitrile group, such as acrylonitrile, butadiene, styrene, resins having amide group, such as polyamide, resins having carboxyl group, such as polycarbonate, resins having aldehyde group, such as polyacetal, resins having sulfone group, such as polysulfone, a resin such as liquid crystal polymer and its compound, metals having highly ink resistance, such as gold, tungsten, tantalum, nickel, stainless steel, titanium, their alloys, and those coated with such metals or alloys on the surface for the ink resistance, resins having amide group such as polyamide, resins having aldehyde group such as polyacetal, resins having ketone group such as polyetheretherketone, resins having imide group such as polyimide, resins having hydroxyl group such as phenol resin, resins having ethyl group such as polyethylene, resins having alkyl group such as polypropylene, resins having epoxy group such as epoxy resins, resins having amino group such as melamine resin, resins having methylol group such as xylene resin, and their compounds, and ceramics such as silicon dioxide, and its compounds, which are desirable.

Examples of the materials for the separation wall may include resins having good heat resistance, solvent resistance, and moldability represented by recent engineering plastics such as polyethylene, polypropylene, polyamide, polyethylene terephthalate, melamine resin, phenol resin, epoxy resin, polybutadiene, polyurethane, polyetheretherketone, polyethersulphone, polyallylate, polyimide, polysulphone, liquid crystal polymer (LCP), and their compounds, and metals such as silicon dioxide, silicon nitride, nickel, gold, stainless steel, their alloys and their compounds, and those coated with titanium or gold on the surface, which are desirable.

Also, the thickness of separation wall may be determined, in consideration of its material and shape, from the viewpoint of attaining the strength of separation wall and operating as the movable member, but desirably is in a range from about 5 $\mu$m to about 10 $\mu$m.

While the width of slit 35 for forming the movable member 31 was 2 $\mu$m in this embodiment, it will be appreciated that since the bubbling liquid and the discharge liquid are different, the slit width may be large enough to form a meniscus between liquids if it is desired to prevent the mixture of both liquids, thereby suppressing the ventilation between respective liquids. For example, when a liquid of about 2 cp (centipoise) as the bubbling liquid, and a liquid of 100 cp or more as the discharge liquid are used, the mixture of liquids can be prevented with a slit as large as about 5 $\mu$m, but desirably may be equal to or less than 3 $\mu$m.

The movable member applicable to the invention may have a thickness in the order of $\mu$m (t $\mu$m), but not be intended to have a thickness in the order of cm. For the movable member having a thickness in the order of $\mu$m, it is desirable to take into consideration the dispersion in manufacture if the slit width (W $\mu$m) in the order of $\mu$m is used.

When the thickness of a member opposed to the free end and/or side end of the movable member to form a slit is equivalent to that of the movable member (see FIGS. 8 and 13), the slit width and the thickness are set in the following range, in consideration of the dispersion in manufacture, whereby the mixture of the bubbling liquid and the discharge liquid can be suppressed stably. This means that in the limited conditions, as a point of view on the design, when a highly viscous ink (5 cp, 10 cp) is used for the bubbling liquid having a viscosity of 3 cp or less, the mixture of two liquids can be suppressed for a long term, if $W/t \leqq 1$ is satisfied.

The slit for providing a "substantially enclosed state" which is applicable to this invention may be more surely in the order of several $\mu$m.

As above described, the bubbling liquid and the discharge liquid are separately used, the movable member may be substantially a partition member for them. When this movable member is moved with the creation of bubble, it is observed that a small amount of bubbling liquid mixes into the discharge liquid. Considering that the discharge liquid for forming the image has typically a color material concentration of about 3% to 5%, in the ink jet recording, no great density change may occur, even if the bubbling liquid is contained into the discharge liquid droplet in a range of 20% or less. Accordingly, such liquid mixture composed of the bubbling liquid which is 20% or less relative to the discharge liquid droplet and the discharge liquid are contained in the liquid discharge head according to the invention.

In this embodiment as above described, the bubbling liquid of 15% at the upper limit is mixed, even if the viscosity is changed, and in the bubbling liquid of 5 cp or less, this mixture ratio is about 10% at the upper limit, depending on the drive frequency.

In particular, the smaller viscosity of the discharge liquid below 20 cp, the lesser mixture of liquids (e.g., 5% or less).

The configurational relation between the heating element and the movable member in this head will be described below with reference to the drawings. Note that the shape, size and number of the movable members and the heating elements are not limited to the following values. By the optimal arrangement between the heating element and the movable member, the pressure of forming by the heating element can be effectively utilized as the discharge pressure.

Figure 16:
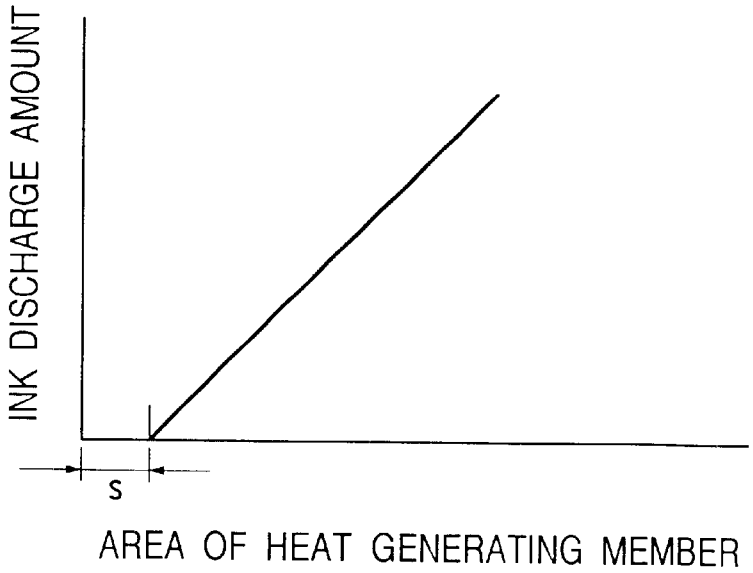
FIG. 16 is a graph showing the relation between the area of heat generating member and the ink discharge amount.

FIG. 16 is a graph showing the relation between the area of heating element and the ink discharge amount.

In the conventional technology relying on an ink jet recording method, a so-called bubble jet recording method, in which the image is formed on the recording medium in such a manner as to bring about a state change in the ink, with a rapid volume change (i.e., development of a bubble), by applying the thermal energy to the ink, discharge the ink from the discharge ports onto the recording medium, under the working force owing to this state change, the area of heating element and the ink discharge amount are in the proportional relation, as shown in FIG. 16, but it can be seen that a bubble generation ineffective area S not contributing to the ink discharge exists. From the burnt deposits on the heating element, it can be seen that this bubble generation ineffective area S exists around the heating element. From these results, it can be said that the portion having a width of about 4 $\mu$m around the heating element is not involved in the bubble generation.

Accordingly, to effectively utilize the bubble generation pressure, it is effective to dispose the movable member such that a portion directly above a bubble generation effective area about 4 $\mu$m or more inside from the periphery of the heating element can be covered with a movable area of the movable member. While in this embodiment, the bubble generation effective area was made about 4 $\mu$m or more inside from the periphery of the heating element, it will be appreciated that it may not be limited thereto, depending on the kind or forming method of the heating element.

Figure 17A:
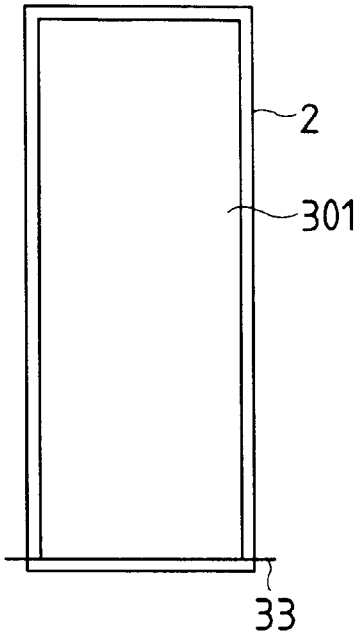
FIGS. 17A and 17B are views showing the configurational relation between the movable member and the heat generating member.
Figure 17B:
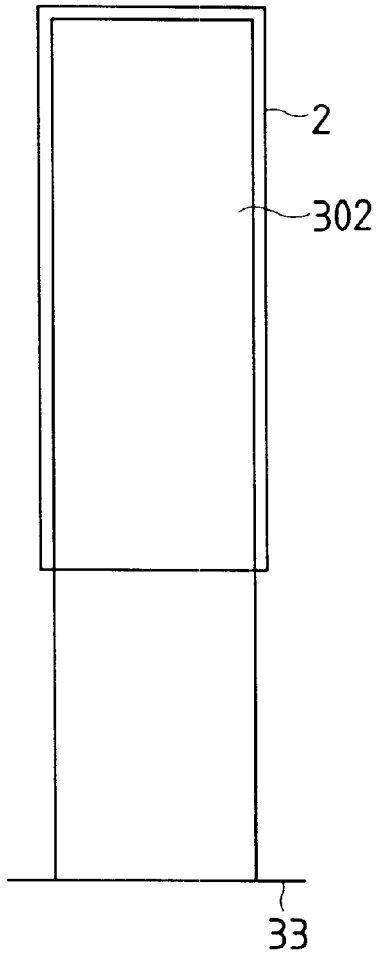

FIG. 17 is a typical view showing the positional relation between the movable member and the heating element, in which a movable member 301 (FIG. 17A) and a movable member 302 (FIG. 17B) which are different in the total movable area are disposed on the heating element 2 of 58×150 μm, as looked from the above.

The dimension of the movable member 301 is 53×145 μm, which is smaller than the area of the heating element 2, but is substantially equal to the bubble generation effective area of the heating element 2, the movable member 301 being disposed to cover the bubble generation effective area. On the other hand, the dimension of the movable member 302 is 53×220 μm, which is larger than the area of the heating element 2 (the dimension from the fulcrum to the leading end of movable member is larger than the length of heating element, with the same width), this movable member 302 being disposed to cover the bubble generation effective area, like the movable member 301. For the above two movable members 301, 302, the durability and the discharge efficiency were measured. The measurement conditions are as follows.

Bubbling liquid: Aqueous solution of ethanol 40%

Discharge ink: Dye ink

Voltage: 20.2 V

Frequency: 3 kHz

As a result of the experiments under the above measurement conditions, regarding the durability of the movable member, the movable member 301 of FIG. 17A was seen to have damage on the fulcrum portion of the movable member 301, after applying $1\times10^7$ pulses. The movable member 302 of FIG. 17B was seen to have no damage, after applying $3\times10^8$ pulses. Also, the kinetic energy obtained from the discharge amount and the discharge rate with respect to the input energy was confirmed to be increased about 1.5 to 2.5 times.

From the above results, it can be found, from both aspects of the durability and the discharge efficiency, that it is preferential to provide the movable member to cover the top of the bubble generation effective area, with the area of the movable member being larger than that of the heating element.

Figure 18:
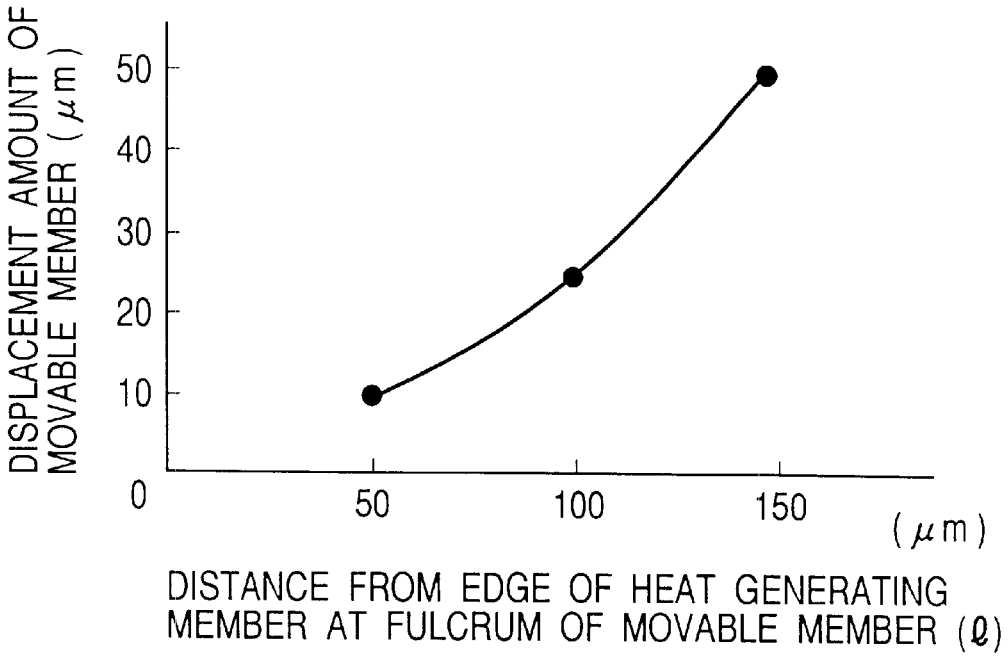
FIG. 18 is a graph showing the relation between the distance from the edge of heat generating member at the fulcrum of movable member and the displacement amount of movable member.
Figure 19:
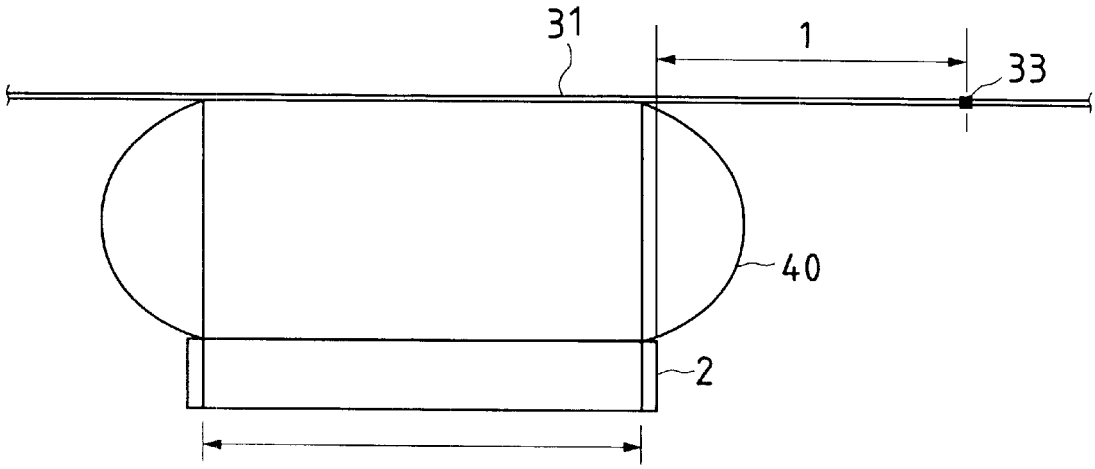
FIG. 19 is a view showing the configurational relation between the movable member and the heat generating member.

FIG. 18 is a graph showing the relation between the distance from the edge of heating element to the fulcrum of the movable member and the displacement amount of movable member, and FIG. 19 is a cross-sectional view showing the configurational relation between the heating element 2 and the movable member 31, as looked from the lateral side.

The heating element 2 used was 40×105 μm. The larger distance 1 from the edge of heating element 2 to the fulcrum 33 of movable member 31, the greater displacement amount will be produced. Accordingly, it is desirable that the optimal displacement amount is obtained in accordance with the required discharge amount of ink, the flow passage structure of discharge liquid and the shape of heating element, and the fulcrum position of the movable member is determined.

When the fulcrum of movable member is located immediately above the bubble generation effective area of heating element, a bubble generation pressure in addition to a stress due to displacement of the movable member is directly applied to the fulcrum, resulting in reduced durability of the movable member. According to the experiments of the present inventors, it could be determined that the movable member having the fulcrum immediately above the bubble generation effective area was seen to have damage on the movable wall, after applying about $1\times10^6$ pulses, resulting in reduced durability. Accordingly, the fulcrum of the movable member is disposed not immediately above the bubble generation effective area of the heating element, the movable member having the shape or material having less excellent durability will still have high practicability. Note that when the fulcrum is located immediately above the bubble generation effective area, the movable member can be excellently used by selecting the shape or material. With such constitution, the liquid discharge head having high discharge efficiency and durability can be obtained.

<Element Substrate>

The constitution of the element substrate having arranged thereon the heating elements for applying the heat to the liquid will be described below.

Figure 20A:
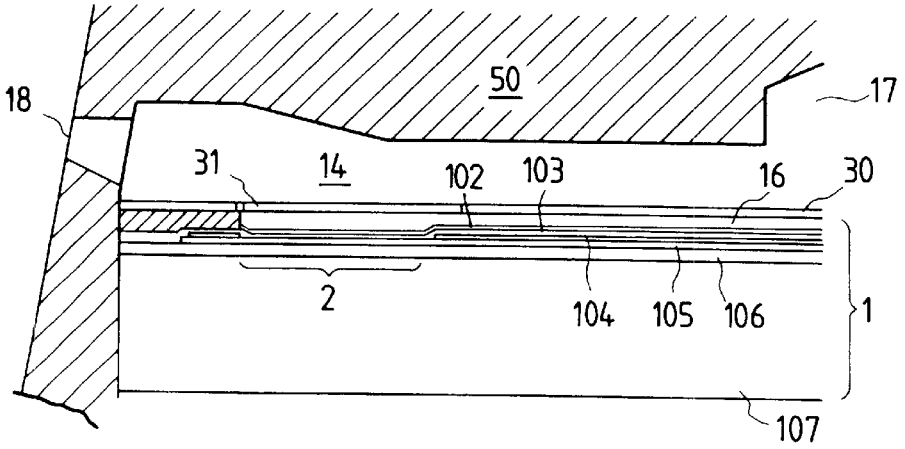
FIGS. 20A and 20B are longitudinal cross-sectional views of the liquid discharge head according to the present invention.
Figure 20B:
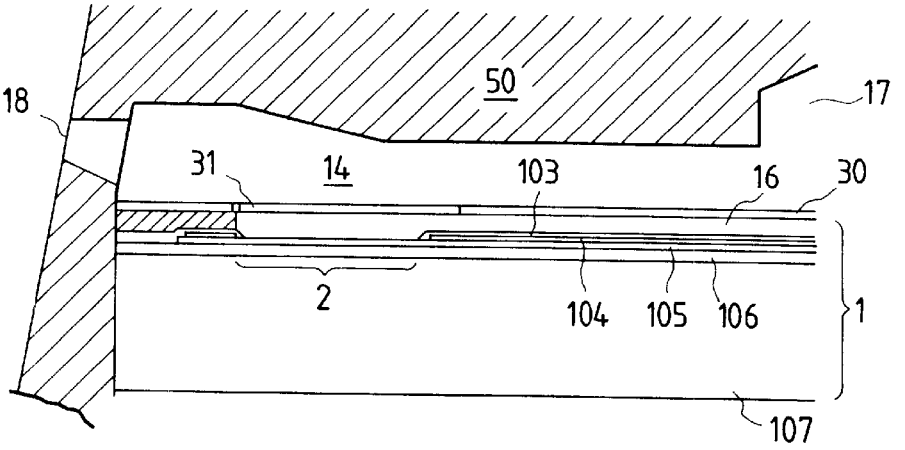

FIGS. 20A and 20B are a longitudinal cross-sectional view of the liquid discharge head according to the present invention, wherein FIG. 20A is a view showing the head having a protective membrane as will be described later, and FIG. 20B is a view showing the head having no protective membrane.

A grooved member 50 having the second liquid flow passage 16, the separation wall 30, the first liquid flow passage 14 and a groove for the first liquid flow passage provided is placed on the element substrate 1.

The element substrate 1 is formed with a silicon oxide film or silicon nitride film 106 for the purposes of insulation and heat accumulation on a substrate 7 made of e.g. silicon, and is patterned with an electrical resistive layer 105 (0.01 to 0.2 μm thick) made of hafnium boride ($HfB_2$), tantalum nitride (TaN), tantalum aluminum (TaAl) and a wiring electrode (0.2 to 1.0 μm thick) such as aluminum, as shown in FIG. 7. A voltage is applied from these two wiring electrodes 104 to the resistive layer 105, which is heated by electrical current passing therethrough. A 0.1 to 2.0 μm thick protective layer made of silicon oxide or silicon nitride is formed on the resistive layer between the wiring electrodes, and an anti-cavitation layer (0.1 to 0.6 μm thick) made of tantalum is formed thereon to protect the resistive layer 105 from various liquids such as the ink.

In particular, since the pressure or impulse wave produced in development of a bubble or debubble generation is very strong, remarkably reducing the durability of a rigid and brittle oxide film, tantalum (Ta) of metal material is used as the anti-cavitation layer.

Also, by the combination of liquid, constitution of liquid flow passage, and resistive material, the protective layer as above mentioned may not be needed, and an example thereof is shown in FIG. 20B. Examples of the resistive layer not needing such protective layer may include an iridium-tantalum-aluminum alloy.

In this way, the heating element in each embodiment as previously described may include only a resistive layer (heating portion) between electrodes, or a protective layer for protecting the resistive layer.

While in this embodiment, the heating element has a heating portion composed of a resistive layer for generating the heat in accordance with an electrical signal as the heating element, it should be noted that the heating element is not limited thereto, but may be one which allow the bubble sufficient to discharge the discharge liquid to be developed in the bubbling liquid. For example, the heating element may be composed of a photothermal converter for generating the heat by receiving the light such as laser, or a heating portion for generating the heat by receiving the high frequency.

Note that the element substrate 1 as above described may be integrally fabricated with, in addition to the electricity-heat converters composed of the resistive layer 105 used as the heating portion, and the wiring electrode 104 for supplying the electrical signal to this resistive layer, the functional devices such as a transistor, diode, latch, and shift resistor, for selectively driving those electricity-heat converters, through a semiconductor manufacturing process.

By driving the heating portions of the electricity-heat converters disposed on the element substrate 1 as previously described, a rectangular pulse as shown in FIG. 18 is applied to the resistive layer 105 via the wiring electrodes 14 to cause the resistive layer 105 between the wiring electrodes to generate the heat rapidly, to discharge the liquid.

Figure 21:
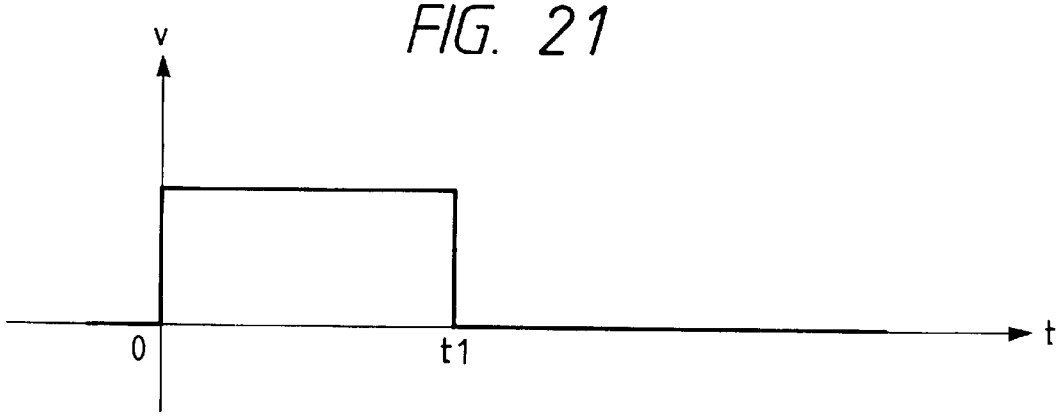
FIG. 21 is a typical graph showing the shape of drive pulse.

FIG. 21 is a typical view showing the shape of a drive pulse.

In the head of each embodiment as previously described, the heating element was driven by applying an electrical signal having a voltage of 24, a pulse width of 7 μsec, and a current of 150 mA, at 6 kHz, to discharge the liquid ink from the discharge ports through the already-described operation. However, the conditions for the drive signal are not limited thereto, but the drive signal may be only required to generate the bubble in the bubbling liquid properly.

<Head Structure of Two Flow Passage>

A structural example of a liquid discharge head which is capable of separately introducing different liquids into the first and second common liquid chambers, with the reduced number of parts and the lower costs, will be described below.

Figure 22:
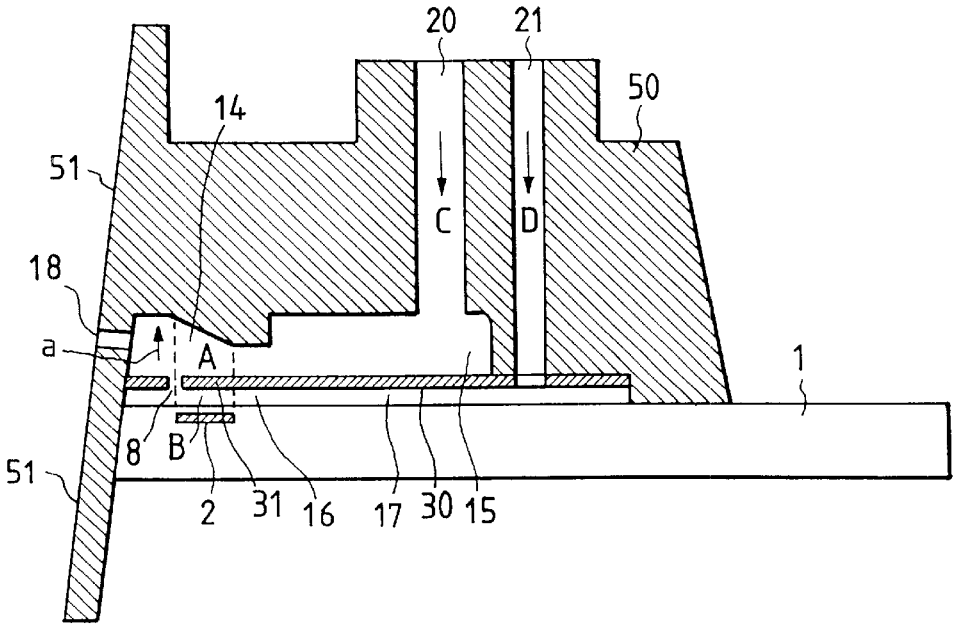
FIG. 22 is a cross-sectional view for explaining a supply passage to the liquid discharge head according to the present invention.

FIG. 22 is a cross-sectional view for explaining a supply passage of the liquid discharge head according to the present invention, wherein like numerals are attached to the same components as in the previous embodiments, the detail explanation of which is omitted herein.

In this embodiment, the grooved member 50 is largely comprised of an orifice plate 51 having the discharge ports 18, a plurality of grooves constituting a plurality of first liquid flow passages 14, and a recess portion constituting a first common liquid chamber 15 for commonly communicating to a plurality of liquid flow passages 14 and supplying the discharge liquid to each of the first liquid flow passages 3.

By joining the separation wall 30 to the lower portion of this grooved member 50, the plurality of first liquid flow passages can be formed. Such grooved member 50 has a first liquid supply passage 20 leading from its upper portion to the first common liquid chamber 15. Also, the grooved member 50 has a second liquid supply passage 21 leading from its upper portion through the separation wall 30 to the second common liquid chamber 17.

The first liquid (discharge liquid) is supplied via the first liquid supply passage 20 to the first common liquid chamber 15 to the first liquid flow passage 14, as indicated by the arrow C in FIG. 22, while the second liquid (bubbling liquid) is supplied via the second liquid supply passage 21 to the second common liquid chamber to the second liquid flow passage 16, as indicated by the arrow D in FIG. 22.

While in this embodiment, the second liquid supply passage 21 is disposed parallel to the first liquid supply passage 20, it will be appreciated that the second liquid supply passage may be disposed at will, as long as it extends through the separation wall 30 disposed outside the first common liquid chamber 15 to communicate to the second common liquid chamber 17.

Also, the size (diameter) of the second liquid supply passage 21 can be determined in consideration of the supply amount of the second liquid. The second liquid supply passage 21 may not be round in shape, but rectangular.

Also, the second common liquid chamber 17 can be formed by partitioning the grooved member 50 with the separation wall 30. A formation method of the second common liquid chamber 17 and the second liquid flow passage 16 may include forming a common liquid chamber frame and a second liquid passage wall with a dry film on the element substrate, and laminating a union of the grooved member 50 with the separation wall 30 secured, to the element substrate 1, as shown in an exploded perspective view of FIG. 23.

In this embodiment, the element substrate 1 having arranged a plurality of electricity-heat converters as the heating elements for generating the heat to produce a bubble in the bubbling liquid, owing to film boiling, as previously described, is placed on a support member 70 made of metal such as aluminum.

This element substrate 1 has arranged thereon a plurality of grooves constituting the liquid flow passages 16 formed by the second liquid passage wall, a recess portion constituting the second common liquid chamber (common bubbling liquid chamber) 17 for communicating to a plurality of bubbling liquid flow passages and supplying the bubbling liquid to respective bubbling liquid passages, and the separation wall 30 provided with the movable wall 31.

Numeral 50 refers to the grooved member. This grooved member has grooves constituting the discharge liquid flow passages (first flow passages) 14 by being joined to the separation wall 30, a recess portion constituting the first common liquid chamber (common discharge liquid chamber) for communicating to the discharge liquid flow passages and supplying the discharge liquid to respective discharge liquid flow passages, a first supply passage (discharge liquid supply passage) 20 for supplying the discharge liquid to the first common liquid chamber, and a second supply passages (bubbling liquid supply passage) 21 for supplying the bubbling liquid to the second common liquid chamber 17. The second supply passage 21 leads to a communicating passage which extends through the separation wall 30 disposed outside the first common liquid chamber 15 to communicate to the second common liquid chamber 17, wherein through this communicating passage, the bubbling liquid can be supplied to the second common liquid chamber 15, without mixing with the discharge liquid.

Also, the configuration relation between the element substrate 1, the separation wall 30 and the grooved ceiling 50 is such that the movable members 31 are disposed corresponding to the heating elements of the element substrate 1, and the discharge liquid flow passages are disposed corresponding to the movable members 31. In this embodiment, an example of the grooved member having one second supply passage arranged was offered, but a multiplicity of second supply passages may be provided in accordance with the supply amount. Further, the flow passage cross-sectional area of the discharge liquid supply passage 20 and the bubbling liquid supply passage 21 may be determined in proportion to the supply amount. By such optimization of the flow passage cross-sectional area, the components for the grooved member 50 may be miniaturized.

As above described, according to this embodiment, since the second supply passage for supplying the second liquid to the second liquid flow passage and the first supply passage for supplying the first liquid to the first liquid flow passage are constituted from the grooved ceiling plate as the same grooved member, the number of components can be reduced, and the shortened process can be realized with the lower costs.

Since the supply of the second liquid to the second common liquid chamber communicating to the second liquid flow passage is made through the second liquid flow passage in a direction extending through the separation wall for separating between the first liquid and the second liquid, the laminating process for the separation wall, the grooved member and a heating element forming substrate can be done only once, thereby making the fabrication easier, resulting in the improved laminating accuracy and the excellent discharge.

Also, since the second liquid is supplied through the separation wall to the second liquid common liquid chamber, the supply of the second liquid to the second liquid flow passage is more surely made, so that the discharge can be stably effected as the sufficient supply amount can be secured.

<Discharge Liquid, Bubbling Liquid>

The liquid discharge head according to the present invention as described in the previous embodiments, with the movable member placed as previously described, can discharge the liquid with the higher discharge power or discharge efficiency and at faster speed than with the conventional liquid discharge head. In this embodiment, where the same liquid is used for the bubbling liquid and the discharge liquid, various liquids can be used if they do not degrade due to heat applied by the heating element, are less liable to produce the deposits on the heating element by heating, allow for the reversible state change of vaporization and condensation by heating, and do not cause the liquid flow passage, the movable member or the separation wall to be deteriorated.

Among such liquids, the liquid used for recording (recording liquid) may be the ink having a composition which has been used in the conventional bubble jet apparatus.

On the other hand, when a head of two flow passage according to this invention is used, and the discharge liquid and the bubbling liquid are different, the bubbling liquid may be the liquid having the properties as previously described, examples of which may specifically include methanol, ethanol, n-propanol, isopropanol, n-hexane, n-heptane, n-octane, toluene, xylene, methylene dichloride, trichlene, Freon TF, Freon BF, ethyl ether, dioxane, cyclohexane, methyl acetate, ethyl acetate, acetone, methyl ethyl ketone, water, and their mixtures.

As the discharge liquid, various liquids can be used, irrespective of the bubble generation ability or thermal property. Also, the liquid having poor bubble generation ability which is conventionally inappropriate for the discharge, the liquid which may decompose or degrade by the heat, or the highly viscous liquid, may be employed.

However, desirably, the discharge liquid must not impede the discharge or bubble generation, or the operation of movable member by the discharge liquid itself or the reaction with the bubbling liquid.

The discharge liquid for recording may also be a highly viscous ink. Other discharge liquids may be medicines which are weak thermally and perfume.

In the liquid discharge head according to this invention, the recording was performed using, as the recording liquid which can be used both for the discharge liquid and the bubbling liquid, the ink having the following composition, but since the discharge speed of the ink was increased due to enhanced discharge power, the very excellent recorded image could be obtained with improved short accuracy of liquid droplet.

Dye ink viscosity 2 cp:

| | |
|---|---|
| (C.I. food black 2) dye | 3 wt % |
| diethylene glycol | 10 wt % |
| thiodiglycol | 5 wt % |
| ethanol | 3 wt % |
| water | 77 wt % |

Also, the recording was performed by discharging, using the bubbling liquid and the discharge liquid in combination with the liquids having the following compositions. Consequently, not only a liquid having a viscosity of several tens cp which was difficult to discharge with the conventional head but also a liquid having a very high viscosity of 150 cp could be discharged excellently, and produced the recorded matter with high image quality.

| | | |
|---|---|---|
| Bubbling liquid 1: | ethanol | 40 wt % |
| | water | 60 wt % |
| Bubbling liquid 2: | water | 100 wt % |
| Bubbling liquid 3: | isopropyl alcohol | 10 wt % |
| | water | 90 wt % |
| Discharge liquid 1: | carbon black | 5 wt % |
| pigment ink: | styrene-acrylic acid-ethyl acrylate copolymer (viscosity of about 15 cp) | 1 wt % |

(viscosity of about 15 cp)

(acid value 140, weight average molecular weight 8000)

| | |
|---|---|
| monoethanolamine | 0.25 wt % |
| glycerine | 69 wt % |
| thiodiglycol | 5 wt % |
| ethanol | 3 wt % |
| water | 16.75 wt % |

Discharge liquid 2: polyethylene

| | |
|---|---|
| glycol 200 | 100 wt % |

(viscosity 55 cp)

Discharge liquid 3: polyethylene

| | |
|---|---|
| glycol 600 | 100 wt % |

(viscosity of 150 cp)

The head of this invention is superior to the conventional head in the respects of discharging the high viscous liquid, and discharging the liquid weak to the heat which may damage the discharge heater, and produced the recorded matter of high image quality.

| | | |
|---|---|---|
| Bubbling liquid 1: | ethanol | 20 wt % |
| | water | 80 wt % |
| Bubbling liquid 2: | water | 100 wt % |
| Bubbling liquid 3: | isopropyl alcohol | 20 wt % |
| | water | 80 wt % |

Discharge liquid 1: dye (direct yellow 86

| | |
|---|---|
| thiodiglycol | 10 wt % |
| glycerine | 10 wt % |
| EDTA (ethylenediaminetetraacetic acid) | 1 wt % |
| water | 76 wt % |

(carbon black: styrene acrylic

| | |
|---|---|
| thiodiglycol | 10 wt % |
| glycerine | 10 wt % |
| IPA | 5 wt % |
| water | 65 wt % |

Discharge liquid 3: Victoria Blue GF-25 (manufactured by Mikoku Shikiso Inc.)

By the way, the liquid which was conventionally difficult to discharge, as those previously cited, has a low discharge rate, thus the more dispersion in the discharge directionality and the poor shot accuracy on the recording sheet, but also yields the dispersion in discharge amount due to discharge instability, which impeded to produce the high quality image. However, in the constitution of the above embodiment, the development of bubble can be made fully and stably, using the bubbling liquid. Thus, this allows the shot accuracy of liquid droplet to be improved and the ink discharge amount to be stabler, remarkably enhancing the quality of recorded image.

<Manufacture of Liquid Discharge Head>

A manufacturing process of the liquid discharge head according to the present invention will be described below.

For the liquid discharge head as shown in FIG. 2, the base board 34 for providing the movable member 31 on the element substrate 1 is formed by patterning, and the movable member 31 is bonded or welded to this base board 34. Thereafter, a grooved member having a plurality of grooves for constituting the liquid flow passages 10 and a recess portion for constituting the discharge ports 18 and the common liquid chamber 13 was joined with the element substrate 1, in the state where the grooves are in registration with respective movable members.

Figure 23:
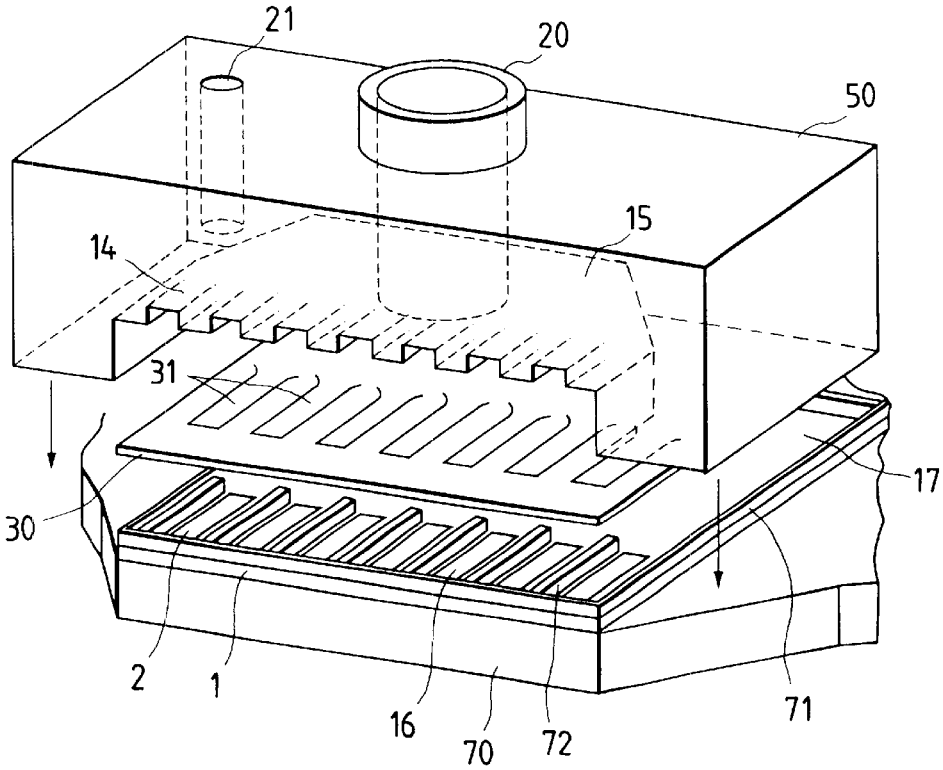
FIG. 23 is an exploded perspective view of the head according to the present invention.

A manufacturing process of the liquid discharge head of two flow passage as shown in FIGS. 6 and 23 will be described below.

FIG. 23 is an exploded perspective view of the head according to the present invention.

Roughly, the head is manufactured in such a manner that the wall for the second liquid flow passages 16 is formed on the element substrate 1, the separation wall 30 is attached thereon, the further the grooved member 50 provided with the grooves constituting the first liquid flow passages 14 is attached thereon, or after the wall for the second liquid flow passages 16 is formed, the grooved member 50 having the separation wall 30 attached is bonded on this wall.

Further, a fabrication method of the second liquid flow passage will be described below.

FIGS. 24A to 24E are process drawings for explaining the manufacturing method of the liquid discharge head according to the present invention.

Figure 24A:
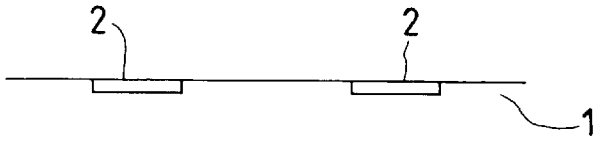
FIGS. 24A, 24B, 24C, 24D and 24E are process drawings for explaining a manufacturing method of the liquid discharge head according to the present invention.

In this embodiment, after the electricity-heat converting elements having the heat generating members 2 made of hafnium boride or tantalum nitride, was formed on the element substrate (silicon wafer) 1, using the same manufacturing apparatus as that used in the semiconductor manufacturing process, as shown in FIG. 24A, the surface of the element substrate 1 was washed for the purpose of providing the greater adhesion with the photosensitive resin in the next process. Further, to increased the adhesion, the surface of the element substrate was reformed by the ultraviolet ray-ozone, and then spin coated with a liquid of silane coupling agent (made by Nippon Yunika: A189) diluted by ethyl alcohol to 1 wt %.

Figure 24B:
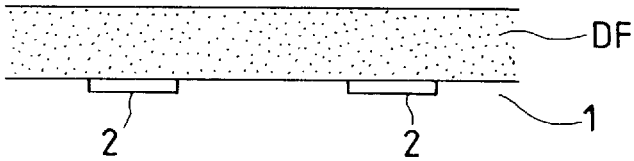

Then, the surface washing was conducted as shown in FIG. 24B, and a ultraviolet sensitive resin film (made by Tokyo Ohka Kogyo Co., Ltd: dry film, Audil SY-318) DF was laminated on the substrate 1 with improved adhesion.

Figure 24C:
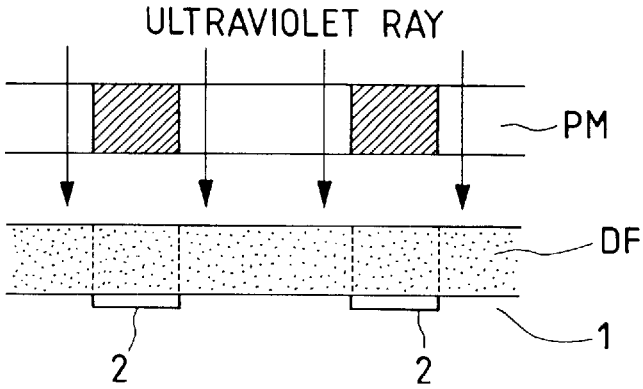

Then, a photomask PM was placed on a dry film DF, as shown in FIG. 24C, and the ultraviolet ray was applied onto a portion of the dry film DF which is left as the second flow passage wall. This exposure step was performed using MPA-600 made by Canon Inc., with an exposure amount of about 600 mJ/cm$^2$.

Figure 24D:
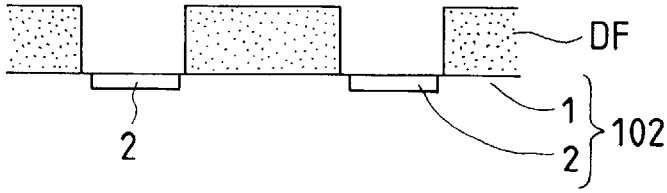

Then, the dry film DF was developed with a developer (made by Tokyo Ohka Kogyo Co., Ltd: BMRC-3) composed of a mixture liquid of xylene and butyl cellosolve acetate, the unexposed portion was dissolved, and the exposed and cured portion was formed as the wall portion of the second liquid flow passage 16, as shown in FIG. 24D. Further, the residue on the surface of the element substrate 1 was processed for about 90 seconds and removed, using an oxide plasma ashing apparatus (manufactured by Alkantec: MAS-800), and subsequently, ultraviolet radiation of 100 mJ/cm$^2$ was made at 150° C. for two hours to completely cure the exposed portion.

With the above method, the second liquid flow passages can be formed uniformly at high precision on a plurality of heater boards (element substrates) divided from the above silicon substrate. The silicon substrate was cut and separated into heater boards 1, using a dicing machine (manufactured by Tokyo Seimitsu: AWD-4000) with a diamond blade having a thickness of 0.05 mm. A separated heater boards 1 was secured onto an aluminum base plate 70 (FIG. 27) by an adhesive (made by Toray Industries: SE4400). Then, a printed wiring board 71 prebonded on the aluminum base plate 70 and the heater board 1 were connected by an aluminum wire (not shown) having a diameter of 0.05 mm.

Figure 24E:
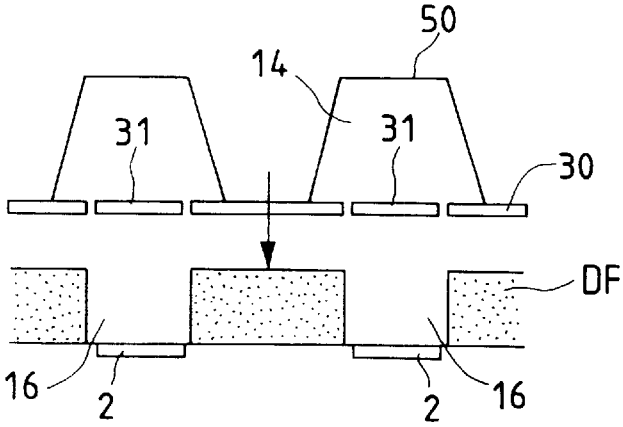

Then, a union of the grooved member 50 and the separation wall 30 was bonded in registration to the heater board 1 thus obtained, as shown in FIG. 24E. That is, the grooved member having the separation wall 30 and the heater board 1 are registered and firmly engaged with each other by a presser bar spring 78, an ink and bubbling liquid supply member 80 was joined on the aluminum base plate 70, and the interstice between aluminum wires, and between the grooved member 50, the heater board 1 and the ink and bubbling liquid supply member 80 were sealed with silicon sealant (made by Toshiba Silicone: TSE399).

With the above manufacturing method, the second liquid flow passages can be formed onto the heater of each heater board, at high precision and without misregistration. In particular, if the grooved member 50 and the separation wall 30 are prebonded in the prior step, the positional precision of the first liquid flow passage 14 and the movable member 31 can be raised.

And with these high precision manufacturing technologies, the discharge stabilization can be effected and the printing quality can be enhanced. Also, since a number of devices are fabricated collectively on a wafer, they can be mass produced at the low cost.

While in this embodiment, to form the second liquid flow passage, a ultraviolet curable dry film was used, it should be noted that it may be formed using a resin having an absorption band in the ultraviolet region, particularly, near 248 nm, which is cured after lamination to directly remove the portion of the resin corresponding to the second liquid flow passage by excimer laser.

Other manufacturing methods are also provided.

FIGS. 25A to 25D are process drawings for explaining the manufacturing method of the liquid discharge head according to the present invention.

Figure 25A:
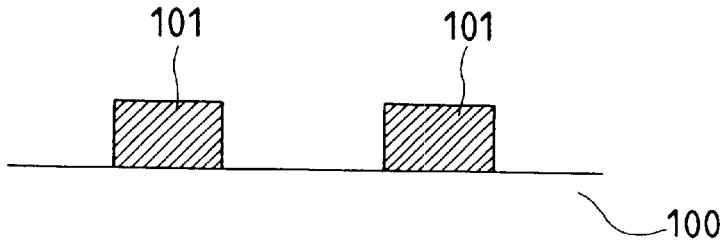
FIGS. 25A, 25B, 25C and 25D are process drawings for explaining a manufacturing method of the liquid discharge head according to the present invention.

In this embodiment, a resist 101 having a thickness of 15 μm was patterned on an SUS substrate 100, as shown in FIG. 25A.

Figure 25B:
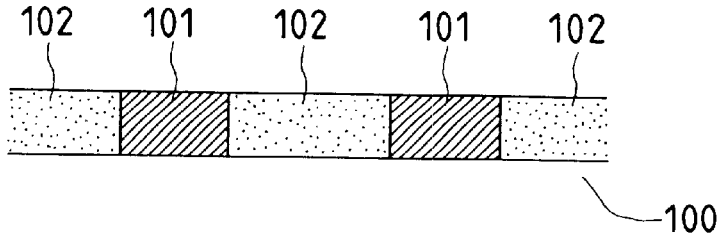

Then, a nickel layer 102 was grown 15 μm thick on the SUS substrate 100 by electrically plating the SUS substrate 100, as shown in FIG. 25B. A plating solution used contained nickel sulfamate with a stress reducing agent (made by World Metal Inc.: Zero-orle), boric acid, a pit inhibitor (made by World Metal Inc.: NP-APS), and nickel chloride. A way of applying the electric field in electrodepositing includes attaching an electrode on the anode side, and the SUS substrate 100 already patterned on the cathode side, with the temperature of the plating solution being 50° C., and the current density being 5 A/cm$^2$.

Figure 25C:
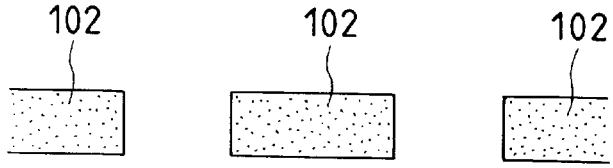

Then, the SUS substrate 100 which has been plated as above described was subjected to ultrasonic vibration to exfoliate a portion of the nickel layer 102 from the SUS substrate 100, so that the desired second liquid flow passage was obtained, as shown in FIG. 25C.

Figure 25D:
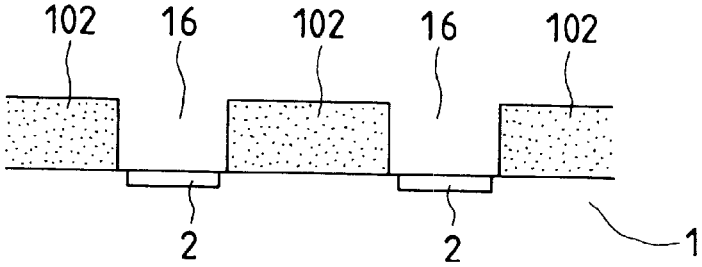

On the other hand, the heater boards having the electricity-heat converting elements disposed were formed on a silicon wafer, using the same manufacturing apparatus as that for the semiconductor. This wafer was divided into respective heater boards, using a dicing machine in the same way as in the previous embodiment. This heater board 1 was joined to the aluminum base plate 70 having a printed board 104 bonded beforehand, the electrical wiring being made by connecting the printed board 71 with the aluminum wires (not shown). Then, the second liquid flow passage obtained at the previous step was registered and secured on the heater board 1, as shown in FIG. 25D. In securing, because this will be engaged and contacted with the ceiling plate having the separation wall attached by a presser bar spring at a later step, in the same way as in the first embodiment, it is sufficient to be secure enough not to cause misregistration when joining the ceiling plate therewith.

In this embodiment, an ultraviolet light curable adhesive (made by Grace Japan: Amicon UV-300) was coated in registration as above mentioned, and secured, using an ultraviolet light irradiation apparatus, with an exposure amount of 100 mJ/cm$^2$, for the duration of about 3 seconds.

According to the manufacturing method of this embodiment, the second liquid flow passage can be obtained at high precision and without misregistration relative to the heat generating member, and because the flow passage wall is made of nickel, it is possible to provide the reliable head which is strong to the alkaline liquid.

Other manufacturing methods are also provided.

FIGS. 26A to 26D are a process drawing for explaining the manufacturing method of the liquid discharge head according to the present invention.

Figure 26A:
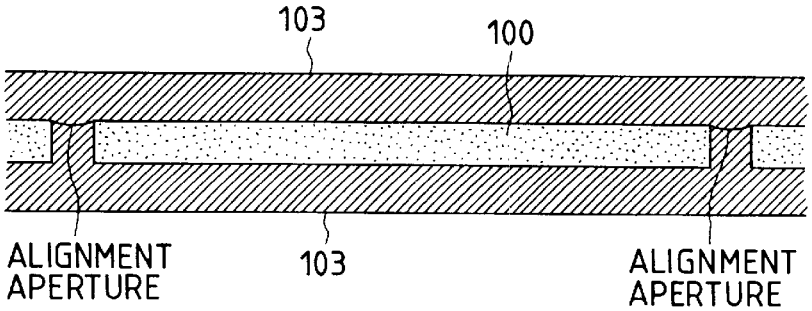
FIGS. 26A, 26B, 26C and 26D are process drawings for explaining a manufacturing method of the liquid discharge head according to the present invention.

In this embodiment, a resist 31 was coated on both side of an SUS substrate 100 having a thickness of 15 μm having alignment holes or marks 100*a*, as shown in FIG. 26A. Herein, the resist uses PMERP-AR900 made by Tokyo Ohka Kogyo.

Figure 26B:
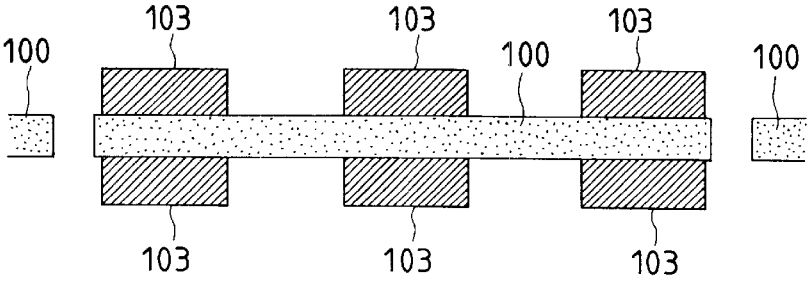

Then, the element substrate 100 was exposed in accordance with the alignment holes 100*a*, using an exposure apparatus (manufactured by Canon Inc.: MPA-600), and the resist 103 corresponding to the portion of the second liquid flow passage was removed, as shown in FIG. 26B. At this time, the exposure amount was 800 mJ/cm$^2$.

Figure 26C:
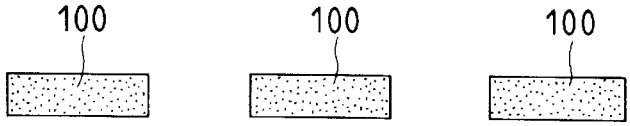

Then, the SUS substrate 100 with the resist on both sides patterned was immersed in an etching liquid (aqueous solution of ferric chloride or cupric chloride), a portion exposed from the resist 103 was etched, and the resist was peeled, as shown in FIG. 26C.

Figure 26D:
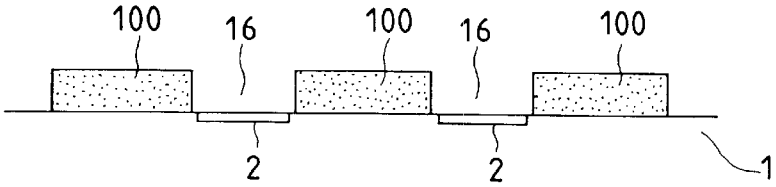

Then, the SUS substrate 100 which has been etched was registered and secured on the heater board 1, in the same way as in the manufacturing method of the previous embodiment, and the liquid discharge head having the second liquid flow passage 4 was assembled, as shown in FIG. 26D.

According to the manufacturing method of this embodiment, the second liquid flow passage 4 can be obtained at high precision and without misregistration relative to the heater, and because of the flow passage formed by the SUS, it is possible to provide the reliable liquid discharge head which is strong to the acid or alkaline liquid.

As above described according to the manufacturing method of this embodiment, by disposing beforehand the second liquid flow passage wall on the element substrate, the electricity-heat converter and the second liquid flow passage can be registered at high precision. Also, since the second liquid flow passages can be formed simultaneously for a number of element substrates on the board before cutting and separating, the liquid discharge heads can be mass produced at the low cost.

Also, a liquid discharge head obtained by carrying out the manufacturing method of the liquid discharge head according to the present invention can efficiently receive the pressure due to a bubble produced by the electricity-heat converter, resulting in excellent discharge efficiency, because the heat generating member and the second liquid flow passage are registered at high precision.

<Liquid Discharge Head Cartridge>

A liquid discharge head cartridge mounted with a liquid discharge head according to the embodiment of this invention will be roughly described below.

Figure 27:
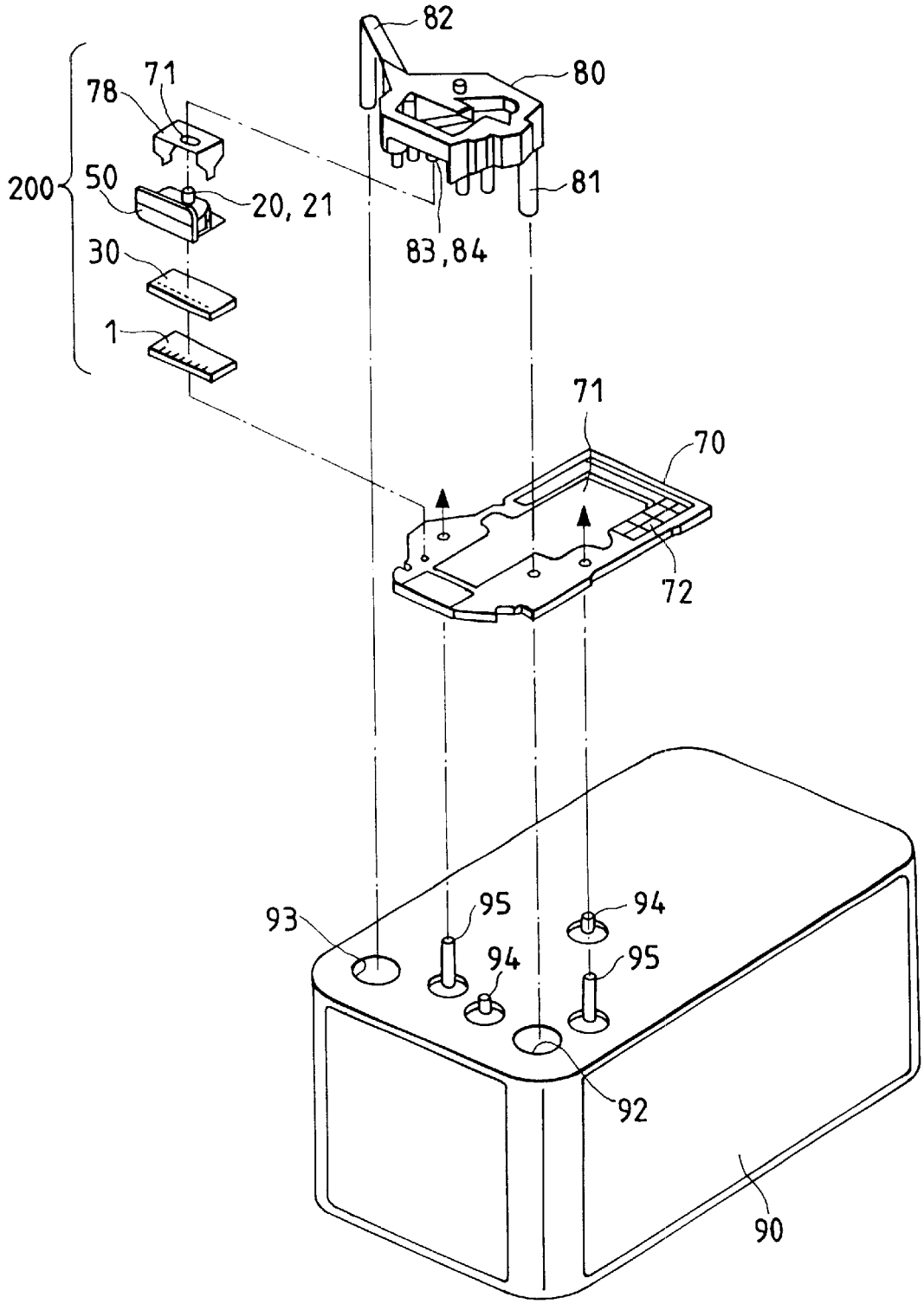
FIG. 27 is an exploded perspective view of a liquid discharge head cartridge.

FIG. 27 is an exploded perspective view of the liquid discharge head cartridge.

As shown in FIG. 27, the liquid discharge head cartridge roughly consists of a liquid discharge head portion 200 and a liquid vessel 90.

The liquid discharge head portion 200 is composed of an element substrate 1, a separation wall 30, a grooved member 50, a presser bar spring 78, a liquid supply member 90, and a support member 70. On the element substrate 1 are provided a plurality of heating resistors for applying the heat to the bubbling liquid as previously described in a row, and a plurality of function elements for driving these heating resistors selectively. A bubbling liquid passage is formed between this element substrate 1 and the separation wall 30 having the movable wall to allow the bubbling liquid to pass therethrough. By joining this separation wall 30 with the grooved ceiling plate 50, a discharge liquid passage (not shown) is formed to allow the discharge liquid to pass therethrough.

The presser bar spring 78 is a member for urging the grooved member 50 toward the element substrate 1, with which the element substrate 1, the separation wall 30, the grooved member 50 and the support member 70 are integrated securely.

The support member is to support the element substrate 1, and has arranged thereon a circuit board 71 connecting to the element substrate 1 for supplying an electrical signal, and a compact pad 72 connecting to the apparatus side for communicating an electrical signal to the apparatus side.

The liquid vessel 90 contains the discharge liquid such as the ink to be supplied to the liquid discharge head and the bubbling liquid for producing the bubble, separated by a partition. A registration part 94 for registering a connection member for connecting the liquid discharge head and the liquid vessel and rigid shafts 95 for securing the connection portion are provided outside the liquid vessel 90. The supply of the discharge liquid is made from a discharge liquid supply passage 92 through a supply passage 84 of the connecting member to a discharge liquid supply passage 81 of a liquid supply member 80, and through the discharge liquid supply passages 83, 71, 21 for each member to the first common liquid chamber. The supply of the bubbling liquid is also made from a supply passage 93 of the liquid vessel through the supply passage of the connecting member to the bubbling liquid supply passage 82 of the liquid supply member 80 to the bubbling liquid supply passage 82, and through the bubbling liquid supply passages 84, 71, 22 to the second liquid chamber.

While in the liquid discharge head cartridge as above described, the supply passages and the liquid vessels are provided, when the bubbling liquid and the discharge liquid are different, it will be appreciated that the supply passages and the liquid vessels for the bubbling liquid and the discharge liquid may not be separately provided.

Note that these liquid vessels may be reused by refiling the liquid, after the liquid is used up. To this end, it is desirable that a liquid inlet opening is provided in the liquid vessel. Also, the liquid discharge head and the liquid vessel may be provided integrally or separably.

<Liquid Discharge Apparatus>

Figure 28:
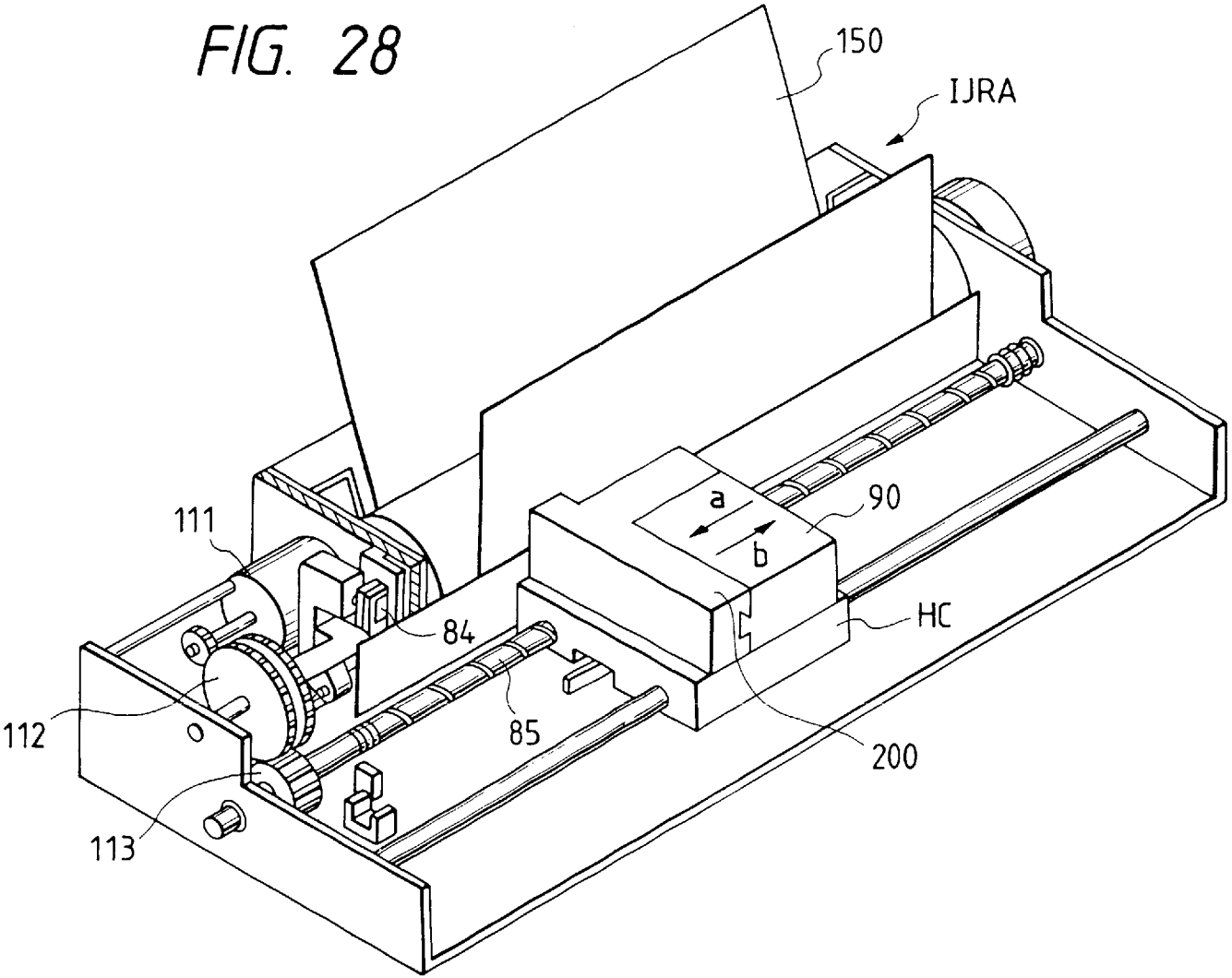
FIG. 28 is a schematic constitutional view of a liquid discharge apparatus.

FIG. 28 is a schematic constitutional view of a liquid discharge apparatus.

A carriage HC of the liquid discharge apparatus which is explained particularly using an ink discharge recording apparatus with the ink as the discharge liquid is mounted with a head cartridge having detachably a liquid tank 90 for containing the ink and a liquid discharge head portion 200, the head cartridge being reciprocated in the width direction of the recording medium 150 such as the recording sheet which is conveyed by recording medium conveying means.

If a drive signal is supplied from drive signal supply means not shown to liquid discharge means on the carriage, the recording liquid is discharged from the liquid discharge head to the recording medium, in accordance with this signal.

Also, the liquid discharge apparatus of this embodiment has a motor 111 as a drive source for driving the recording medium conveying means and the carriage, gears 112, 113 for transmitting a motive power from the drive source to the carriage, and a carriage shaft 115. By this recording apparatus as well as the liquid discharge method carried out with the recording apparatus, the recorded matter of good image quality could be obtained by discharging the liquid onto a variety of recording media.

Figure 29:
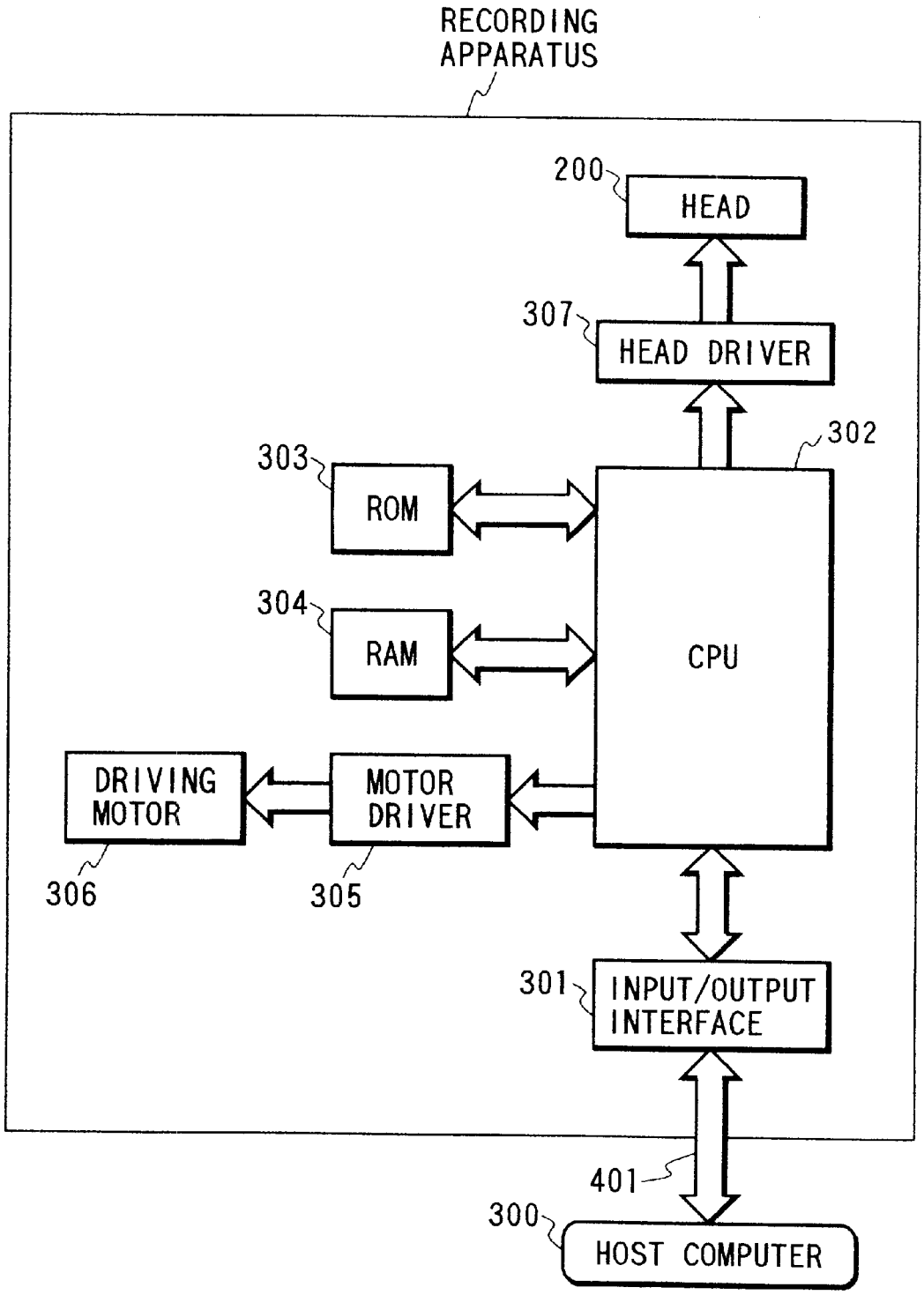
FIG. 29 is a block diagram of the recording apparatus.

FIG. 29 is a block diagram of the whole device for performing the ink discharge recording with the liquid discharge method and the liquid discharge head according to the present invention.

The recording apparatus receives the print information as a control signal from a host computer 300. The print information is saved temporarily in an input interface 310 inside the printer, and at the same time converted into processible data within the printer, and input into a CPU 302 which is also used as head drive signal supply means. The CPU 302 processes data entered into the CPU 302, using a peripheral unit such as RAM 304, and based on a control program stored in a ROM 303, for conversion into the print data (image data).

Also, the CPU 302 creates the drive data for driving a drive motor which moves the recording sheet and the recording head, synchronously with the image data, to record the image data at an appropriate position on the recording sheet. The image data and the motor drive data are transferred via a head driver 307 and a motor driver 305 to the head 200 and the drive motor 306, each being driven at a controlled timing to form the image.

The recording media applicable to the recording apparatus, to which the liquid such as the ink is attached, may include various sheets, or an OHP sheet, plastic materials for use with the compact disk or ornamental plate, cloths, metal plate such as aluminum or copper, leather materials such as cowhide, pigskin, and artificial leather, woods such wood and plywood, bamboo, ceramic materials such as tile, and three-dimensional structure such as sponge.

Also, the above recording apparatuses may include printers for printing on various sheets or the OHP sheet, plastic printers for recording on the plastic plate, such as compact disk, metal printers for recording on the metal plate, leather printers for recording on the leather, wood printers for recording on the wood, ceramic printers for recording on the ceramic material, recorders for recording on the three-dimensional mesh structure such as sponge, and textile printing machines for printing on the cloths.

Also, the discharge liquids for use with these liquid discharge apparatuses may include those in accordance with the recording media or conditions.

<Recording Apparatus>

An example of an ink jet recording system for performing the recording on the recording medium, using a liquid discharge head according to this invention as the recording head will be given below.

Figure 30:
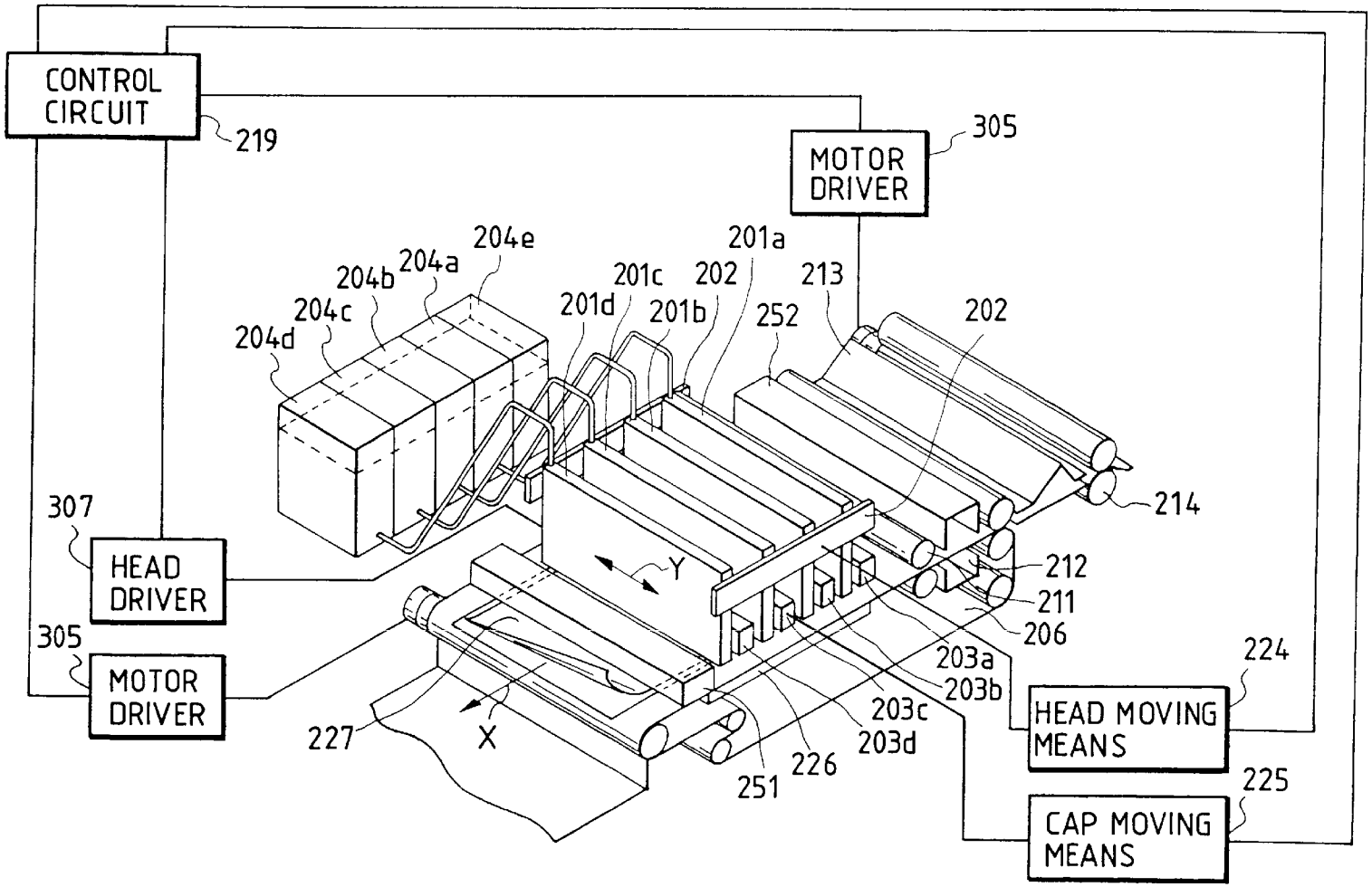
FIG. 30 is a view showing a liquid discharge recording system.

FIG. 30 is a typical view for explaining the constitution of the ink jet recording system using the liquid discharge head 201 to which this invention is applicable, as previously described.

The liquid discharge head in this embodiment is a full-line type head having arranged a plurality of discharge ports at an interval of 360 dpi over the length corresponding to the recordable width of the recording medium 150, four heads corresponding to four colors of yellow (Y), magenta (M), cyan (C), and black (Bk) being secured and supported, in parallel to each other, in a holder 202 at a predetermined interval in an X direction.

To each of these heads, a signal is supplied from a head driver 307 constituting drive signal supply means, and each head is driven based on this signal.

Each head is supplied with four color inks of Y, M, C and Bk, as the discharge liquid, from the ink vessels 204*a* to 204*d*. Note that numeral 204*e* is a bubbling liquid vessel in which the bubbling liquid is stored, wherein the bubbling liquid is supplied from this vessel to each head.

Also, under the heads, head caps 203*a* to 203*d* having the ink absorbing members such as sponge disposed inside are provided, wherein the head can be subjected to maintenance by covering the discharge ports of the heads, when not used for recording.

Numeral 206 is a conveyer belt constituting conveying means for conveying various recording media as described in the previous embodiment. The conveyer belt 206 is looped around a predefined path via various rollers, and driven by a driving roller connected to the motor driver 305.

In the ink jet recording system of this embodiment, a preprocessing unit 251 and a postprocessing unit 252 for performing various processings on the recording medium before and after recording are provided upstream and downstream of the recording medium conveying path, respectively.

The preprocessing and postprocessing are varied in the processing content, depending on the type of recording medium or the kind of ink for use in recording, but for the recording media such as metal, plastic, or ceramics, for example, the preprocessing to apply the ultraviolet ray and ozone is performed by activate the surface, thereby improving the adherent property of ink. Also, for the recording media prone to generate static electricity such as plastic, the dirt may be easily deposited on the surface due to static electricity, so that excellent recording may be prevented. Thus, by eliminating the static electricity from the recording medium, using an ionizer, as the preprocessing, the dirt should be removed from the recording medium. Also, when the cloths are used as the recording medium, the preprocessing to attach a substance selected from alkaline material, water soluble material, synthetic high polymer, water soluble metallic salt, urea and thiourea to the cloths may be made, from the viewpoints of stain prevention and higher degree of exhaustion. The preprocessing is not limited thereto, but may be setting the temperature of the recording medium to an appropriate temperature.

On the other hand, the postprocessing may include a fixing treatment for promoting the fixing of ink onto the recording medium having the ink attached thereon, and washing the processing agent attached and unreacted in the preprocessing.

While in this embodiment a full-line head was used as the head, it will be appreciated that a small head such as those previously described may be conveyed in a width direction of the recording medium.

<Head Kit>

A head kit having a liquid discharge head according to the present invention will be described below.

Figure 31:
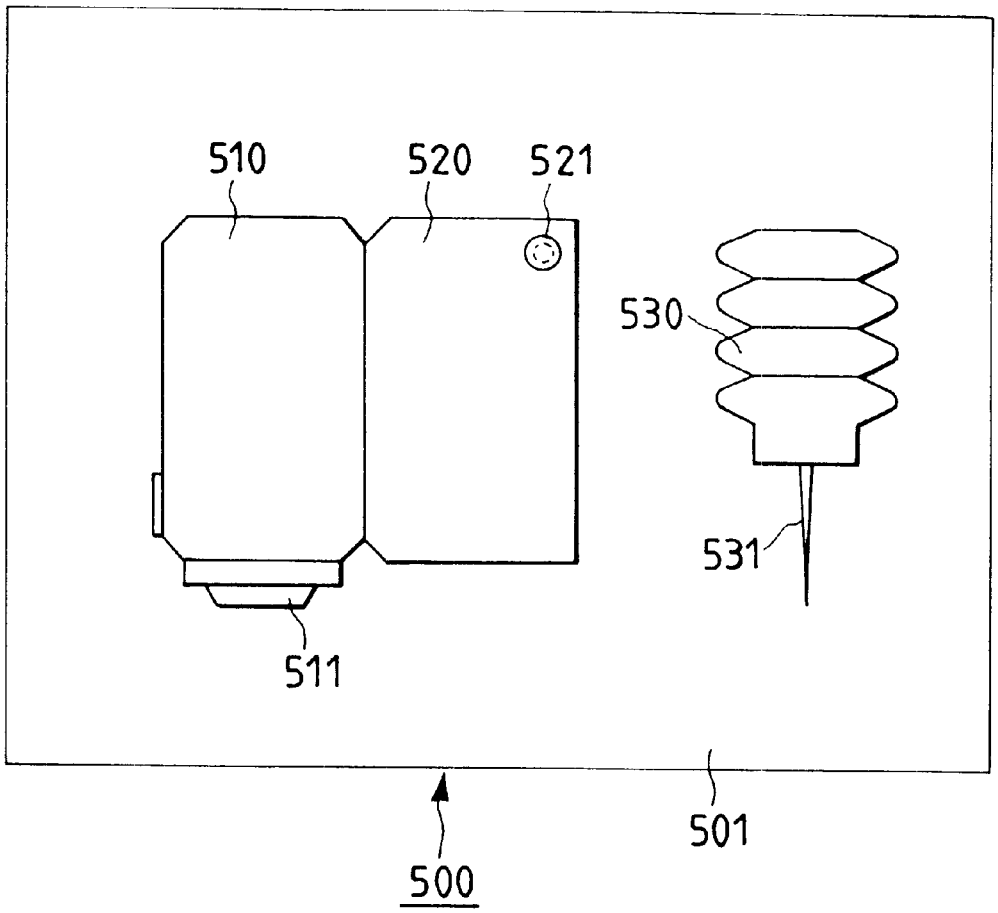
FIG. 31 is a typical view of a head kit.

FIG. 31 is a typical view of the head kit.

The head kit as shown in FIG. 31 houses, within a kit container 501, a head 510 having an ink discharge portion 511 for discharging the ink to which the invention is applied, an ink vessel 520 which is a liquid vessel integral with or separable from the head, and ink refilling means for refilling the ink into this ink vessel with the ink held.

When the ink is consumed, it is only necessary to insert a part of an insertion portion (such as a needle) 531 of the ink refilling means into an atmosphere communicating opening 521 of the ink vessel, a connecting portion with the head, or a hole opened on the wall of the ink vessel, and refill the ink within the ink refilling means into the ink vessel via this insertion portion.

In this way, by accommodating the liquid discharge head according to this invention, the ink vessel, and the ink refilling means within one kit container, as a kit, the ink can be easily refilled into the ink vessel immediately, as previously described, even if the ink is consumed, whereby the start of recording can be effected promptly.

While in the head kit of this embodiment, ink refilling means is included. It will be appreciated that the head kit may have no ink refilling means but comprise an ink vessel of separable type having the ink filled, and a head housed within the kit container 510.

While ink refilling means for refilling the ink into the ink vessel is only shown in FIG. 31, it will be appreciated that bubbling liquid refilling means for refilling the bubbling liquid into a bubbling liquid vessel may be accommodated within the kit container.

EXAMPLES

The examples for the supply of liquid into the liquid discharge head, or the pressure recovery, will be described below. Each means for the supply of liquid or the pressure recovery as hereinafter described may be constituted integrally with the liquid discharge head, or provided outside the liquid discharge head. Also, use of one flow passage or two flow passages will be possible.

Example 1

Figure 56:
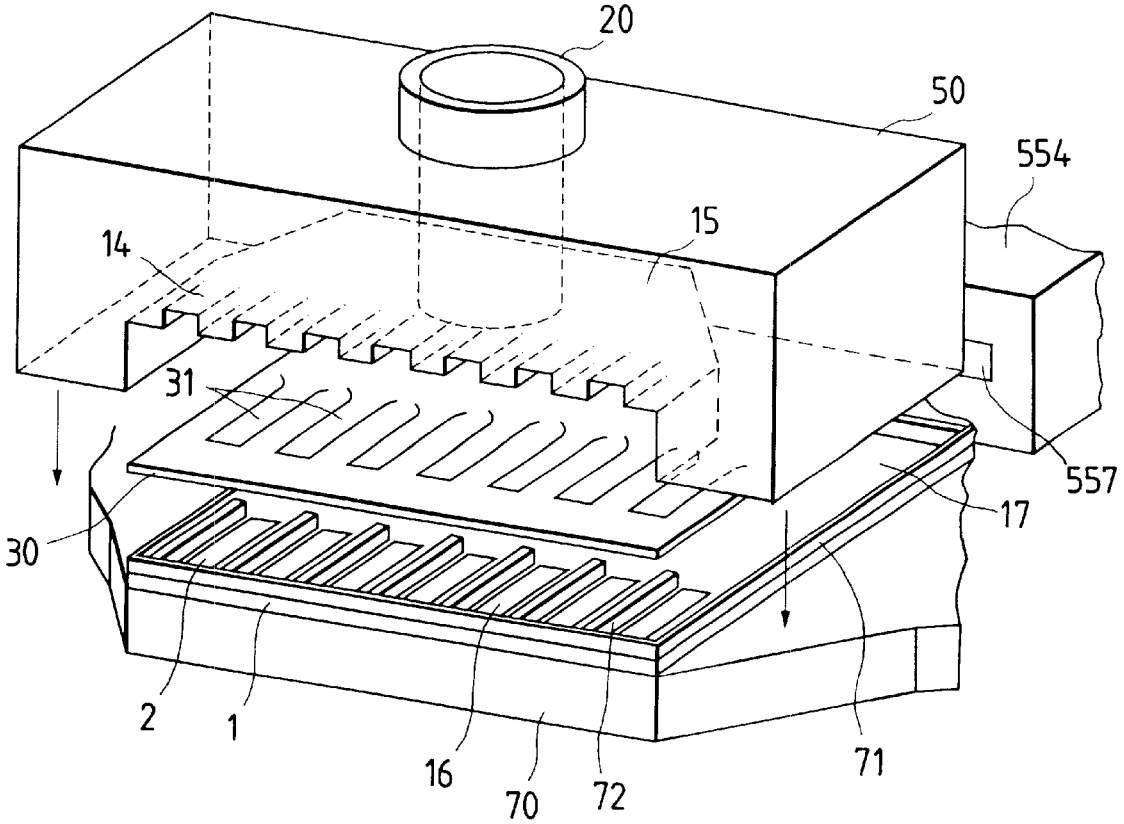
FIG. 56 is an exploded perspective view of the head according to the present invention.
Figure 57:
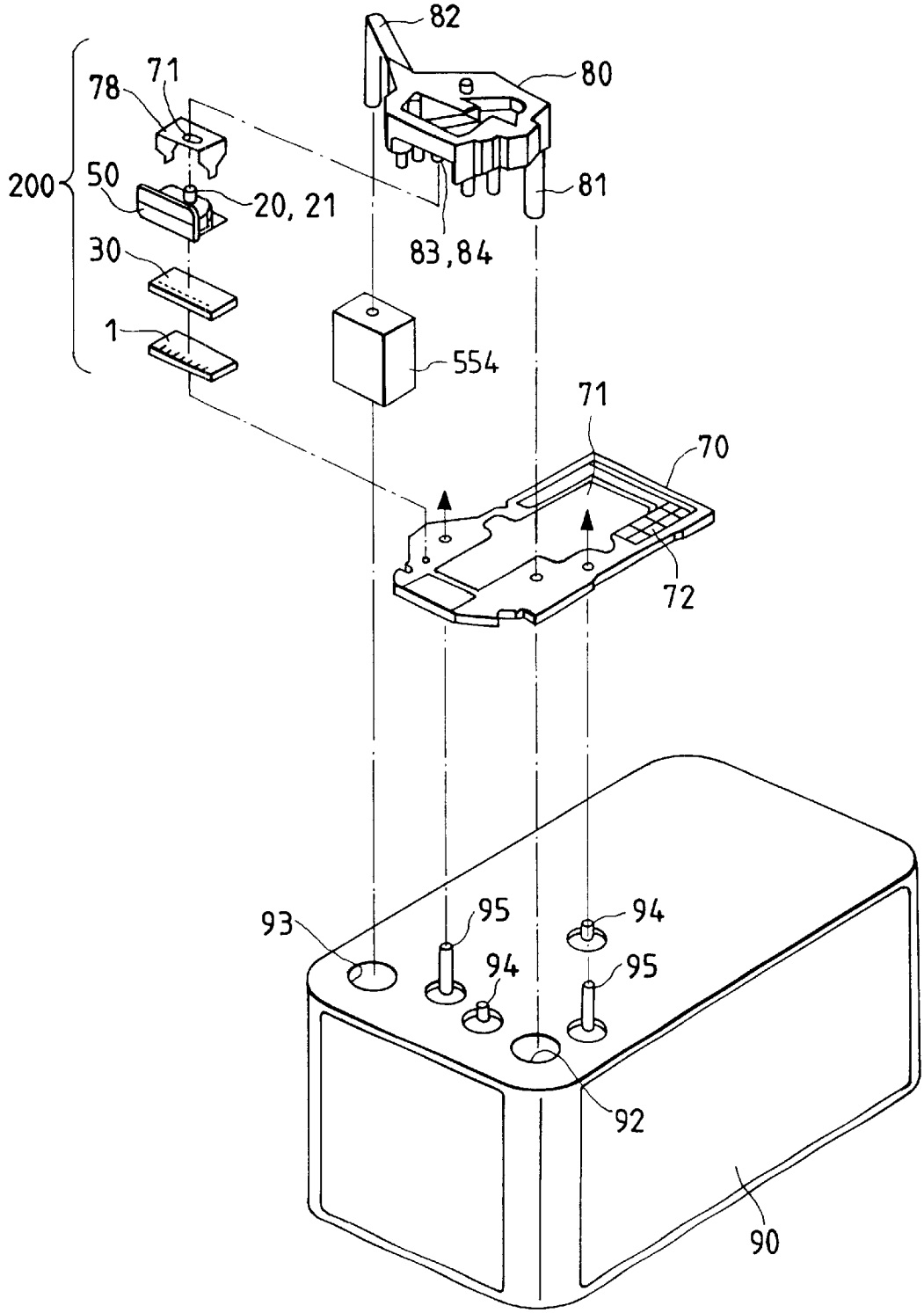
FIG. 57 is an exploded perspective view of a liquid discharge head cartridge.

FIGS. 56 and 57 are views showing the overview of the present invention.

Figure 61:
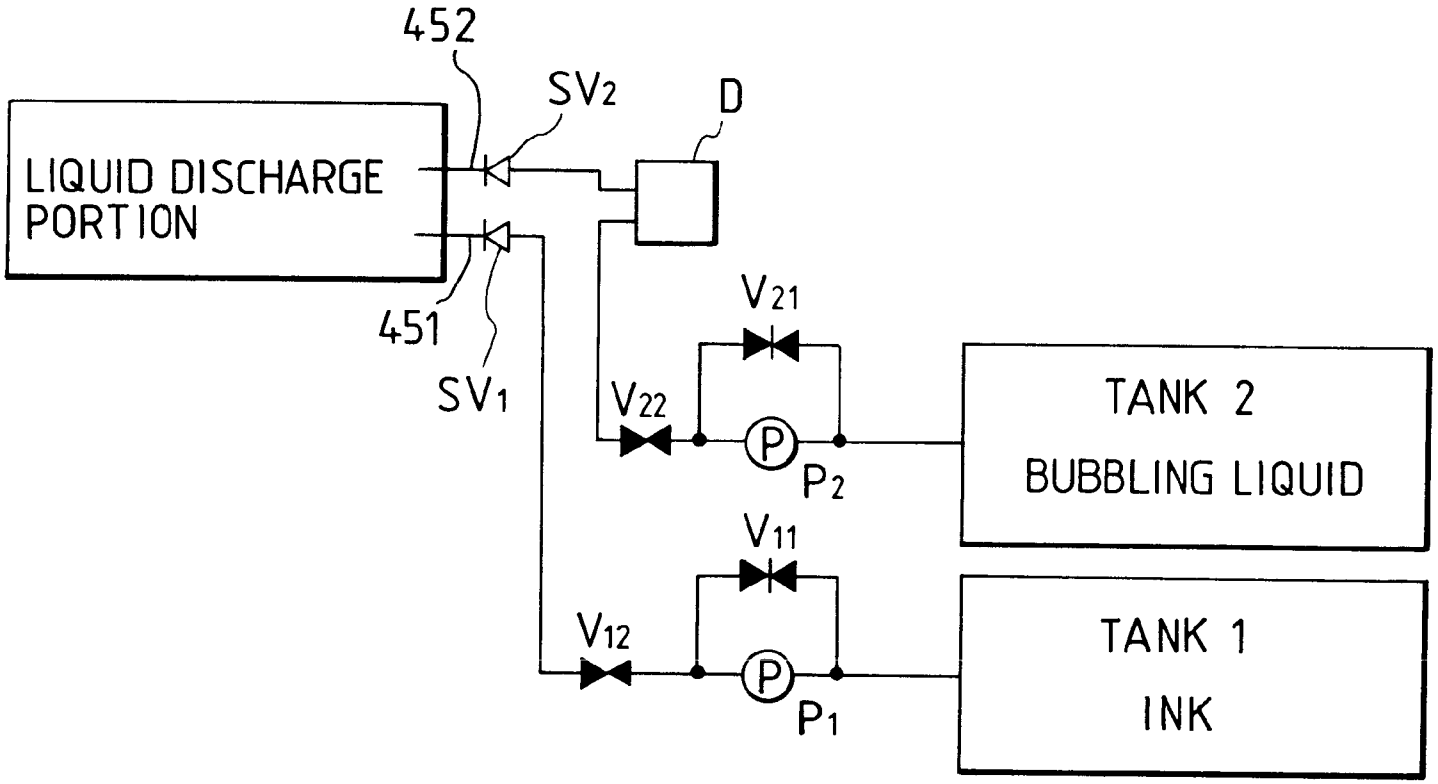
FIG. 61 is a block diagram showing the configuration of a liquid discharge system.

FIG. 56 is a system configurational view for supplying two liquids to the head H using two liquids, as previously described, and FIG. 57 is a typical view of an integral head system with a whole system mounted on the head, though the fundamental system configuration is the same as that of FIG. 56. Also, FIG. 61 shows a block diagram of the whole system.

First, the whole system will be described with reference to FIG. 60. Note that the first liquid and the discharge liquid are the same, and the second liquid and the bubbling liquid are the same in this figure.

A liquid discharge portion 453 of the head 200 is the same as that shown in FIG. 22, wherein a first discharge liquid supply passage 20 supplied with the first liquid is connected with a supply tube 451, and a second supply passage supplied with the second liquid is connected with a supply tube 452. The first liquid side is connected via the supply tube 451 to a check valve SV1, and further connected through the check valve SV1 to a valve V12. Further, the supply tube 451 is branched after the valve V12, to connect to a pump P1 and a valve V11, after which the branches of the supply tube 451 passing in parallel are united, to connect to a first liquid (or discharge liquid) tank. The first liquid is supplied to the head 200 through this passage.

A second liquid supply passage 21 to which the second (bubble generation) liquid of the liquid discharge portion 453 for the head 200 is supplied is connected with a supply tube 452, which is passed via a check valve SV2, a deaerator D, a valve V22, and branched to connect to a valve V21 and a pump P2, after which the branches of the supply tube 452 passing in parallel are united, to connect to a second liquid (or bubbling liquid) tank. The second liquid is supplied to the head 200 through this passage.

While one of two liquids is the recording liquid for use in printing, and the other is the bubbling liquid superior in the bubble generation characteristics, it will be appreciated that one may be the recording liquid, and the other may be the liquid with no or less coloring material, wherein the mixture liquid may be discharged, in another embodiment.

Each function of the system configuration as above will be described in respect of FIG. 60, and also with reference to the block diagram of FIG. 61.

The check valves SV1, SV2 may be basically the same. They allow the liquid to flow in one direction, but not in opposite direction, or will give rise to a much greater flow resistance than that in the flow direction. In this example, they allow for the flow in a direction of supplying the liquid from the tank to the liquid discharge head, and inhibits the flow in opposite direction.

The deaerator D has the function of removing the gas component dissolved in the second liquid (bubbling liquid)

to be supplied to the liquid discharge head or the liquid discharge portion, from the second liquid, via a gas permeable membrane, owing to a pressure difference produced by the vacuum or low pressure. This deaerator D can be placed anywhere in the liquid supply passage (except for the pump P2) from the second liquid tank to the liquid discharge head, or the liquid discharge portion.

The valves V11, V12, V21 and V22 have, in addition to the function of permitting or inhibiting the supply of liquid from the two liquid tanks to the head or liquid discharge portion, by the opening or closing operation, the function for the recovery operation of feeding the liquid to the head by closing the valves V11, V21 and allowing the pumps P1, P2 to feed the liquid to the head or liquid discharge portion. In this example, the pumps P1, P2 can be operated simultaneously or independently.

While one of two liquids is the recording liquid for use in printing, and the other is the bubbling liquid superior in the bubble generation characteristics, it will be appreciated that one may be the recording liquid, and the other may be the liquid with no or less coloring material, wherein the mixture liquid may be discharged, in another embodiment.

Herein, the detailed constitution and operation of each portion will be described below.

Figure 32A:
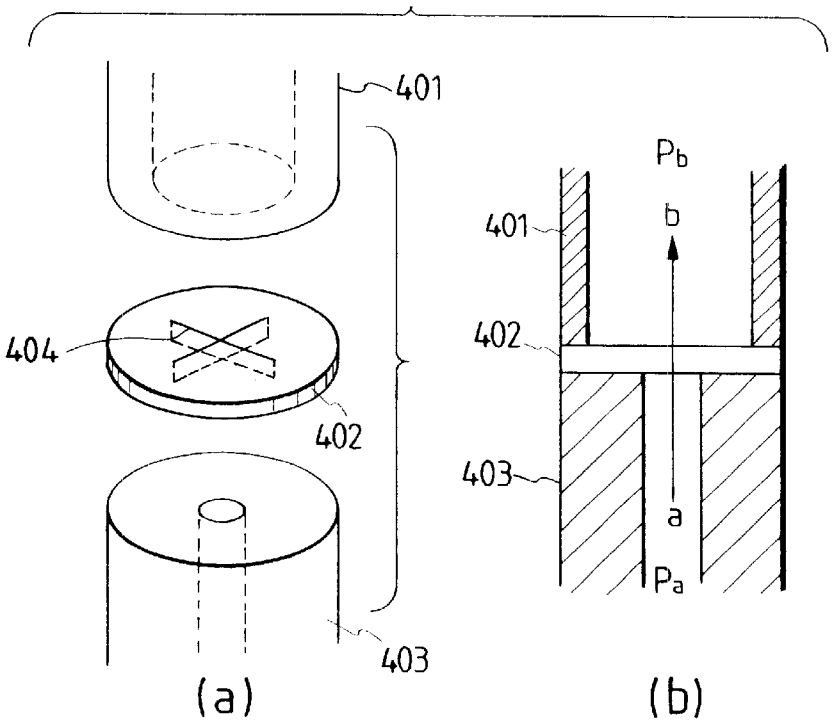
FIGS. 32A, 32B, 32C and 32D are views illustrating the constitution of a check valve.
Figure 32B:
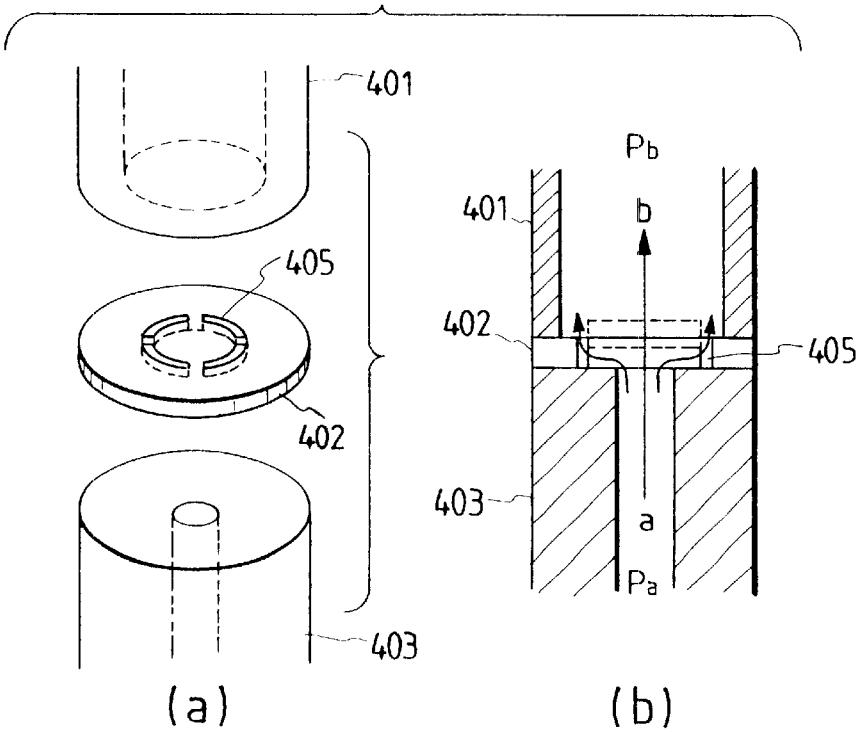
Figure 34A:
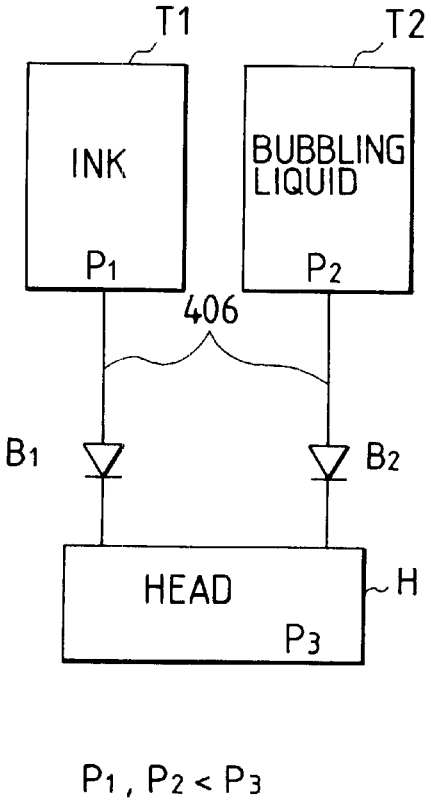
FIGS. 34A and 34B are block diagrams of an example in which a check valve is provided in each of the flow passages for the bubbling liquid and the discharge liquid.
Figure 34B:
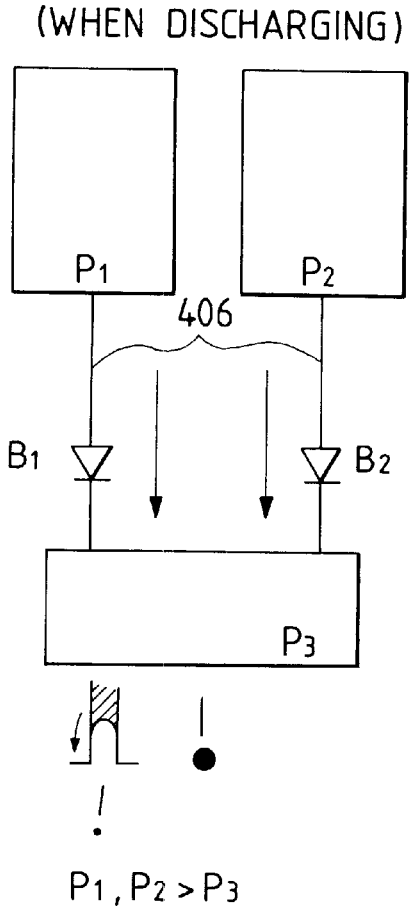
Figure 35:
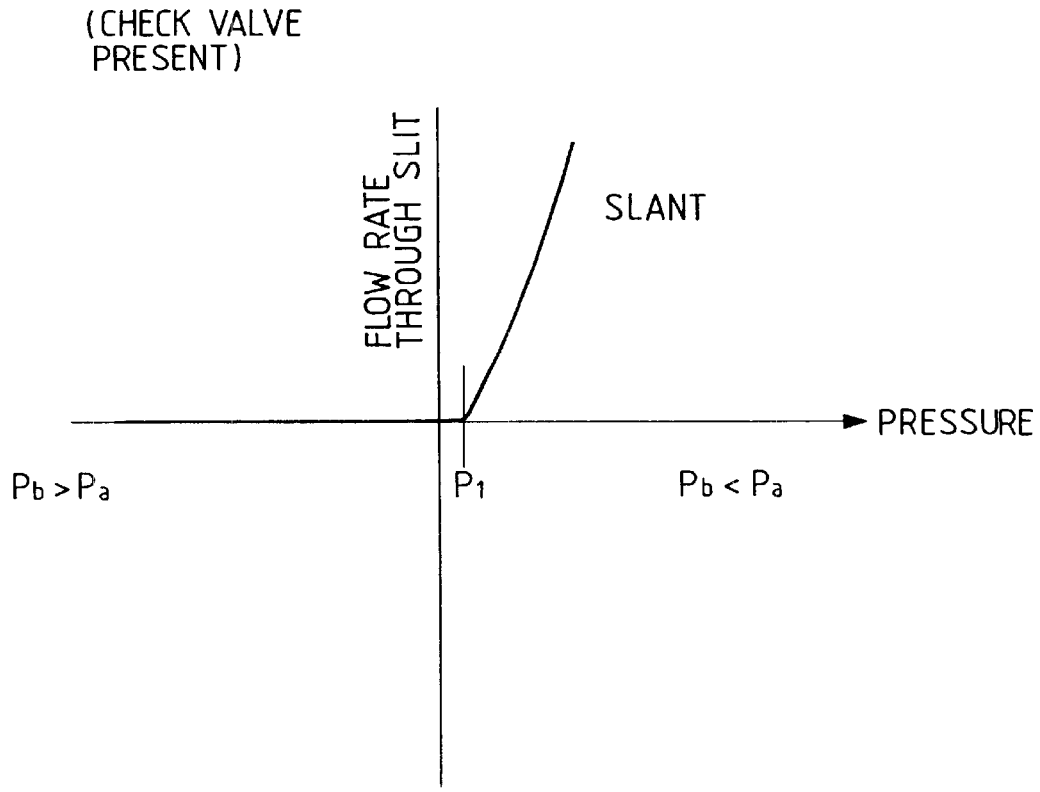
FIG. 35 is a graph showing the negative pressure balance of two liquids in an example using a check valve.

FIG. 32A is an exploded perspective view showing the construction of a check valve, and FIG. 32B is a cross-sectional view. FIGS. 34A and 34B are typical views of the embodiment in which a check valve is provided within each of the flow passages for the bubbling liquid and the discharge liquid, wherein FIG. 34A is in the normal state and FIG. 34B is in the discharge state. Also, FIG. 35 illustrates the negative balance of two liquids in the embodiment using the check valve. Pa is a pressure within a tube 403 and Pb is a pressure within a tube 401, wherein the flow rate is represented when this balance is different.

The effects of the check valve will be described below.

The check valve as shown in FIG. 32A has a plate-like valve member 402 provided with a cross cut line 404 made of an elastic rubber sandwiched between the tubes 401 and 403, thus having directionality for the liquid flow, while the check valve as shown in FIG. 32B, like that of FIG. 32A, has a plate-like valve member 402 provided with a slit 405 sandwiched between the tubes 401 and 403, permitting the liquid flow in a direction from a to b with the movement of a central deformation portion of the plate-like valve member 405, and inhibiting the liquid flow in the opposite direction. These check valves have the directionality for the liquid flow, and the feature of allowing the liquid to flow in a direction from the flow passage a of the slender tube 403 to the flow passage b of the thicker tube 401, while preventing the flow in a direction from the flow passage b of the thicker tube 401 to the flow passage a of slender tube 403.

Figure 32C:
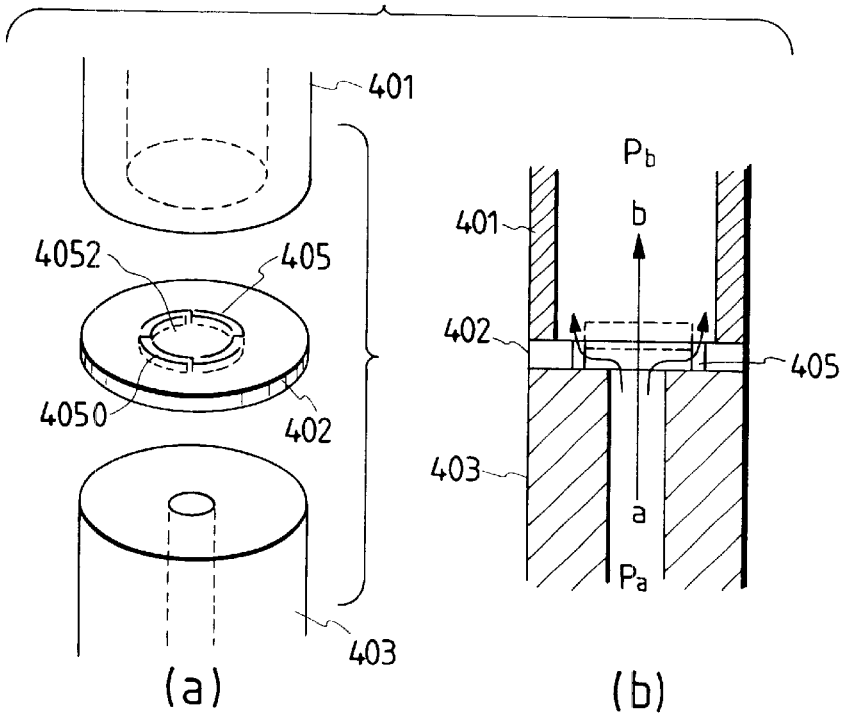
Figure 33:
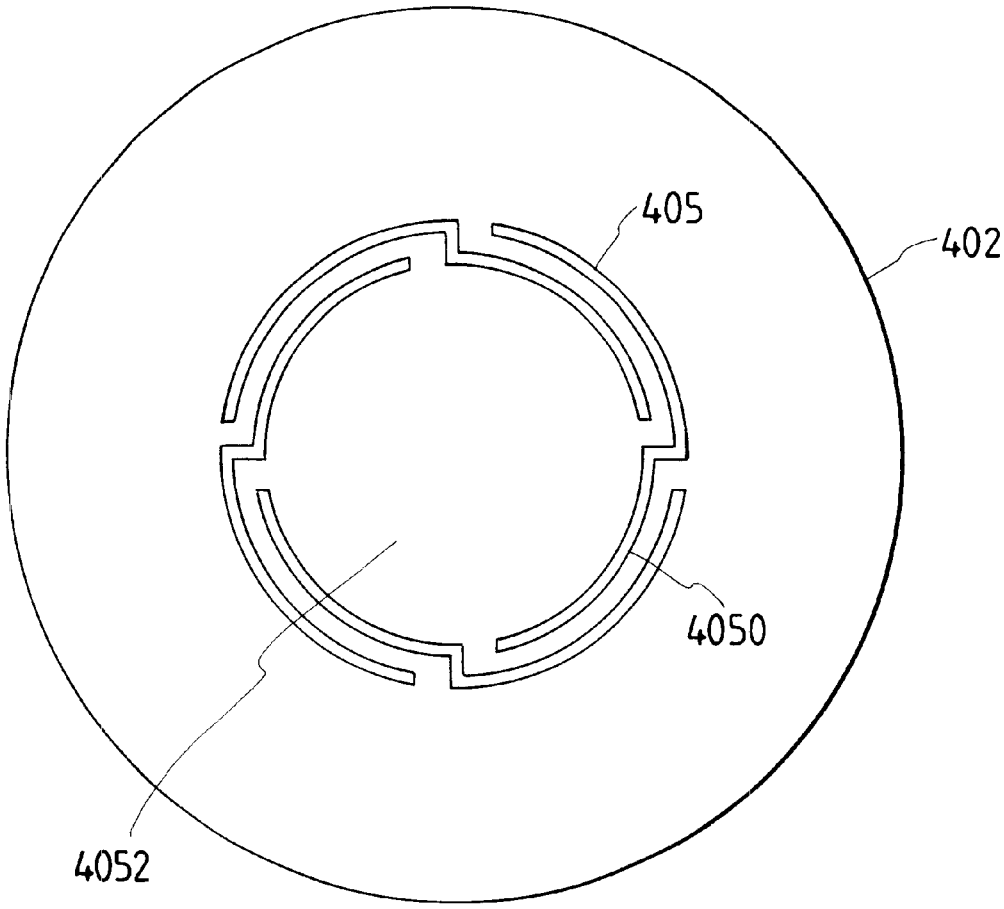
FIG. 33 is an enlarged view of a slit as shown in FIG. 32C.

In FIG. 32C, a variation example of FIG. 32B is shown, wherein a slit 405 is doubly disposed along the external periphery of a valve movable member 4052, with the complicate geometry of the slit 405 of the plate-like valve member 402 (see FIG. 33). Therefore, the area between the slits is a valve spring portion 4050, whereby the valve operation can be effected with a slight pressure difference, because the deformable spring portion 4050 can be longer than that shown in FIG. 32B. Further, the slit is of the double structure, so that the flow resistance becomes small when the liquid flow rate is great.

Figure 32D:
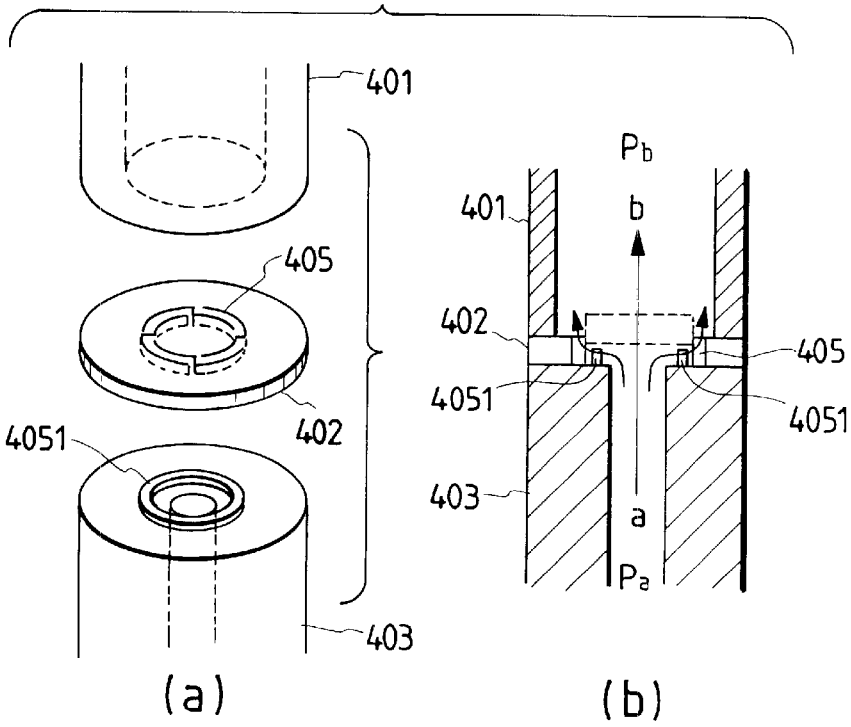

In FIG. 32D, a variation example of FIG. 32C is shown, wherein a rib 4051 is provided to encircle the inner diameter of tube at the contact portion between the inner side of slender tube 403 and the valve movable portion 4052. In combination of these, the valve spring portion 4050 is always subject to a deformation stress, resulting in the closer contact between the valve movable portion 4052 and the rib 4051 to prevent the mixture or diffusion of liquid.

This rib 4051 may be made of the same material as the tube 403, integrally therewith, but if it has higher elasticity, the much closer contact can be effected.

Figure 54:
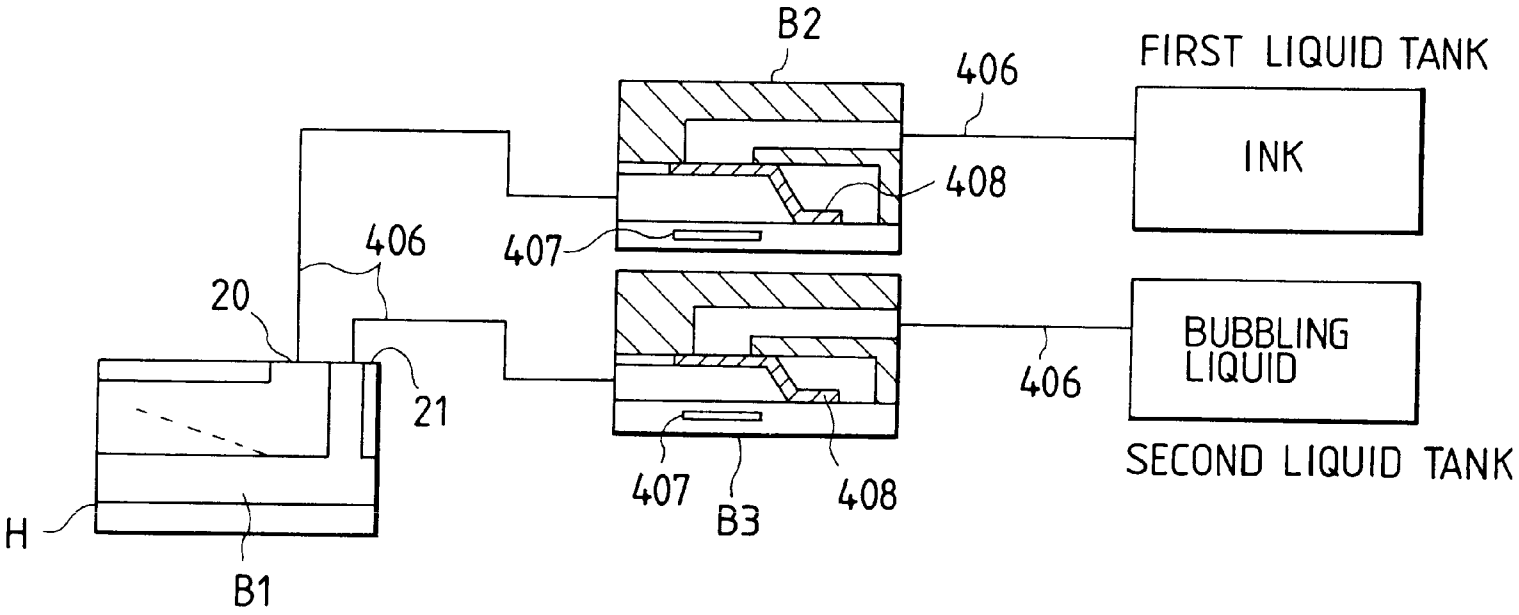
FIG. 54 is a block diagram in which a valve is provided in each supply passage to the liquid discharge head of the present invention.

In this embodiment, as shown in FIGS. 34A and 34B, check valves $B_1$, $B_2$ are provided in the flow passages via the supply tube 406 in a direction of liquid flow from the tank $T_1$, $T_2$ to the head H as in FIGS. 22 and 54, respectively. A check valve $B_1$ is connected to the supply passage 20 (FIG. 22, FIG. 54), and a check valve $B_2$ is connected to the supply passage 21 (FIG. 22, FIG. 54), via the supply tube, leading to the liquid chambers 15, 17, respectively. Normally, since a negative pressure is generated within the tank of each liquid, the liquid holds a meniscus at the discharge port of the head, so that the flow of liquid stands still. In the figure, $P_1$ is a pressure of the ink tank, $P_2$ is a pressure of the bubbling liquid tank, and $P_3$ is a pressure at the nozzle portion of head H (FIG. 34A).

However, if the liquid is discharged from the head H with the heat applied to the heating element (see first heating element 2), a meniscus is produced at the nozzle portion of head in discharging, at which portion a greater negative pressure is generated than that of the tank, resulting in $P_1>P_3$, $P_2>P_3$, whereby the liquid by the amount used for discharging is supplied through the check valves $B_1$, $B_2$ from the tank T to the head H (FIG. 34B).

Also, even at $P_1=P_2$ and $P_2=P_3$, since the flow passage is substantially disrupted by the check valve, the mixture or diffusion of two liquids when left away for a long time can be prevented, but with the check valve as shown in FIG. 32D, even at $P_1=P_2$ and $P_2=P_3$, since the valve movable portion 4052 and the rib 4051 are pressed together, the disrupted state can be maintained in spite of more or less vibration or dispersion in the pressure difference, whereby the liquid mixture or diffusion can be prevented more stably.

Herein, the characteristics of the check valve is shown in FIG. 35. With such characteristics, even if there is a difference in negative pressure between each liquid tank, the discharge ratio of two liquids (ratio of consumption) is easily maintained at constant and well balanced, so that the stable discharge can be made, and the mixture of two liquids at this valve portion can be prevented. In particular, the valve can be closed with a pressure difference below a point $P_1$ by the rib 405 of FIG. 32D. Also, the level of $P_1$ can be defined in accordance with the height of rib 4051. That is, $P_1$ can be raised with greater height of rib 4051, to prevent the mixture or diffusion of two liquids more surely.

In particularly, in FIG. 32C, since the spring portion 4050 can be lengthened, the slant of FIG. 35 can be increased, resulting in enhanced response of valve opening to pressure difference or flow property, with suppressed dispersion in the characteristics.

Also, in FIG. 32D, the valve opening can be suppressed up to a $P_o$ level in the area $P_b<P_a$ of FIG. 35, whereby the liquid mixture due to the dispersion factors as previously described can be prevented. Further, by changing the parameters such as the height of rib 4051, the value of P0 can be controlled.

In this embodiment, an experiment was made by setting the diameter of valve movable portion to about 1 to 5 mm, the thickness of plate-like valve member 402 to 0.005 to 0.05 mm, and the width of slit 405 to 0.005 to 0.1 mm, so that the slant of liquid flow rate to the pressure in FIG. 35 could be increased and the excellent characteristics could be obtained. Also, the flow of about 5 to 20 mmAq could be realized at P0, whereby the opening and closing response could be improved while preventing the liquid mixture.

The operation in FIGS. 34A and 34B will be described below in greater detail. For the pressure $P_1$ of an ink tank T1 and the pressure $P_2$ of a bubble generation tank T2, $0 \geqq P_1$, $P_2 \geqq -200$ mmAq. Note that a positive pressure tank not exceeding the value of P0 can be used with the rib 4051.

The pressure $P_3$ within the liquid chamber and nozzle portion of the head H is substantially invariable, unless the liquid is moved, and automatically maintained at a value ($P_3 \geqq P_1$, $P_2$) equal to or slightly greater than the tank pressures $P_1$, $P_2$ with the characteristics of the valve, not causing the liquid mixture or movement (state of FIG. 34A). However, if the liquid is discharged from the nozzle, the state of FIG. 34B results. That is, since the meniscus at the discharge port of nozzle is retracted toward the nozzle to an extent corresponding to the discharged liquid amount, the capillary force is produced corresponding to the shape of the nozzle. Due to this force, the meniscus begins to return to the discharge port, while a great negative pressure is generated in the nozzle and the liquid chamber.

The negative pressure within the liquid chamber is determined by the capillary force, and smaller than the tank internal pressure, i.e., in a range from −250 to 6000 mmAq. Such a wide range resulted from the area and peripheral length of the discharge port and nozzle to produce the capillary force.

While in this example, the check valve was used in both supply passages for the head using two liquids, it will be appreciated that the check valve may be used in either of them to prevent the liquid mixture or diffusion.

Furthermore, when the check valve is used for both supply passages, the check valve having different characteristics is used for each supply passage, whereby the ratio of the exhausted amount of bubbling liquid to that of discharge liquid can be controlled. That is, in the characteristics of the check valve as shown in FIG. 35, if the check valve having a different slant of pressure to flow rate is used for each of the supply passages of two liquids, the exhausted amount of each liquid is substantially in proportional relation at the ratio between its slant constants. For example, when the consumed ratio of the discharge liquid to the bubbling liquid is made 10 to 11, the check valves having different characteristics with the ratio of the slant constants of 10 to 11 may be used.

Further, the check valve, which allows for the flow of liquid only in one direction, can prevent the diffusion of two liquids when not printing.

While in this embodiment, the head of two liquids was described, it will be appreciated that in the head of one flow passage, the check valve may be also used in the flow passage to prevent the back wave when the bubble disappears, and effect the stable discharge.

Figure 36A:
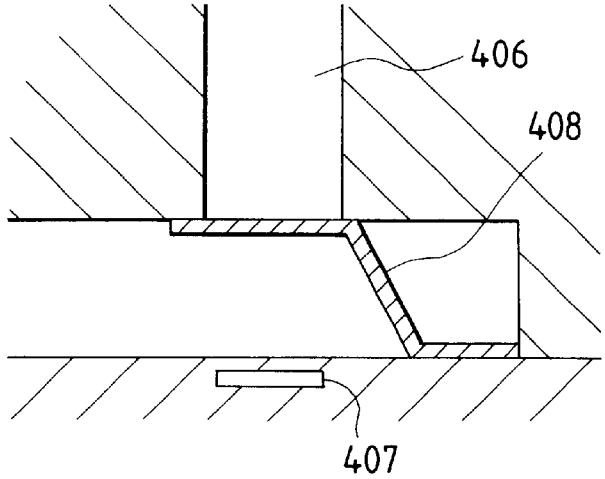
FIGS. 36A, 36B and 36C are views showing the constitution of another check valve.
Figure 36B:
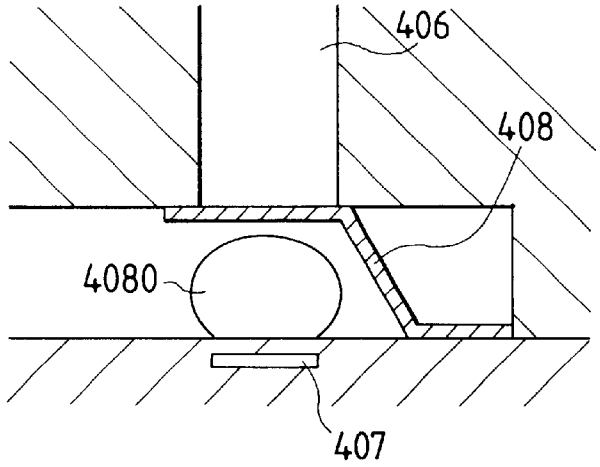
Figure 36C:
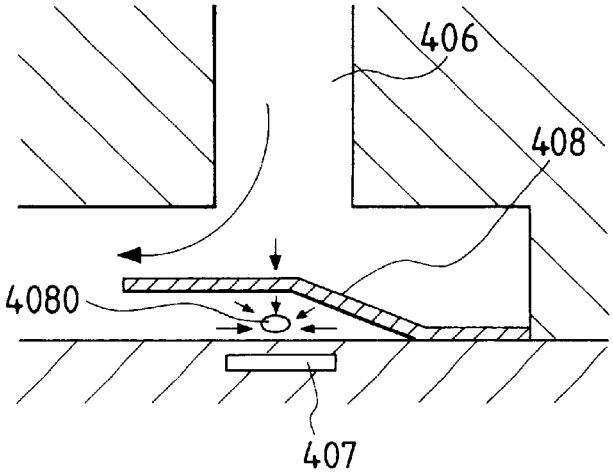

While the check valve of the shape as shown in FIG. 32A and made of silicon rubber was used, it will be appreciated that an active valve activated by the bubble generation/bubble disappearance of bubble, bimetal or electrostatic adsorption, as shown in FIG. 32B or FIGS. 36A to 36C, may be used. The materials may include the resin, metal, and solvent resistant substance. The check valve may be formed integrally with the separation wall by electrocasting. FIGS. 36A to 36C show a valve member 408 which is used in the liquid passage, having the valve feature of permitting the liquid flow in the direction of the arrow, as well as a check valve function and an active valve function in such that a bubble 408 is produced by generating the bubble in the liquid in the liquid passage 406 by heating of a heating element 407, as shown in FIG. 36B, and then the valve is opened by attracting the valve member 408 owing to a negative pressure when the bubble disappears, as shown in FIG. 36C, whereby the flow resistance in this portion can be extremely reduced in the open state, resulting in a greater supply rate of liquid, which is preferable for the fast printing.

Figure 37:
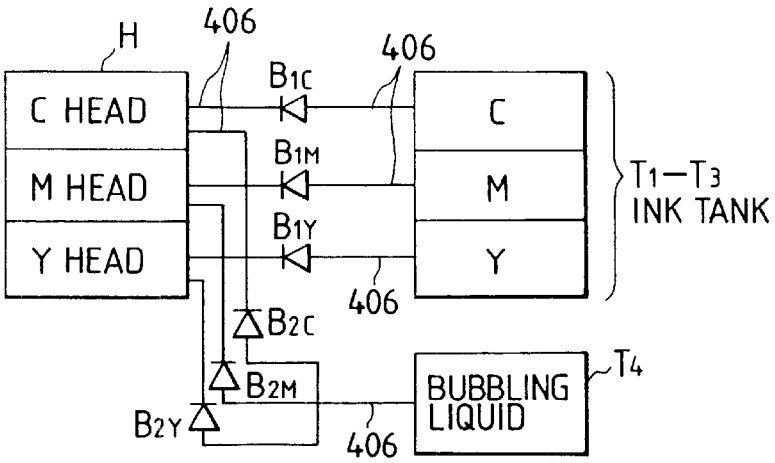
FIG. 37 is a block diagram of an example in which a check valve is provided in each flow passage to a liquid chamber separation type color head.

FIG. 37 is a typical diagram of this example having a check valve in the flow passage into a liquid chamber separable type color head.

The ink is supplied to the first flow passage within the head, for each color of C (cyan), M (magenta), and Y (yellow), with the check valves $B_1$ in the supply passages from the tanks $T_1$ to $T_3$. Also, the bubbling liquid is supplied to the second flow passage, with the check valves $B_2$ in the supply passages from one tank $T_4$.

With this constitution, it is unnecessary to use the identical number of bubbling liquids in the multi-color tank/head, which is preferable for the miniaturization of the apparatus or the reduced cost.

Thus, even if there is a negative pressure difference in each tank, the bubbling liquid can be supplied from the common tank, without being influenced by the negative pressure difference, because the check valve is used in the supply passage to prevent the liquid movement between the tanks, as previously described, resulting in the stable discharge.

Also, since the liquid mixture or diffusion can be prevented, the multi-color inks can be used without color mixture or diffusion of liquids.

Example 2

Figure 38:
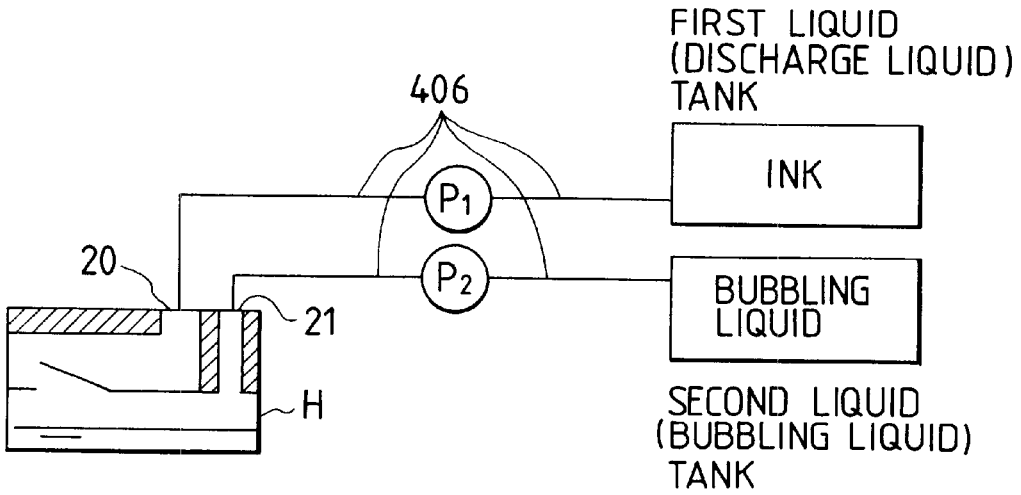
FIG. 38 is a block diagram of an example in which a pressure pump for the pressure recovery is provided in each supply passage to the liquid discharge head of the present invention.

FIG. 38 is a typical diagram of an example wherein a pressure pump for the pressure recovery is provided in each supply passage to a liquid discharge head of the present invention.

In the head of two liquids according to the present invention, since it is difficult to discharge the first liquid (discharge liquid) and the second liquid (bubbling liquid) in respective amounts as required in the suction recovery from the discharge ports, the independently controlled recovery can be effected by using a separate pump for supplying the liquid in a respective supply passage.

Also, in the liquid discharge head of the present invention, when various inks such as a highly viscous ink or solid ink can be used, the recovery unit may be clogged or fixed in the conventional suction recovery system of the main unit, depending on the kind of ink, whereby it is necessary to design these in view of the ink.

When the head is exchanged and other colors or kinds of the ink are used, the deterioration may occur within the recovery system by combination of used inks.

Accordingly, in this example, the pressure recovery of the liquid discharge head H is performed using a pressure pump P, and any complicate mechanism in the recovery system of the main unit was dispensed with.

The pressure pump may be a tube pump, an oscillating flap, a bubble jet (BJ) pump or an adjustable vane small pump.

Figure 39:
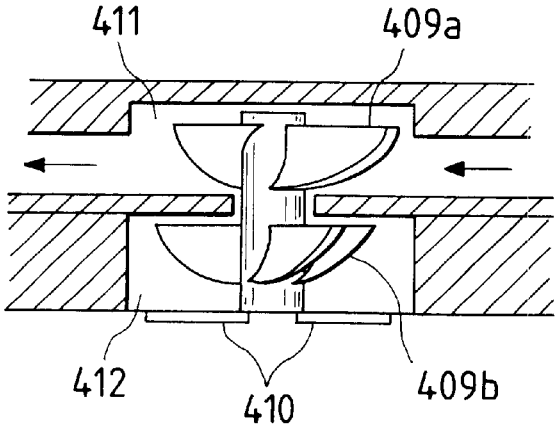
FIG. 39 is a view showing one example of a pump.

In the liquid discharge head of two flow passages, one pressure pump may be provided for each flow passage, but one pump may be commonly used to pressurize two flow passages, as shown in FIG. 39. FIG. 39 is a view of a BJ pump which transports the liquid by rotating a propeller 409*b* with a pressure produced by bubble generation of the liquid caused by heating of the heat generating members 410, and rotating a propeller 409*a* attached coaxially, in which case this pump, the discharge liquid for use in the two liquid type head can be transported by this pump, using the bubbling liquid in a second liquid passage 412. Also, it can be used for one liquid type.

Example 3

Figure 40A:
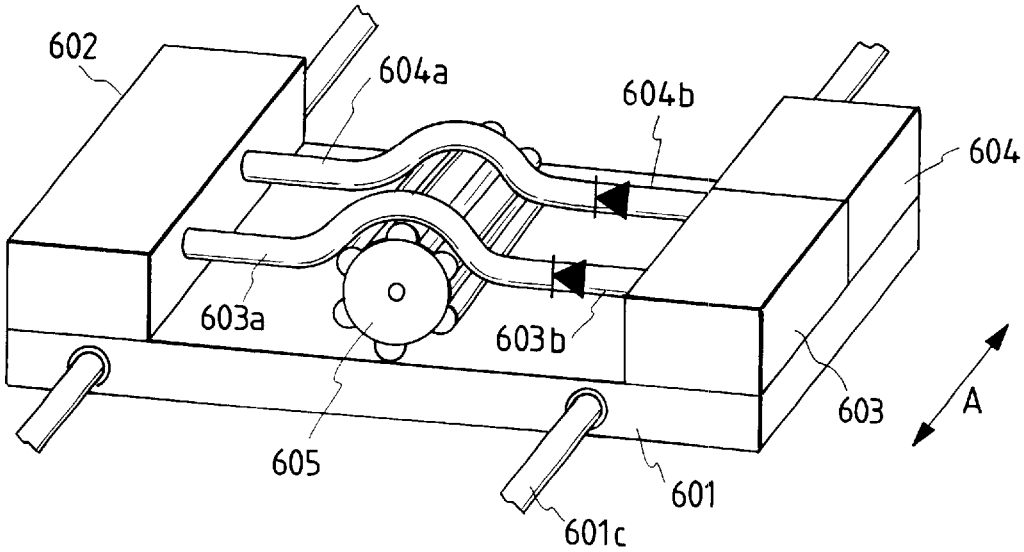
Figure 40B:
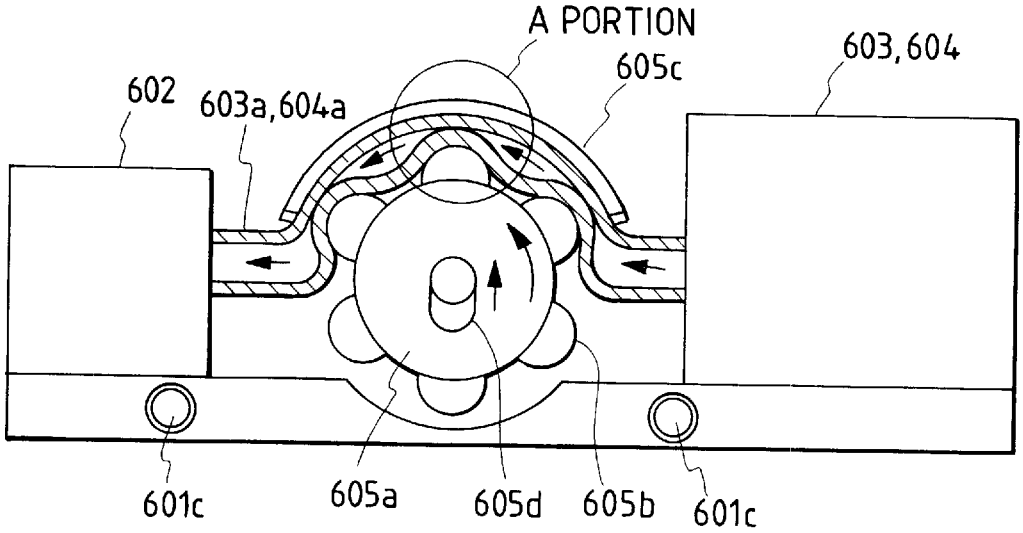

FIGS. 40A and 40B are views for explaining a third example of the present invention, wherein FIG. 40A is a perspective view, and FIG. 40B is a cross-sectional view.

In FIGS. 40A and 40B, on a carriage 601 are disposed a liquid discharge head 602, a liquid vessel 603 for storing the discharge liquid, a liquid vessel 604 for storing the bubbling liquid, and a tube pump 605.

Figure 63A:
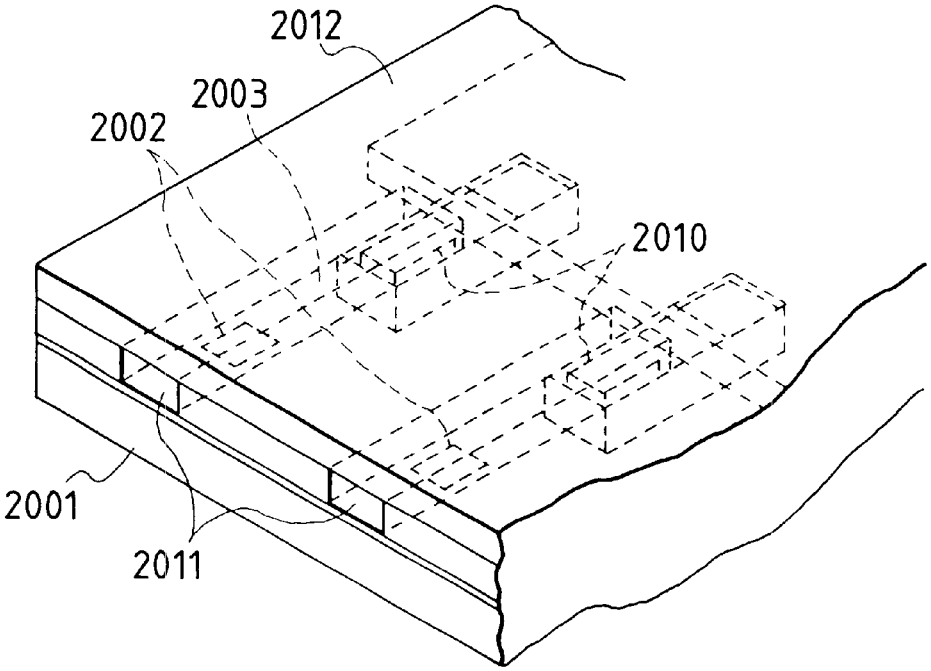
FIGS. 63A and 63B are views for explaining the structure of liquid flow passage in the conventional liquid discharge head.
Figure 63B:
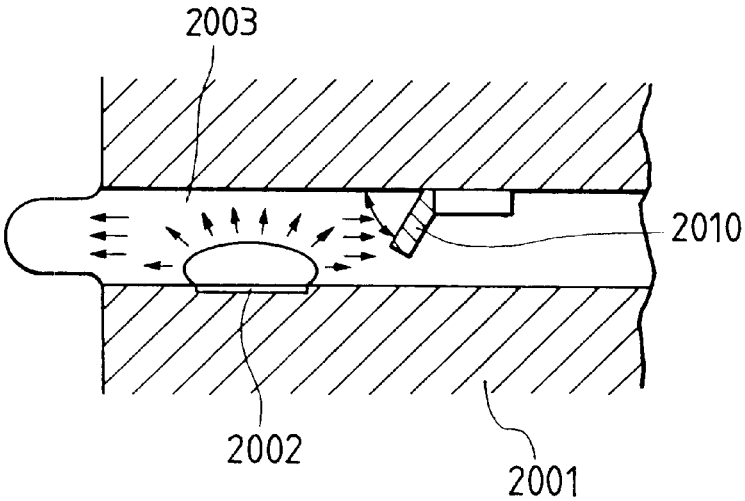

The carriage 601 is for example a carriage HC of the recording apparatus as shown in FIGS. 63A and 63B, and as previously described with the discharge principle, and is reciprocated in the width direction (sub-scan direction) A of the recording medium such as the recording sheet which is conveyed by recording medium conveying means, while being supported around the shafts 601C.

The discharge head 602 is a head having the first liquid flow passage (discharge liquid flow passage) communicating to the discharge port and the second liquid flow passage (bubbling liquid) containing the bubble producing area, for example, as described in the above embodiment. The first liquid flow passage is connected via a tube 603*a* to the liquid vessel 603, and the second liquid passage is connected via a tube 604*a* to the liquid vessel 604. On the liquid vessel side of each tube 603*a*, 604*a*, the one-way valves 603*b*, 604*b* are provided to allow the liquid to flow from the liquid vessel to the head but prevent the reverse flow.

Between the liquid discharge head 602 and the liquid vessels 603, 604, a tube pump 605 using the above tubes 603*a*, 604*a* is provided, thereby constituting liquid transporting means. This tube pump 605 is comprised of a rotor 605*a* having a plurality of rollers 605*b* on the circumference and a pan 605*c* for pressing the rotor 605*a* against the tube, as shown in FIG. 40B. This pan 605*c* is curved along a roller face of the rotor 605*a*. This tube pump 605 has the tubes 603*a*, 604*a* disposed between the rotor 605*a* and the pan 605*c*, the tube being deformed by pressing the rotor 605*a* against the pan 605*c*, thereby rotating the rotor 605*a* to feed the liquid into the head.

Figure 41A:
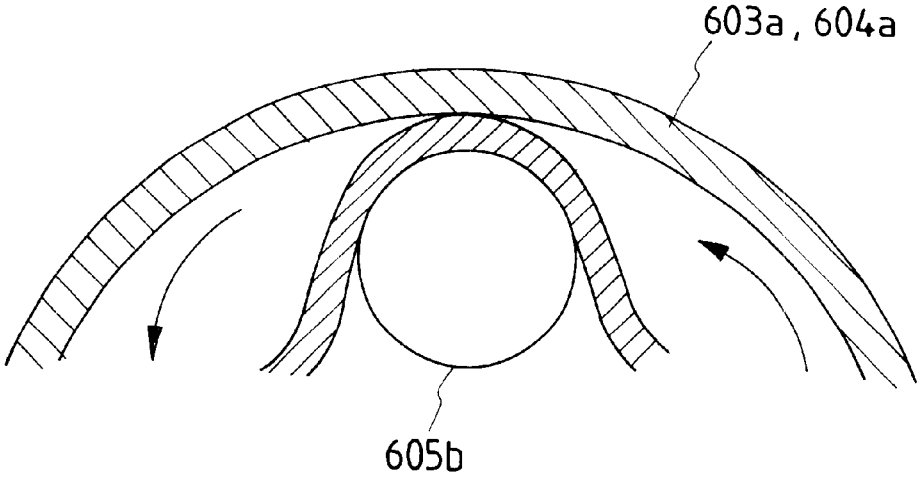
Figure 41B:
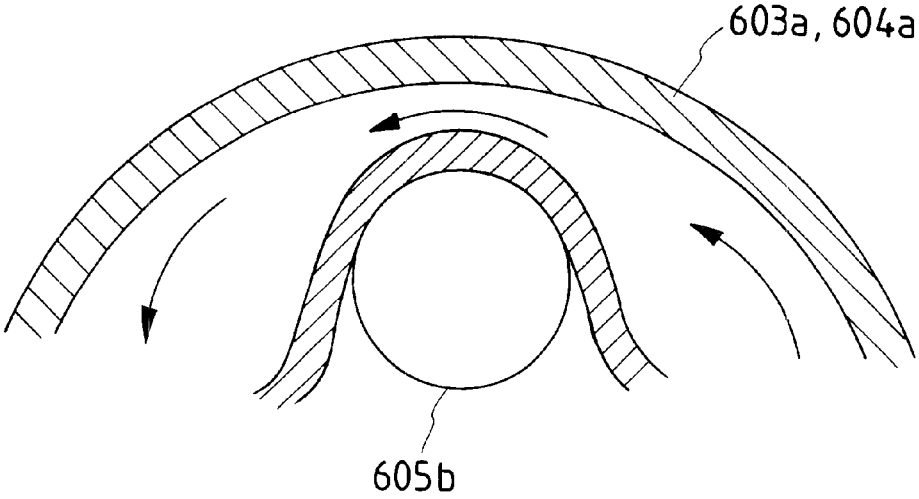

Also, the rotor 605*a* is provided with a movable bearing 605*d*, which can adjust the force pressing the rotor 605*a* against the pan 605*c* freely. Thereby, the tubes 603*a*, 604*a* are fully compressed, as shown in FIG. 41A, allowing for the liquid supply of constant liquid amount in accordance with the rotation of the rotor 605*a*, or the tubes are not fully closed, as shown in FIG. 41B, giving rise to the flow resistance, to prevent the liquid supply from occurring with a greater pressure than necessary. For example, if the tube 604*a* (for bubbling liquid) is placed in a state as shown in FIG. 41B, the liquid can be supplied, while adjusting the pressure balance for the supply of discharge liquid to the first liquid flow passage and the supply of bubbling liquid to the second liquid flow passage.

In the recovery device with the above constitution, when the head recovery is performed, the carriage 601 is first moved to a home position for effecting the recovery operation (e.g., Home Position), the tube pump 605 is operated, while a cap remains attached on the discharge face of head, to supply the discharge liquid and the bubbling liquid to the first and second liquid flow passages, respectively. In this way, the liquid is supplied to each liquid flow passage to perform the head recovery. Note that the reverse flow of liquid caused by a pressure difference after the recovery operation will not occur owing to the provision of one-way valves 603*b*, 604*b*.

Figure 42:
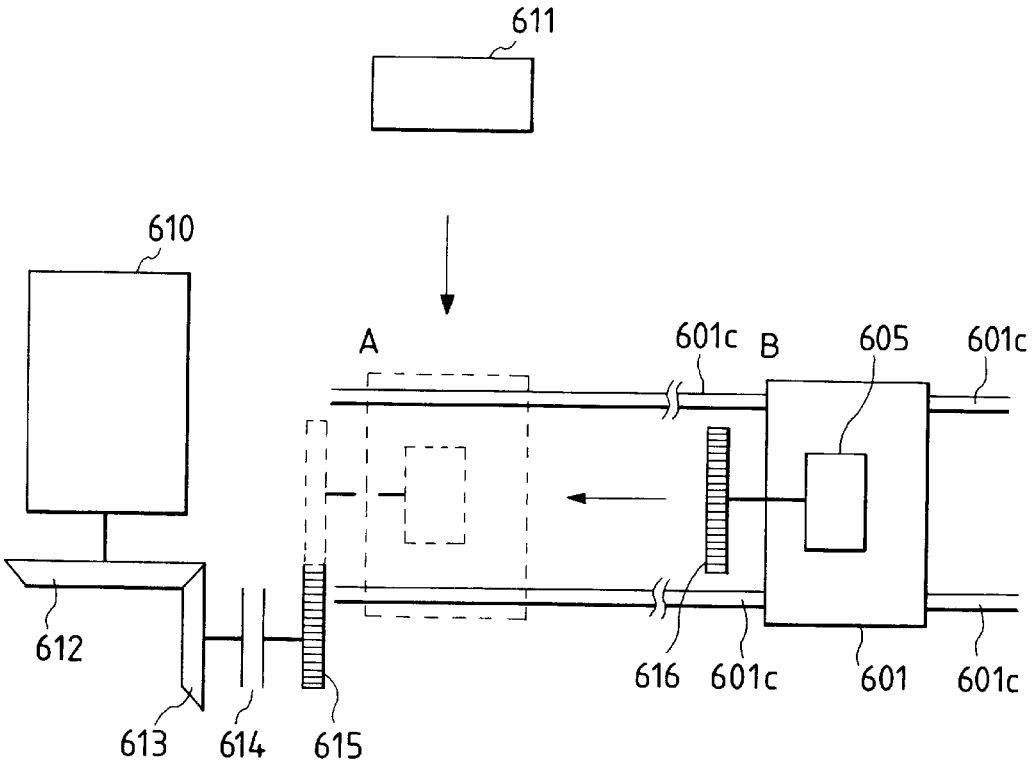
FIG. 42 is a diagram schematically showing the drive transmission at a home position of the tube pump.

One example of transmitting the drive at the home position of the tube pump is typically illustrated in FIG. 42. In the same figure, position A is the home position, at which a drive motor 610 for driving the tube pump is provided. A first gear 612 is provided on a drive shaft of the drive motor 610, a driving force obtained from this first gear being transmitted to a second gear 613, and via a clutch 614 to a third gear 615. On the other hand, a fourth gear 616 is provided around a rotational shaft of the tube pump 605 on the carriage 601, whereby when the carriage is moved from position B to position A which is the home position, the fourth gear 616 is meshed with the third gear 615 to transmit the driving force from the drive motor 610 to the tube pump 605.

At the home position, the cap 611 is provided, whereby when the head recovery is performed, the discharge face of head is capped with this cap 610, so that the drain liquid from the discharge ports is exhausted through this cap 610 in driving the tube pump.

Figure 43:
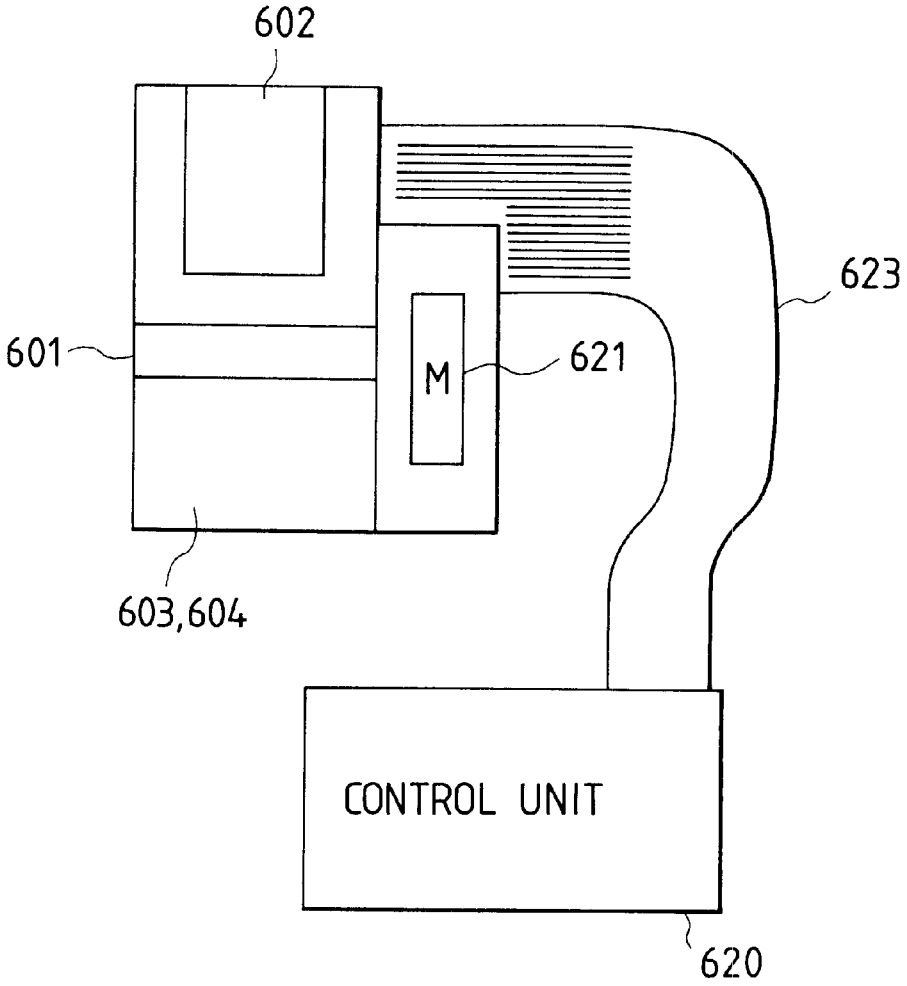
FIG. 43 is a diagram showing a drive system provided with a drive motor for the tube pump on the carriage.

As a system different from the drive system as shown in FIG. 42, a drive motor 621 for driving the tube pump may be provided on the carriage, for example, as shown in FIG. 43. In this case, the drive motor 621 is connected via a flexible cable 623 to a control unit 620 on the main body of the apparatus, and driven based on a control signal from the control unit 620.

While in the head of two liquid flow passages such as the liquid discharge head 602 as above described, since various liquids having different viscosities can be discharge, as previously described with the discharge principle, it is desirable to use the above-cited tube pump capable of freely adjusting the recovery amount or the liquid transport speed to cope with a variety of kinds of inks, it should be noted that other pumps than this tube pump may be employed such as a cylinder pump or a diaphragm pump.

Example 4

While in the above example 3, the tube pump is provided on the carriage, it should be noted that the tube pump may be provided on a main unit of the recording apparatus.

Figure 44A:
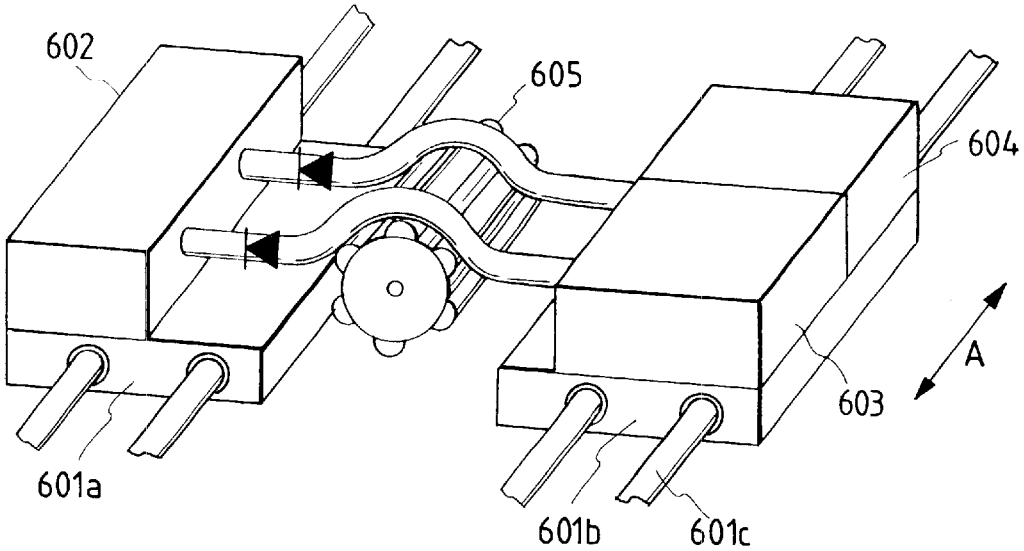
Figure 44B:
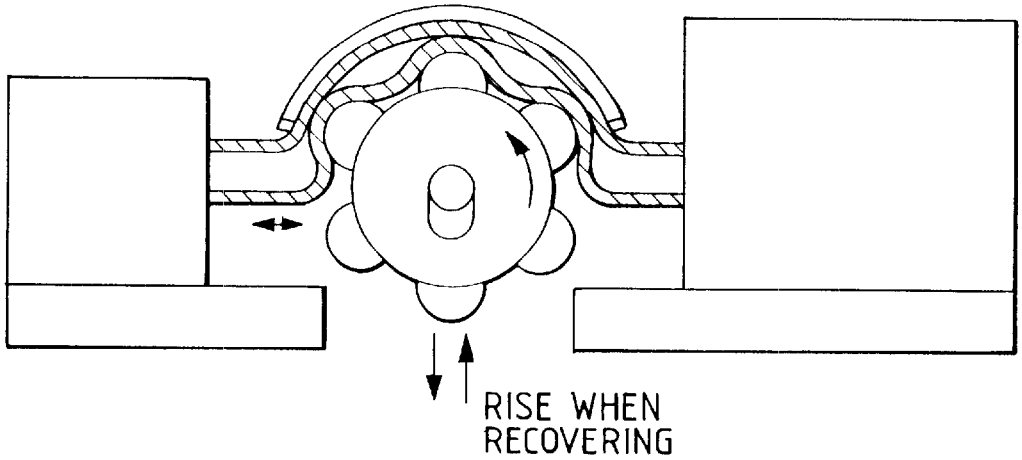

FIGS. 44A and 44B are views for explaining a fourth example, wherein FIG. 44A is a perspective view and FIG. 44B is a cross-sectional view. In the figure, like numerals are attached to the same components as those of the recovery device of example 3, and the explanation of those components is omitted.

The recovery device of this example has a liquid discharge head 602 mounted on a carriage 601*a* supported around the shafts 601*c* and moved along the direction A, and the liquid vessels 603, 604 for the supply of liquid via the tube to the liquid discharge head 602 mounted on a carriage 601*b*. A connecting member (not shown) is used for the connection with these carriages 601*a*, 601*b*.

The spacing between the carriages 601*a*, 601*b* may be large enough to allow a tube pump 605 to be moved between the liquid discharge head 602 and the liquid vessels 603, 604 at the home position, when in the recovery operation. It will be appreciated that the spacing between these carriages

601*a*, 601*b* may be provided only for the recovery operation, since they are unnecessary during the other operation (recording operation).

In the recovery device with the above constitution, in performing the head recovery, the carriages 601*a*, 601*b* are moved to the recovery position (or home position) for the recovery operation. If the carriages 601*a*, 601*b* are moved to the recovery position, the tube pump 605 slides or rises from below, so that the tube is pressed against a pan by a roller. And the discharge face of head is capped, and the tube pump 605 is driven to supply the discharge liquid and the bubbling liquid to the first and second liquid flow passages, respectively, so that the drain liquid from the discharge ports is exhausted through this cap.

Example 5

While the examples 3, 4, the tube pump is provided between the liquid discharge head and the liquid vessels to feed the liquid into each liquid flow passage (liquid transporting means), it should be noted that the liquid may be fed from the liquid vessel to each liquid flow passage by feeding the air into the liquid vessels by means of the tube pump (liquid transporting means).

Figure 45A:
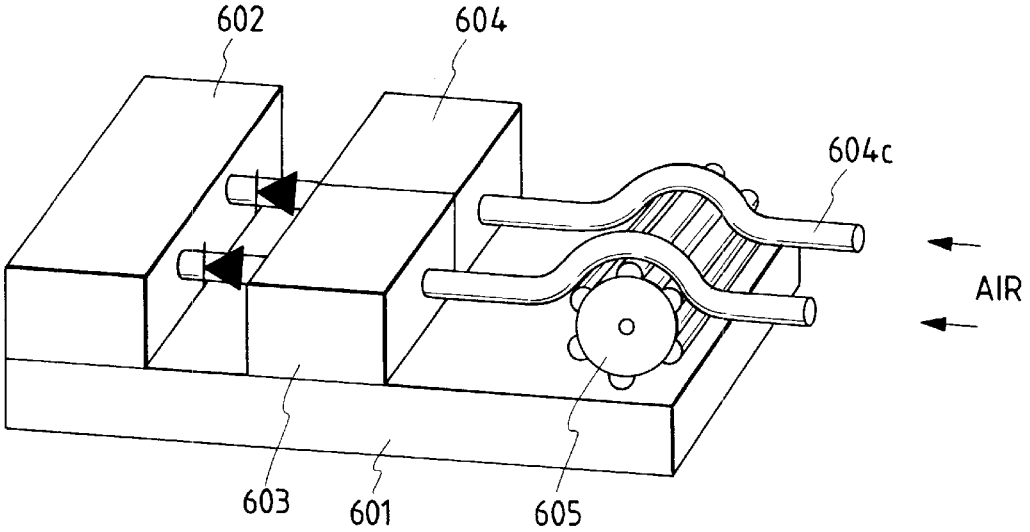
Figure 45B:
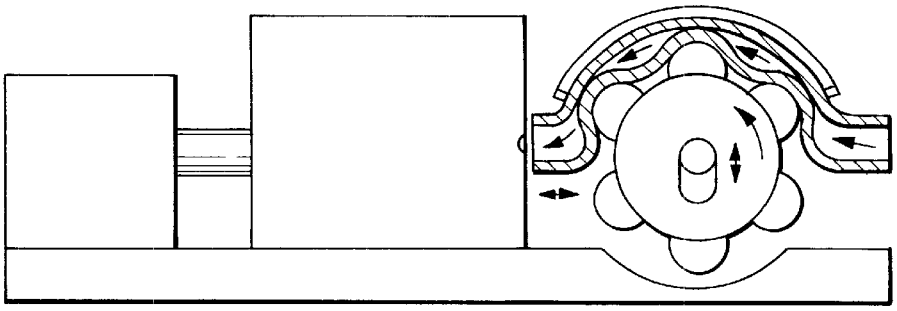

FIGS. 45A and 45B are views for explaining a fifth example of this invention, wherein FIG. 45A is a perspective view and FIG. 45B is a cross-sectional view. A recovery device of this example is the same as in the above example 1, except that the air is fed into the liquid vessel by the tube pump. In the figure, like numerals are attached to the same components as those of the recovery device of the example 3, and the explanation of those components is omitted.

On a carriage 601, a liquid discharge head 602, liquid vessels 603, 604, and a tube pump 605 are mounted. The liquid vessels 603, 604 are provided with the tubes 603*c*, 604*c* for feeding the air into the vessels, respectively, which constitute the tube pump 605.

In this recovery device, if the tube pump 605 is driven, the air is fed via the tubes 603*c*, 604*c* into the liquid vessels 603, 604. If the air has been fed into the liquid vessels 603, 604, the liquid is fed, by an amount corresponding to the amount of the air which has been fed, from the liquid vessels 603, 604 via the tubes 603*a*, 604*a* to the liquid discharge head 602. In this way, the liquid is fed from the liquid vessel into each liquid flow passage by feeding the air into the liquid vessels by means of the tube pump, to effect the head recovery.

Figure 46A:
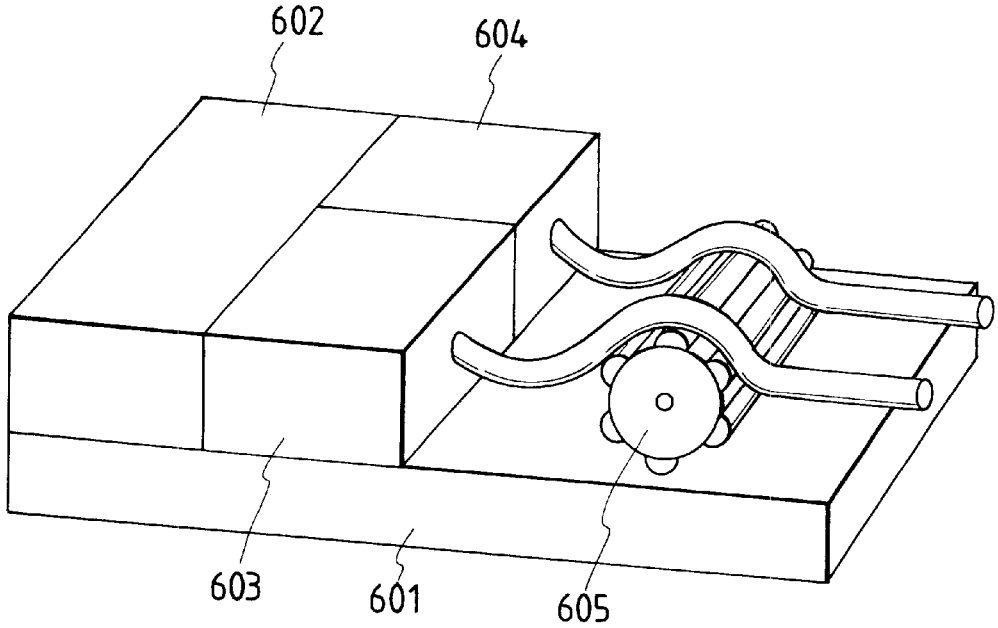

In the recovery device of this example, since it is not necessary to have the tube between the liquid discharge head 602 and the liquid vessels 603, 604, the liquid vessels 603, 604 may be attached to the liquid discharge head 602 (e.g., head cartridge), for example, as shown in FIG. 46A. Thereby, the total size can be reduced. In this case, one-way valve is not provided, but the reverse flow is prevented by pressing the rotor against a pan in the tube pump 605 without driving the tube pump 605. In this state, the recording is performed by discharging the liquid.

It will be appreciated that since the tube pump transports the air, the tubes 603*c*, 604*c* provided on the pump itself may be pressed, at one end thereof, onto an atmosphere communicating opening provided on a side wall of liquid vessel.

Example 6

While in the above example 5, the tube pump was provided on the carriage, it should be noted that the tube pump may be provided in a main unit of the recording apparatus.

Figure 47A:
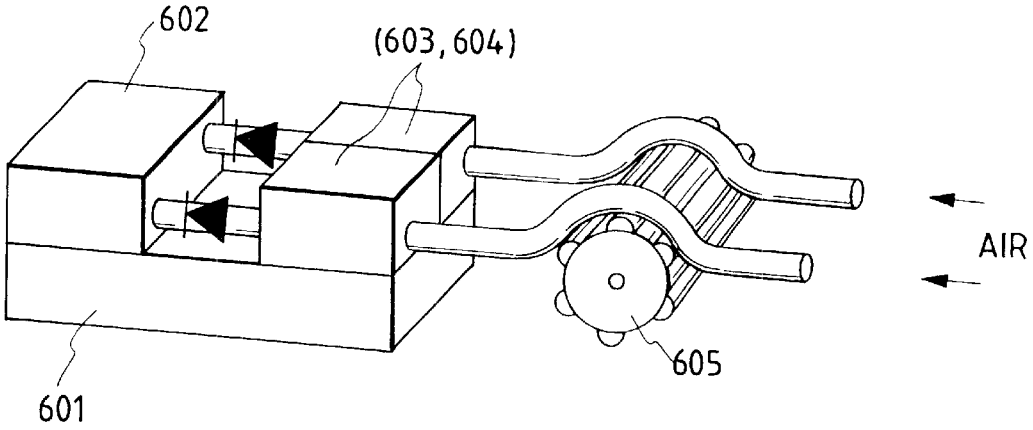
Figure 47B:
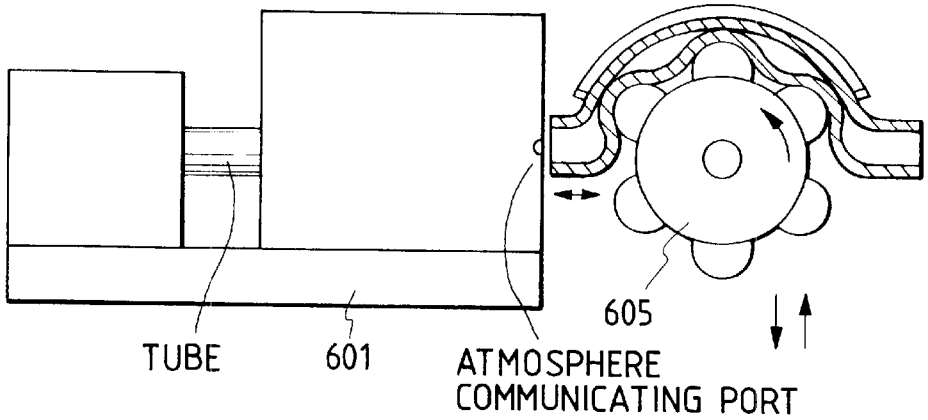

FIGS. 47A and 47B are views for explaining a sixth example, wherein FIG. 47A is a perspective view and FIG. 47B is a cross-sectional view. In the figure, like numerals are attached to the same components as those of the recovery device of example 4, and the explanation of those components is omitted.

In this example, a tube pump 605 is not mounted on the carriage 601, but provided on a main unit of the recording apparatus, and slides or rises from below upon the recovery operation, so that the tubes 603*c*, 604*c* are sandwiched between a roller of the tube pump and a pan.

In a recovery device with the above constitution, when performing the head recovery, a carriage 601 is first moved to a recovery position (or home position) for the recovery operation. If the carriage 601 is moved to the recovery position, the tube pump 605 slides or rises from below, so that the tube is pressed onto the pan by the roller. And the discharge face of head is capped with a cap, and the tube pump 605 is driven to supply the discharge liquid and the bubbling liquid into the first and second liquid flow passages, respectively, so that the drain liquid from the discharge ports is exhausted through the cap.

Figure 46B:
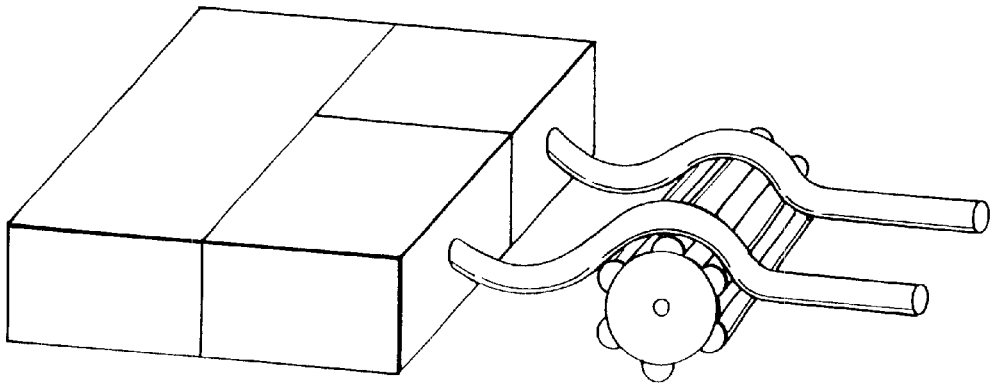

In the recovery device of this example, as in the above example 4, since it is not necessary to have the tube between the liquid discharge head 602 and the liquid vessels 603, 604, the liquid vessels 603, 604 may be attached to the liquid discharge head 602 (e.g., head cartridge), for example, as shown in FIG. 46B. Thereby, the total size can be reduced.

Example 7

While in the above examples, one tube pump was provided, it should be noted that a tube pump may be provided for each vessel.

Figure 51:
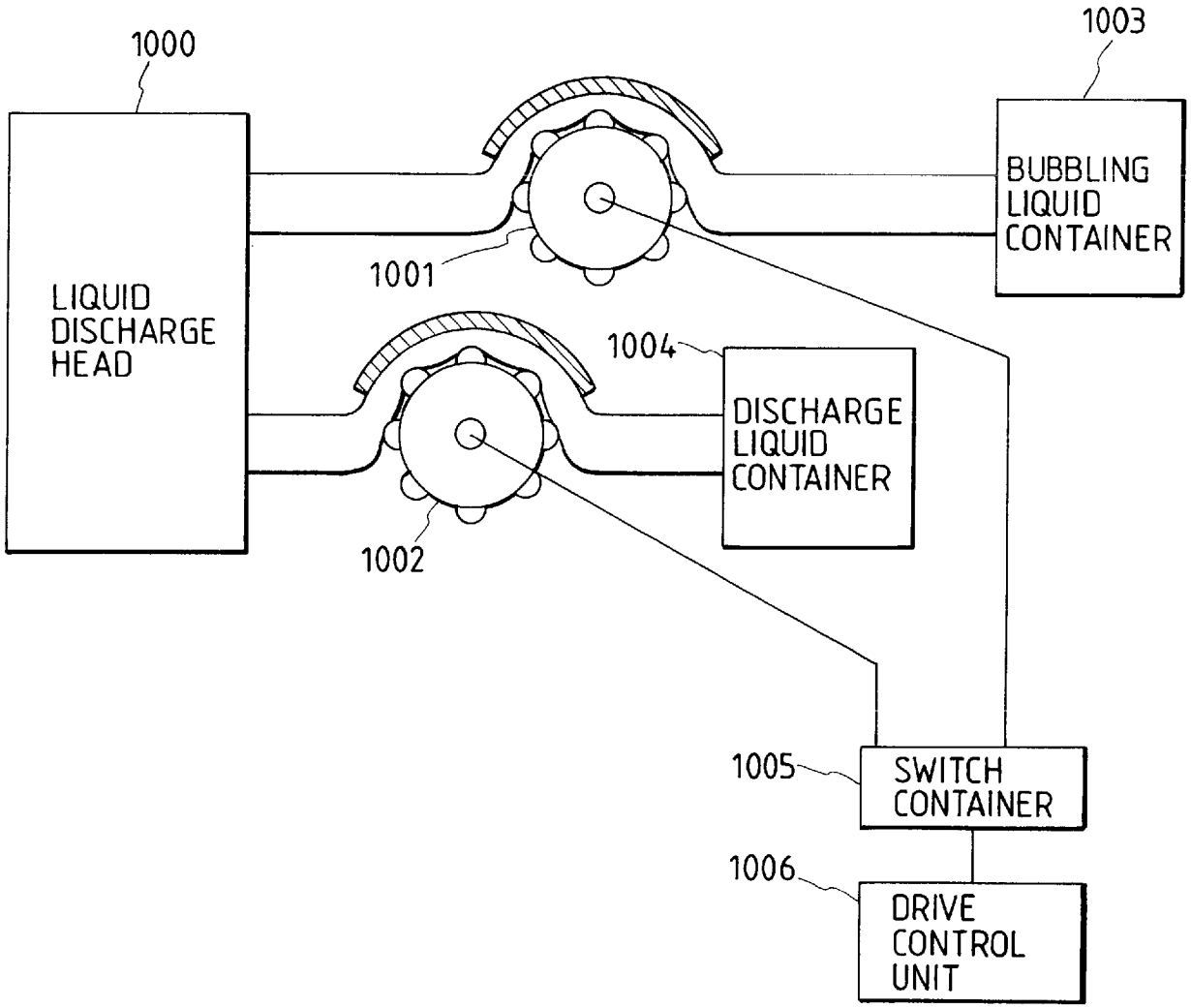
FIG. 51 is a block diagram for explaining the recovery device provided on the recording apparatus in a seventh example of the present invention.

FIG. 51 is a diagram for explaining a seventh example of the present invention.

In this example, two tube pumps 1001, 1002 are used. A tube pump 1001 is provided in a tube between a liquid discharge head 1000 and a bubbling liquid vessel 1003, and a tube pump 1002 is provided in a tube between a liquid discharge head 1000 and a discharge liquid vessel 1005, so that the liquid can be supplied to each liquid flow passage, independently. Each tube pump 1001, 1002 is independently driven, and controlled via a switch 1005 from a drive control unit 1006. With this constitution, the supply of discharge liquid to a first liquid flow passage and the supply of bubbling liquid to a second liquid flow passage can be independently controlled. Further, the pressure balance for the supply of liquid to each liquid flow passage can be controlled at will.

In this example, one-way valve is not provided, but the reverse flow is prevented by pressing a rotor against a pan in the tube pump without driving the tube pump. In this state, the recording is performed by discharging the liquid.

Pump Example 1

Figure 48:
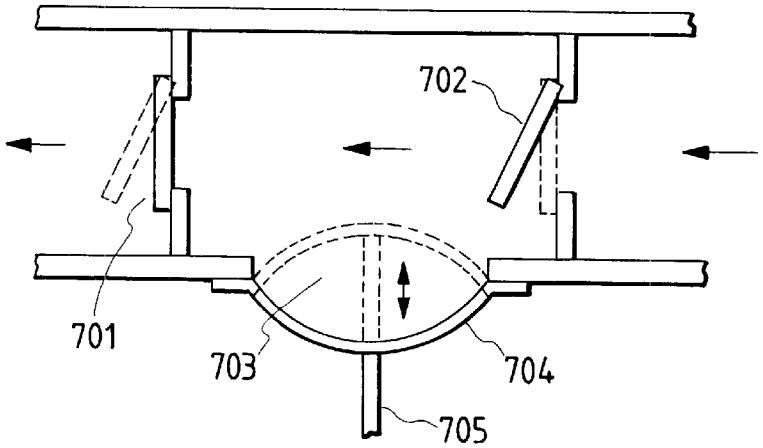
FIG. 48 is a view showing a variation example of the pump.

While in the examples 3 to 6 as previously described, because the head of two liquid flow passages allows various liquids having different viscosities to be used, a tube pump capable of adjusting the recovery amount or the liquid transport speed freely, corresponding to a variety of inks was used, it will be appreciated that a pump with the constitution as shown in FIG. 48 may be used, instead of this tube pump.

In FIG. 48, one-way valves 701, 702 are provided within a transport tube 700 for transporting the liquid (discharge liquid or bubbling liquid) or the air. An opening portion 703 is provided at a part of tube in the region segmented by the one-way valves 701, 702, an elastic wall 704 is provided to close up its opening in the opening portion 703. This elastic wall 704 is displaced between position A and position B by a pressure regulator lever 705. A one-way valve 701 is provided downstream, while a one-way valve 702 is provided upstream, both regulating the flow to an upstream direction.

In the pump with the above constitution, if the elastic wall 704 is displaced from position A to position B by the pressure regulator lever 705, the one-way valve 702 is closed, and the one-way valve 701 is opened, so that the liquid or air upstream of the one-way valve 701 is fed downstream of the one-way valve 701. On the other hand, if the elastic wall 704 is displaced from position B to position A by the pressure regulator lever 705, the one-way valve 701 is closed and the one-way valve 702 is opened, so that the liquid or air upstream of the one-way valve 702 is fed downstream of the one-way valve 702.

Pump Example 2

While in the examples 5 and 6 as previously described, the liquid is fed from the liquid vessel to each liquid flow passage by feeding the air into the liquid vessel, a pump for pressurizing the liquid vessel as will be described below may be used, instead of the tube pump.

FIGS. 49A to 49D are views of a pump using a displacement cam, schematically illustrating the pump operation. In the same figure, a liquid vessel 800 has an elastic wall 801, with an opening portion 803 formed at a part (center) of the elastic wall 801. Over this opening portion 803, a sheet member 802 is provided to close up the opening.

Figure 49A:
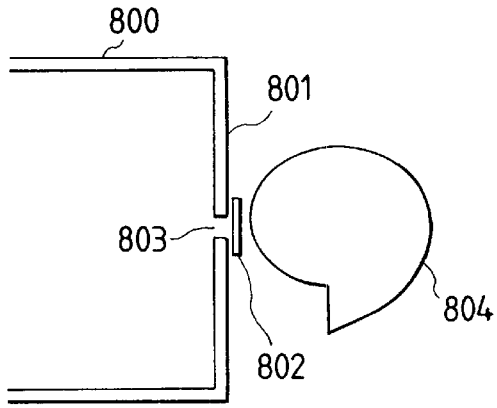
FIGS. 49A, 49B, 49C and 49D are views showing a variation example of the pump.
Figure 49B:
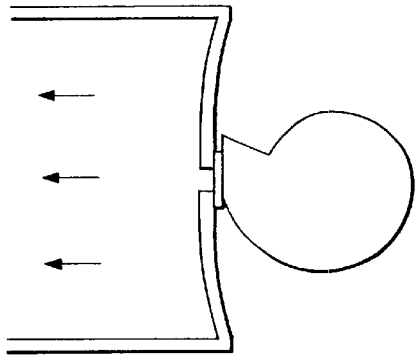
Figure 49C:
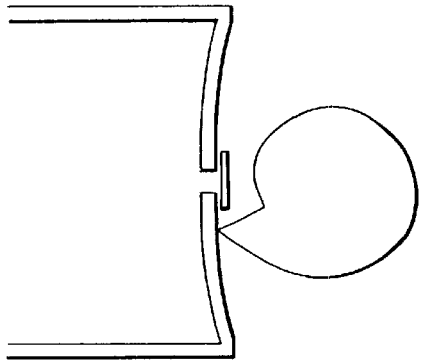
Figure 49D:
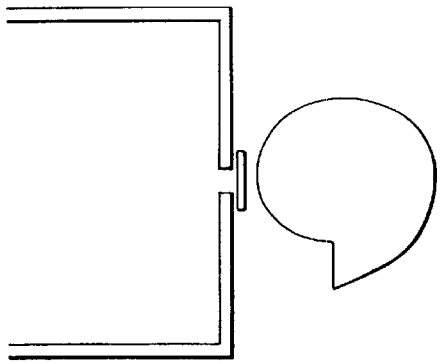

In the pump with the above constitution, if the displacement cam 804 is rotated, the opening portion 803 is closed up by the sheet member 802, so that the elastic wall 801 is displaced inside the vessel. If the elastic wall 801 is displaced inside the vessel, the vessel is pressurized, so that the liquid from the liquid vessel is delivered into the liquid discharge head (FIGS. 49A and 49B). If the displacement cam 804 is further rotated to exceed the maximum displacement, a gap will occur between the sheet member 802 and the opening portion 803, causing the elastic wall 801 to return to its original position (FIGS. 49C, 49D). In this way, if the displacement cam 804 is rotated to pressurize the vessel, the liquid can be supplied.

Pump Example 3

Besides the pump examples as above described, a pump for delivering the liquid from the liquid vessel into each liquid flow passage by feeding the air into the liquid vessel is shown in FIGS. 50A to 50D.

Figure 50A:
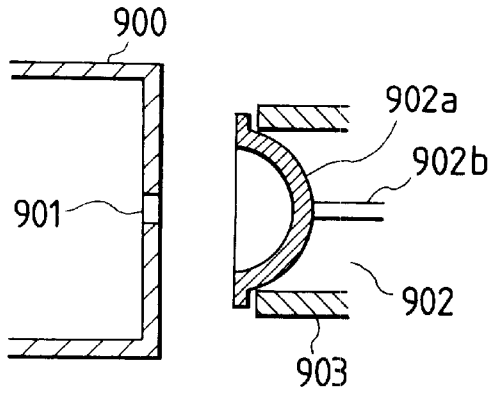
FIGS. 50A, 50B, 50C and 50D are views showing a variation example of the pump.
Figure 50B:
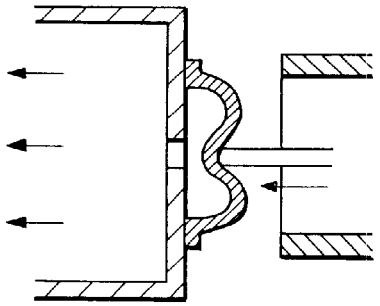
Figure 50C:
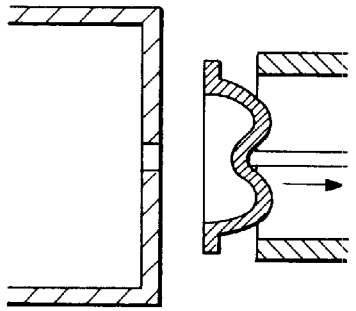
Figure 50D:
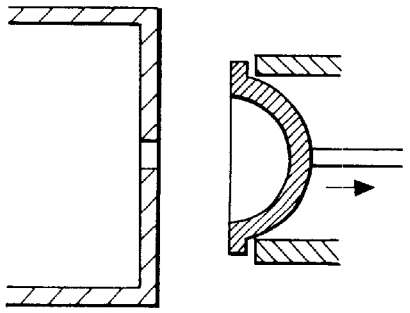

In FIGS. 50A to 50D, an opening portion 901 is provided at a part of a side wall of a liquid vessel 900. A cap pump 902 has a cap 902*a* which can cover this opening portion 901, and can pressurize the liquid vessel 900 by pressing the cap 902*a* against the wall to close up the opening portion 901, and pushing in a support rod 902*b* for supporting the central portion of the cap 902*a* to deform the cap. The deformed cap can be reversed by hanging an edge end of the cap 902*a* on a guide 903 and pulling back the support rod 902*b* (FIGS. 50C, 50D). In this way, the liquid can be supplied by pressing the cap 902*a* against the wall to cover the opening portion 901 and deforming the cap to pressurize the vessel.

Using these pumps, it is possible to reduce the load of the recovery system of the main unit by performing the head recovery under the pressure.

Example 8

Figure 52A:
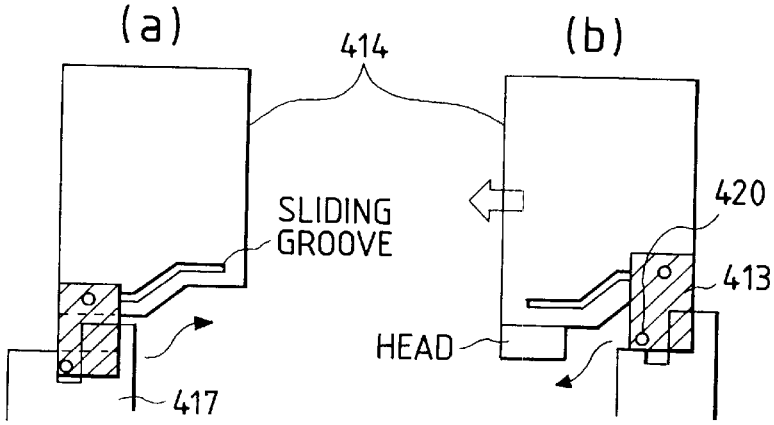
FIGS. 52A, 52B and 52C are typical views of the head integrated with the cap having a waste ink reservoir.
Figure 52B:
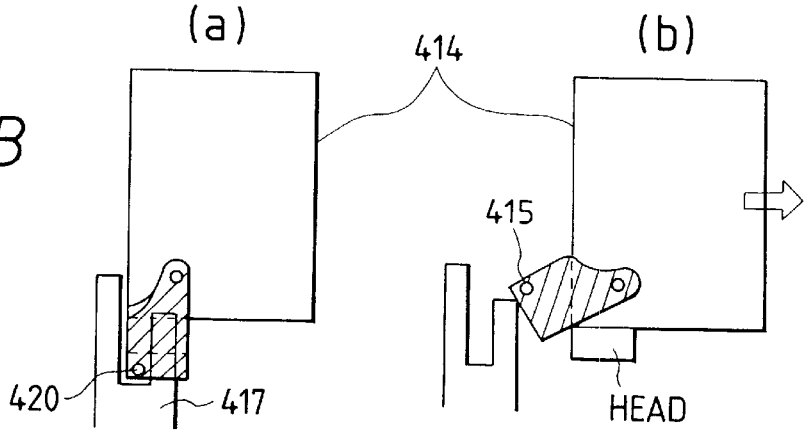
Figure 52C:
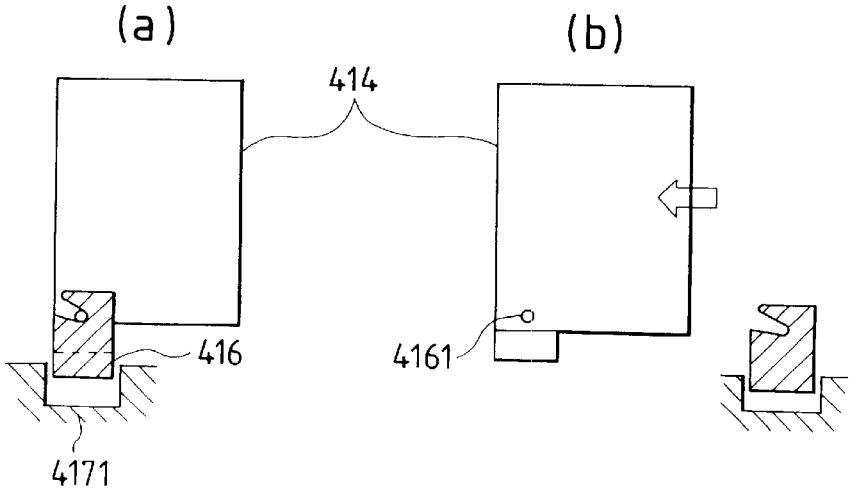

FIGS. 52A to 52C are typical views of a head integrated with a cap having a liquid holding member which is a waste ink reservoir, wherein FIG. 52A is a slide type, FIG. 52B is a rotation type, and FIG. 52C is a separation type which has been integrated, and in FIGS. 52A to 52C, (a) shows the state of physical distribution, and (b) shows the state of printing.

Since the used liquid or ink is not limited by the recovery system of the main unit, like the pressure recovery of the example 2, the waste ink reservoir is disposed on the head side, and the use of a new waste ink reservoir, a cap and a blade for each head is enabled.

A way of attaching or detaching the slide type cap onto or from the head will be described below. FIGS. 53A to 53D are explanatory views illustrating the attaching or detaching of a slide type head cap 413 onto a head 414.

The slide type head cap 413 of FIG. 52A is attached slidably in a slide groove of the head, and can take an attached state (a) where the head 414 and the head cap 413 are coupled and a non-attached state (b).

Figure 53D:
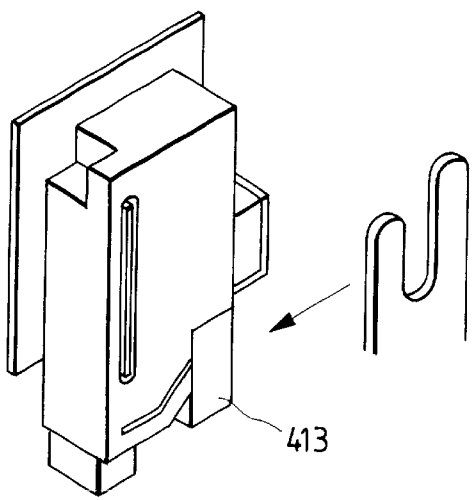
FIGS. 53A, 53B, 53C and 53D are explanatory views showing the attaching or detaching of a slide type cap onto or from the liquid discharge head.
Figure 53C:
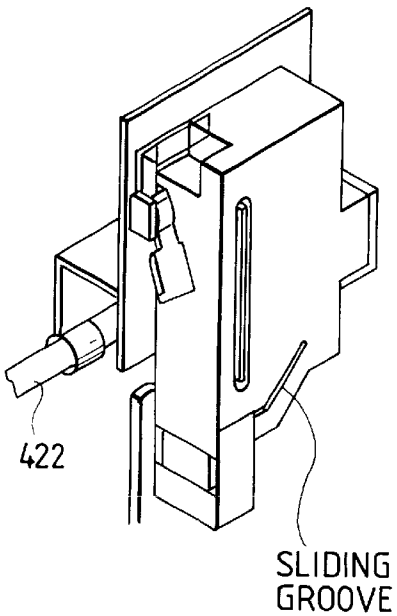
Figure 53B:
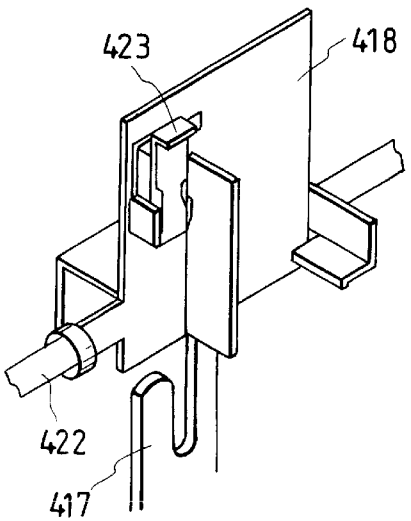
Figure 53A:
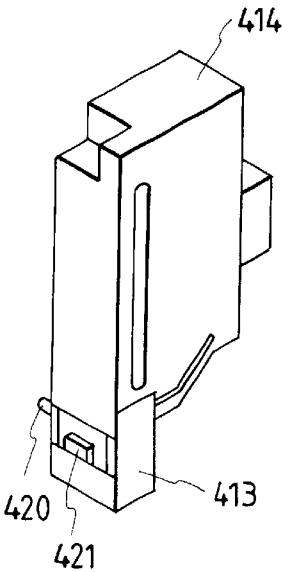

The cap is put onto the face surface of the head during physical distribution (FIG. 53A), the head 414 being capped is mounted on a carriage 418 (FIG. 53B) at a home position (FIG. 53B), using a head securing lever 423, so that the cap lever 420 protruding from the cap engages with a slide guide 417 provided on the printer unit (FIG. 53C).

When in use, a print signal is issued, and when the carriage 418 is moved along a carriage shaft 422 from the home position into the printing area (to the left in the figure), the cap lever 420 of the cap 413 will slide within the slide groove of the head, so that the cap 413 is removed from the face surface (FIG. 53D) to start the printing. Conversely, when the printing is ended, the carriage 418 is returned to the home position from the state D to the state C of the same figure, and the cap is put on the face surface where the discharge ports of the head are provided.

At the time of recovery, with the cap 413 retained on the face, or with the cap 413 slightly away from the face surface by moving the carriage 418, the waste ink is received in the waste ink reservoir.

After the recovery, to remove the ink remaining on the face surface with the blade, the blade operation can be performed in such a manner as to separate the cap from the face surface by moving the cap 413 with a blade 421 provided on the cap 413.

The same method is applicable to other caps such as the rotation type cap 415 and the separation type cap 416, without being limited to the slide type.

Herein, the slide type is met with a smaller cap opening or closing and operational area, and thus appropriate for the saving of space, the rotation type is simple in the mechanical design, and the separation type allows for the reduced carriage weight.

In this example, for each head, a new cap, a waste ink reservoir, and a blade can be used, whereby the fixing problem of the recovery system of the main unit with the liquid ink can be avoided. Accordingly, the scope of selecting the used liquid ink can be extended.

Also, a variety of cartridges can be used in one main unit, whereby the inks of different colors or kinds can be used for the printing.

In this example, the above head is of the structure having a check valve, with the advantages thereof, which is applicable to the head using two liquids or only one liquid as previously described in the embodiments of this invention, and more preferably implemented with the special liquid such as quick drying ink or high viscous ink.

Example 9

FIG. 54 is a typical diagram showing the structure where a valve is provided in a supply passage to the liquid discharge head of this invention.

Herein, the used valve will be described below. The principle is that, like the opening and closing operation of the movable member as described in FIGS. 36A to 36C, the opening and closing operation of the valve can be made by development of a bubble caused by the heating element, but other principles for the opening and closing of valve can be employed.

In FIG. 54, $B_1$ is a movable member within the liquid discharge head, $B_2$ is a valve in the ink flow passage, and $B_3$ is a valve in the bubbling liquid flow passage, wherein these valves serve to supply the ink and the bubbling liquid to the liquid discharge head, and are not directly involved in the discharge.

When the movable member $B_1$ is once turned off and closed, the valves $B_2$, $B_3$ are displaced by the bubble produced by heating of the heat generating member, to open the flow passage.

The heat generating member of the movable member $B_1$ generates the heat to heat and generate the bubble in the the liquid, so that the liquid is discharge, while the heating energy of the valves $B_2$, $B_3$ is stopped, to close the valves at all times.

When the valves $B_2$, $B_3$ are closed, the flow passage is substantially shut off with the displacement of the valve, so that the liquid is prevented from flowing in a direction opposite to the discharge port direction, as the back wave in discharging, like the check valve. Also, the meniscus is produced after the discharge operation, the liquid is supplied from the tank, by the displacement of the valves $B_2$, $B_3$ which are opened by bubble generation or bubble disappearance, with the extremely small flow resistance with the valve, whereby the refill can be smoothly conducted.

Example 10

Figure 55:
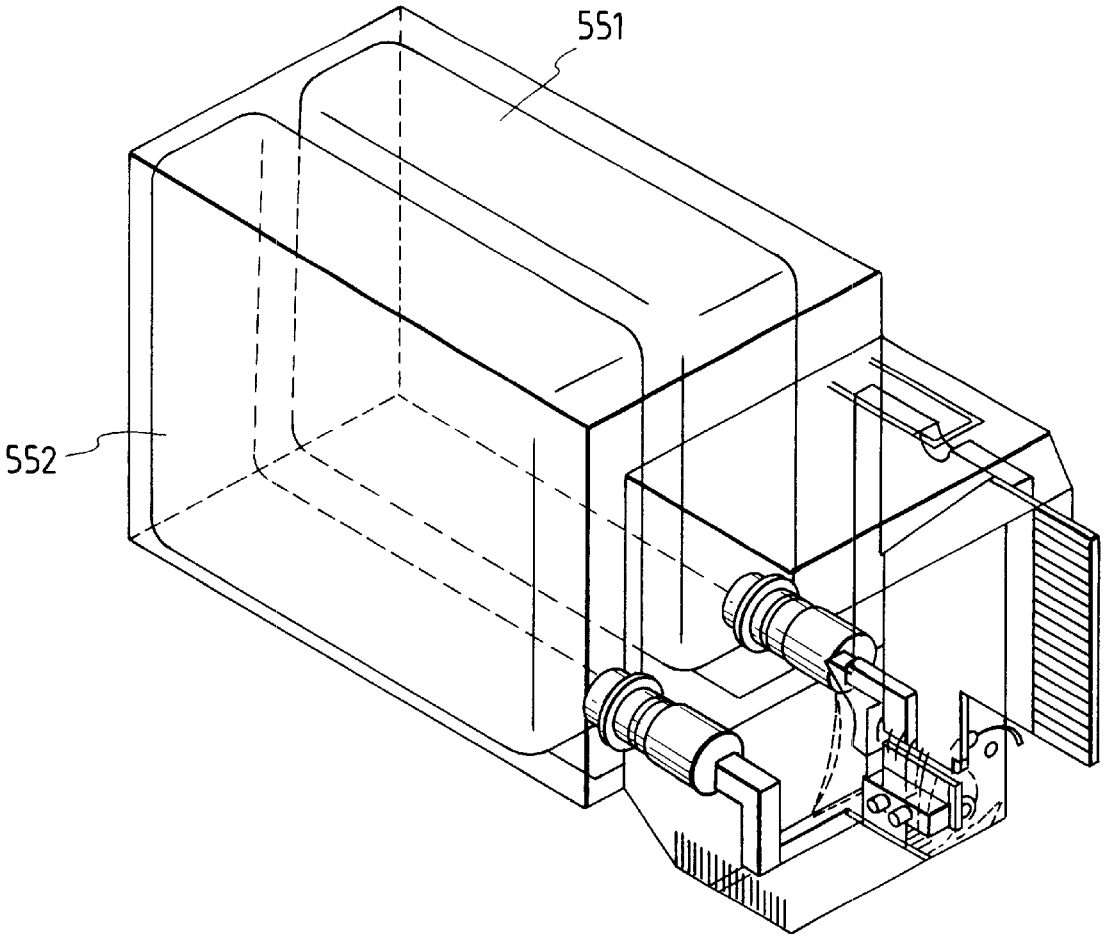
FIG. 55 is a perspective view of the liquid discharge head according to the present invention.

FIG. 55 is a perspective view of a liquid discharge head of the present invention.

In FIG. 55, the discharge liquid is stored in a first liquid vessel 551, and the bubbling liquid predeaerated is stored in a second liquid vessel 552. Note that the liquid vessel 552 is in the form of an enclosed cartridge such as an ink tank having a sealed flexible bag (having an aluminum layer).

The bubbling liquid is predeaerated before being filled into the liquid vessel 552. A way of deaeration is not particularly limited, but in this example, was made using NICEP SF-131LS manufactured by Nitto Denko Corporation. Also, the conditions of deaeration area varied, depending on the composition of the bubbling liquid, but it is sufficient that the dissolved gas in the liquid can be sufficiently deaerated.

After the dissolved gas has been sufficiently deaerated, the bubbling liquid is filled in the liquid vessel 552.

In this constitution, two liquid flow passages of a liquid flow passage for the discharge liquid and a liquid flow passage for the bubbling liquid are provided, but the liquid flow passage for the bubbling liquid is of a structure substantially enclosed, except for a slit of the movable member.

Also, in this constitution, the bubbling liquid having a water to ethanol composition of 9 to 1 was used, but the bubbling liquid contains the water of 20 or more by weight, and is preferably deaerated.

In this example, the stable discharge by the even bubble generation could be accomplished without the gas remaining in the liquid flow passage for the bubbling liquid.

Example 11

FIG. 56 is an exploded perspective view of a head according to the present invention, and FIG. 57 is an exploded perspective view of a liquid discharge head cartridge.

This constitution is provided with a deaeration system 554 for deaerating the bubbling liquid behind the head of FIG. 23, as shown in FIGS. 56 and 57, the deaeration system 554 being placed between a liquid vessel 90 with the liquid filled in the head cartridge of FIG. 27 and the liquid discharge head.

A liquid discharge head with the above deaeration system applied will be described below.

Figure 58:
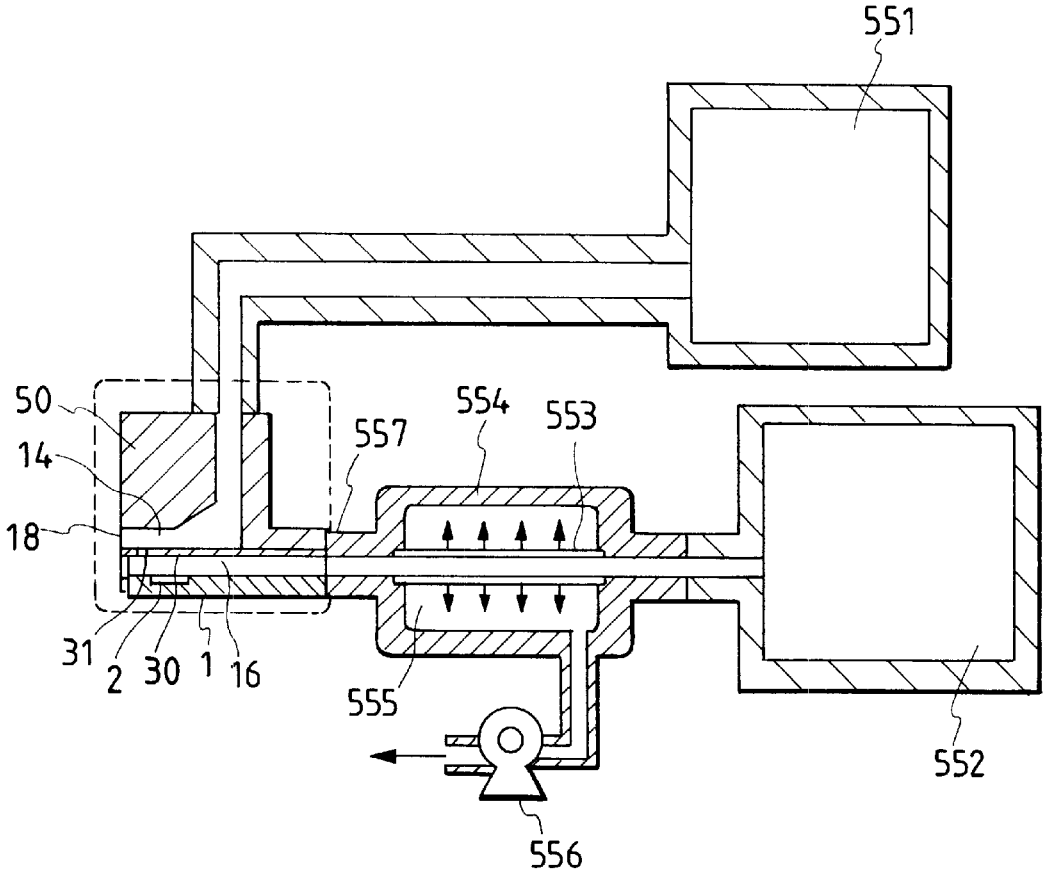
FIG. 58 is a cross-sectional view showing one constitutional example of the liquid discharge head to which a deaeration system is applied.

FIG. 58 is a cross-sectional view showing one constitutional example of the liquid discharge head to which the deaeration system is applied.

In FIG. 58, a discharge port 18 for discharging the liquid, a first liquid vessel 551 for storing the discharge liquid, a first liquid flow passage 14, communicating to the discharge port 18 and the liquid vessel 551, for conducting the discharge liquid stored within the liquid vessel 551 to the discharge port, a second liquid vessel 552 for storing the bubbling liquid, a substrate 1 having a heat generating member 2 provided, a second liquid flow passage 16, communicating to the liquid vessel 552, for conducting the bubbling liquid stored in the liquid vessel 551 to the heat generating member 2, a movable member 31 provided to separate the first liquid flow passage 14 and the second liquid flow passage on the heat generating member 2, with the discharge port side as a free end and the opposite side as a fulcrum, displaced toward the first liquid flow passage 14 by the pressure of a bubble produced on the heat generating member 2, to communicate the first liquid flow passage 14 with the second liquid flow passage 16, a separation wall containing the movable member 31 and made of a material having high gas impermeable property such as metal or PVDF (polyvinylidenefluoride), and a deaeration system, provided between the second liquid flow passage 16 and the liquid vessel 552, for deaerating the bubbling liquid stored within the liquid vessel 552 for the supply to the second liquid flow passage 16, the deaeration system being comprised of a deaeration liquid supply port 557 which is a joint portion with the second liquid flow passage 16, a membrane 553 made of a material having high gas permeability such as ethylene fluoride for permeating the gas from the bubbling liquid, a gas exhaust portion 555 for exhausting the gas from the bubbling liquid via the membrane 553, and a vacuum pump 556 for sucking the gas from the bubbling liquid.

The operation of the liquid discharge head with the above constitution will be described below.

If the bubbling liquid stored within the liquid vessel 552 is supplied to the deaeration system 554, the gas exhaust portion 555 is placed in a low pressure state by the vacuum pump 556 provided within the deaeration system 554, whereby the gas is sucked from the bubbling liquid via the membrane 553.

And the deaerated bubbling liquid is supplied via the deaeration liquid supply port 557 to the second liquid flow passage 16.

On the other hand, the discharge liquid stored within the liquid vessel 551 is supplied to the first liquid flow passage 14.

By heating of the heat generating member 2, a bubble is produced in the bubbling liquid, to cause the movable member 31 to be displaced to the first liquid flow passage 14, owing to a pressure by its bubble, so that the discharge liquid is discharged in the first liquid flow passage 14 from the discharge port 18.

In the liquid discharge head as above described, the gas is not dissolved in the bubbling liquid, even when left away for a long time, and the dissolved gas is not deposited on the heat generating member due to temperature elevation by repeating the heating and forming for the discharge, resulting in the stable bubble generation state, with the state discharge characteristics obtained.

Example 12

In this constitution, a pigment ink was used for the discharge liquid. In the following, the composition of the pigment ink is listed.

| | |
|---|---|
| Carbon black | 6 wt % |
| Styrene-acrylic acid-ethyl acrylate copolymer | 1 wt % |

(acid value 140, weight average molecular weight 8000)

| | |
|---|---|
| Monoethanolamine | 0.25 wt % |
| Glycerine | 9 wt % |
| Thiodiglycol | 7 wt % |
| Ethanol | 3 wt % |
| Water | 76.75 wt % |

The pigment ink is an ink having excellent anti-fastness, but is greatly restricted by the kind or amount of dispersing agent, because the burnt deposits may occur on the heat generating member by heating of the heat generating member.

In the head of this invention, the mixture of the bubbling liquid and the discharge liquid is prevented by regulating the slit width around the movable member, but there is a possibility that the discharge liquid may more or less mingle into the liquid flow passage for the bubbling liquid, due to the characteristics of two liquids for use, or the mixture of two liquids when discharged or when left away for a long time.

In this example, the bubbling liquid had the following composition:

| | |
|---|---|
| Acetylenol | 3 wt % |
| Ethanol | 20 wt % |
| Water | 77 wt % |

By adding an active agent such as acetylenol, as the surface stabilizer, the wettability of liquid on the heat generating member is increased to prevent the burnt deposits from adhering thereto, but even if the discharge liquid diffuses to the liquid flow passage for the bubbling liquid, to yield the burnt deposits on the heat generating member, the burnt deposits can be easily peeled by the external force of the bubbling liquid.

In the liquid discharge head as above described, the bubble generation as well as the discharging were stabilized. In particular, in this example, the consumption amount of the bubbling liquid is reduced, and since the bubbling liquid is mixed at a ratio of about 10% to the discharge liquid in discharging the liquid, acetylenol in the discharged liquid is about 0.3%, whereby the liquid shot onto the recording medium will not blur too much.

Accordingly, it is possible to enhance the peeling ability of burnt deposits, with the good print quality maintained, whereby the stable bubble generation and stable discharge can be accomplished, resulting in the higher image quality.

Example 13

Figure 59:
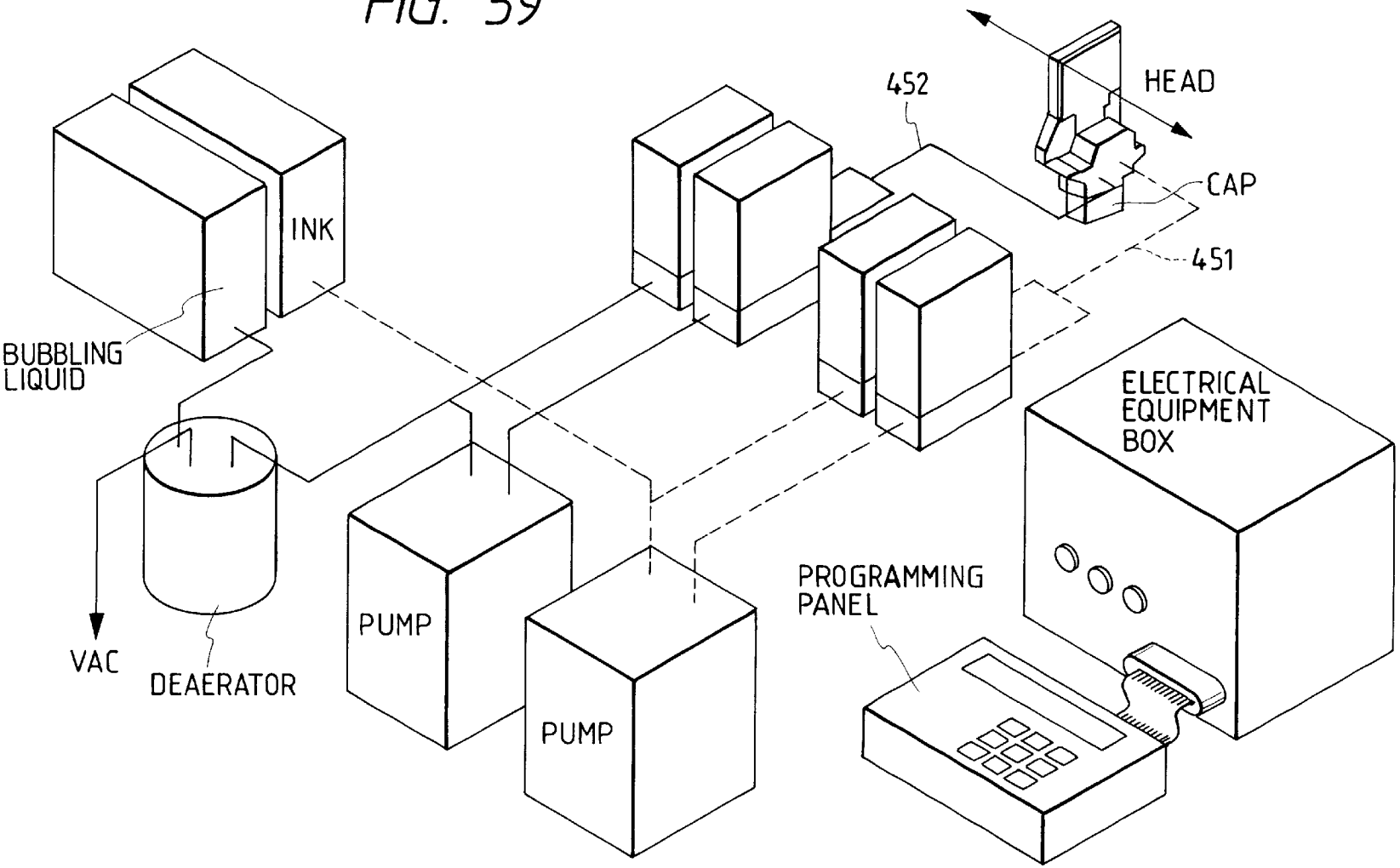
FIG. 59 is a schematic view of the liquid discharge head having a pressure pump, a check valve, a valve and a cap.
Figure 60:
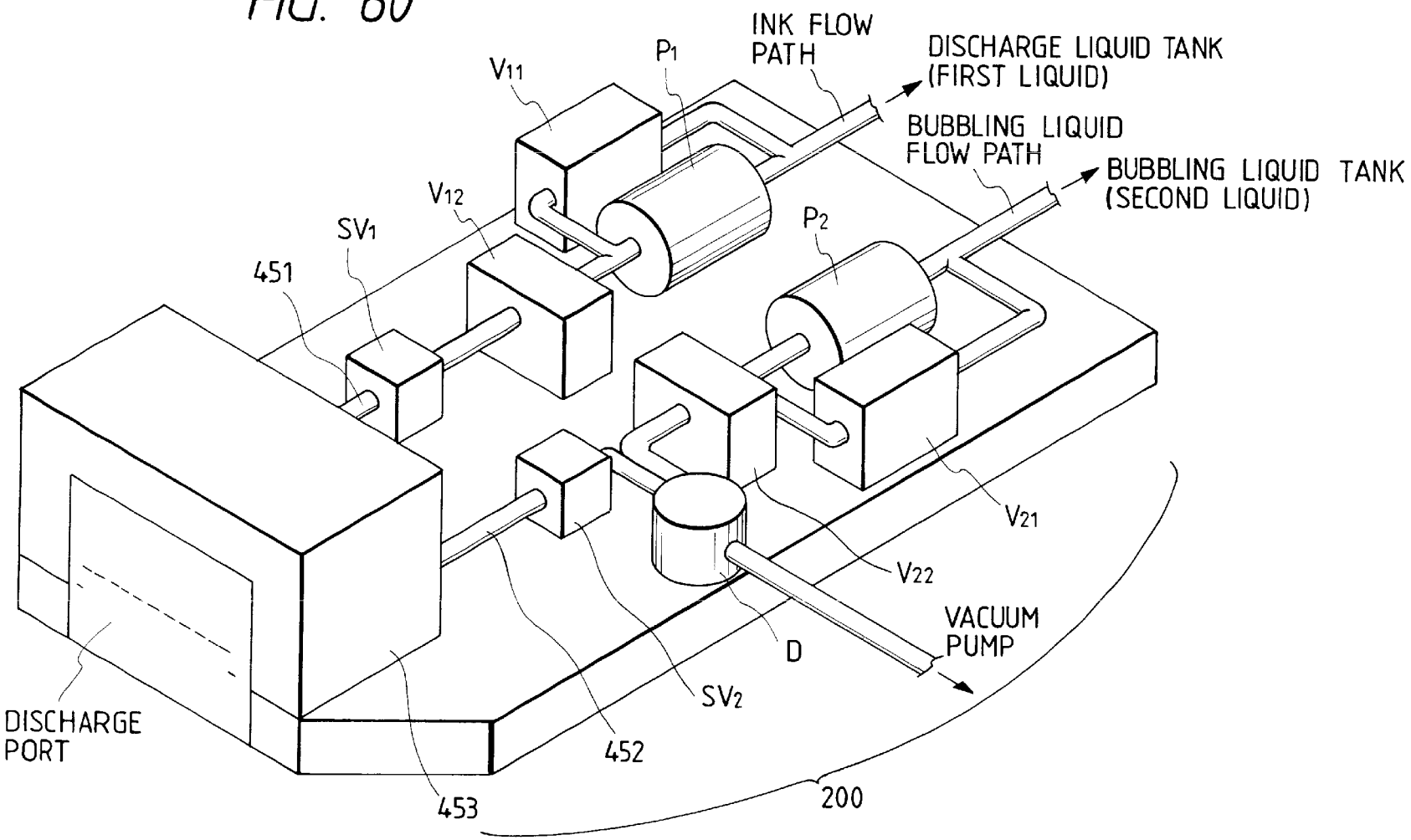
FIG. 60 is a typical view of an integral head system in which the whole system is mounted on the head.

FIG. 59 is a schematic view of a liquid discharge system provided with all of a pressure pump, a check valve, a valve, a cap, a tank and a deaerator, and FIG. 60 is a schematic view showing the construction in which each mechanism is mounted on a liquid discharge head.

As shown in FIGS. 59 and 60, the whole system or head unit may be constructed.

Figure 62:
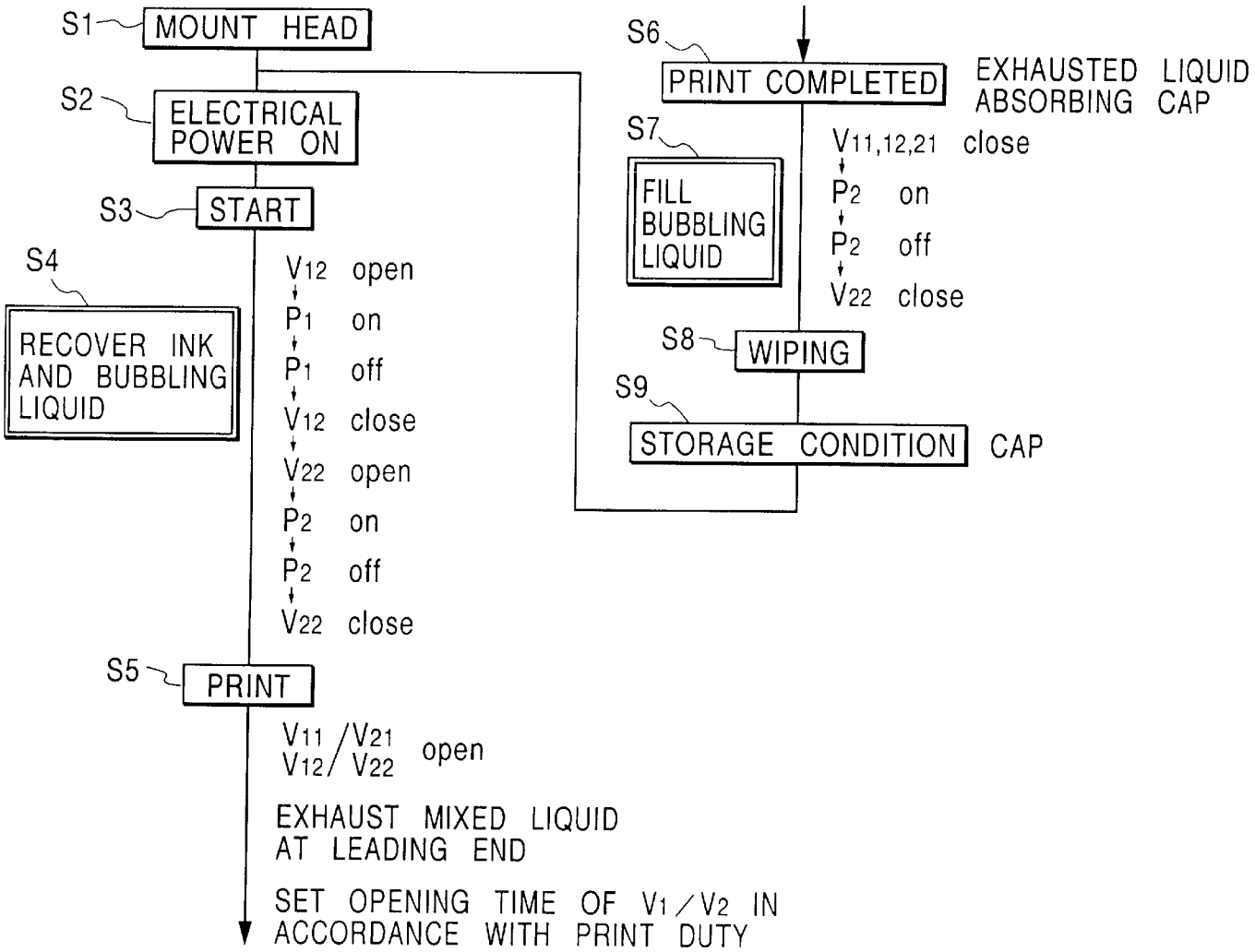
FIG. 62 is a flowchart showing the control procedure of the liquid discharge system.

FIG. 61 is a block diagram showing the overall configuration of the liquid discharge system with the liquid discharge head. Also, FIG. 62 is a flowchart showing a control procedure of the liquid discharge head.

The control procedure of the liquid discharge system will be described below.

The head is capped during physical distribution, with the bubbling liquid filled in the head. When in use, the head is mounted on a carriage (S1), the electrical power is turned on, the recovery function is started, and the head recovery is performed in the order of ink and bubbling liquid, using a pressure pump and a valve (S2 to S4).

As previously described, the cap is separated away from the face by moving the carriage, and the blade is exerted.

During printing, the valve is automatically opened and closed in accordance with the print duty, to retain the supply balance (S5).

After printing, the carriage is returned to the home position, where the suction recovery is performed after the head is filled with the bubbling liquid (S7), and the face surface is capped (S9).

The above examples involve a head structure of two flow passages, a liquid discharge head cartridge and a liquid discharge apparatus, which are obtained with the excellent effects. Also, they are applicable to the head of one flow passage which was partly described in the examples.

Also, by having a check valve and a pressure pump at the same time, the recovery can be more surely performed while the reverse flow of the liquid ink is prevented.

It is needless to say that the present invention is also applicable to a side shooter type having the discharge port at a position opposite the face of the heat generating member.

The present invention exhibits the following effects as follows, owing to the constitution as above described:

(1) In the liquid discharge head of one flow passage, the discharge power is further stabilized, while the load on the recovery system of the main unit can be relieved.

(2) In the liquid discharge head of two flow passages, the supply balance of two liquids can be kept to effect the stable discharge and to prevent the liquid mixture or diffusion.

(3) When using a special ink, the load on the recovery system of the main unit can be reduced.

(4) The liquids are independently supplied into the first liquid flow passage (discharge liquid flow passage) and the second liquid flow passage (bubbling liquid flow passage), respectively, upon the recovery, so that the bubble or dirt will not remain in each liquid flow passage within the head. Also, since the liquid is discharged while the reverse flow of liquid in the liquid flow passage is prevented, the stability of the discharge performance for the liquid discharge head can be maintained, and the reliability raised.

(5) When using a tube pump, the deformation amount of tube due to the roller of tube pump can be varied between the first liquid flow passage side and the second liquid flow passage side. For example, if the liquid is transported with the tube completely closed, on the first liquid flow passage side, and with the tube not completely closed, on the second liquid flow passage side, it is possible to prevent the supply of liquid with a greater pressure than necessary, thereby effecting the stable recovery operation.

(6) In a pump for forcefully feeding the liquid to the liquid discharge head by pressurizing the liquid vessel, since the liquid discharge head and the liquid vessel can be integrated (into cartridge), the reduced cost and size of the apparatus can be realized.

(7) Since the bubbling liquid to be supplied to the heat generating member is predeaerated, the second liquid vessel for storing the bubbling liquid is of the closed type, and the separation wall for separating between the first liquid flow passage having the discharge liquid supplied and the second liquid flow passage having the bubbling liquid supplied has the gas impermeability, the gas is not contained and dissolved in the bubbling liquid to be supplied to the heat generating member.

(8) Since the deaeration means for deaerating the bubbling liquid is provided between the second liquid vessel and the second liquid flow passage, even if the gas is contained in the bubbling liquid within the second liquid vessel, the bubbling liquid can be deaerated by deaerating means, when supplied to the heat generating member, whereby no gas will be contained in the bubbling liquid conducted to the heat generating member.

(9) Since the liquid for peeling the burnt deposits on the heat generating member was used as the bubbling liquid, the burnt deposits can be removed by the bubbling liquid, even if the discharge liquid diffuses within the second liquid flow passage and the burnt deposits occur on the heat generating member by heating of the heat generating member.

What is claimed is:

1. A liquid discharge head comprising discharge ports for discharging the liquid, liquid flow channels each having a heating element for applying heat to the liquid to produce a bubble in the liquid, and a supply passage for supplying the liquid onto said heating element from the upstream side of said heating element along said heating element, and a movable member, provided toward said heating element, with a free end on the discharge port side, for displacing said free end due to a pressure caused by the bubble produced to conduct the pressure to the discharge port side, wherein a check valve is disposed in said liquid supply passage.

2. A liquid discharge head comprising a first liquid flow channel communicating to a discharge port, a second liquid flow channel having a bubble producing area for producing a bubble in the liquid by applying heat to the liquid, and a movable member, disposed between said first liquid flow channel and said bubble producing area, with a free end on the discharge port side, for displacing said free end toward said first liquid flow channel due to a pressure caused by the bubble produced within said bubble producing area to conduct the pressure to the discharge port side of said first liquid flow channel, wherein a check valve is disposed in a liquid supply passage leading to either one of said first and second liquid flow channels.

3. A liquid discharge head comprising a first liquid flow channel communicating to a discharge port, a second liquid flow channel having a bubble producing area for producing a bubble in the liquid by applying heat to the liquid, and a movable member, disposed between said first liquid flow channel and said bubble producing area, with a free end on the discharge port side, for displacing said free end toward said first liquid flow channel due to a pressure caused by the bubble produced within said bubble producing area to conduct the pressure to the discharge port side of said first liquid flow channel, wherein a check valve is disposed in a liquid supply passage leading to said first liquid flow channel and a check valve is disposed in a liquid supply passage leading to said second liquid flow channel.

4. A liquid discharge head according to claim 2, further comprising:

a grooved member having integrally the discharge port for discharging the liquid, a channel which is part of the first liquid flow channel directly communicating to and corresponding to the discharge port, and a recess portion for constituting a first common liquid chamber for supplying the liquid to said first liquid flow channel;

an element substrate having a plurality of heating elements arranged for producing a bubble in the liquid by applying heat to the liquid; and a separation wall, disposed between said grooved member and said element substrate, for composing a part of a wall for said second liquid flow channel corresponding to said heating element, and having the movable member which is displaceable toward said first liquid flow channel by the pressure caused by the bubble produced at the position opposed to said heating element.

5. A liquid discharge head according to claim 3, further comprising:

a grooved member having integrally the discharge port for discharging the liquid, a channel which is part of the first liquid flow channel directly communicating to and corresponding to the discharge port, and a recess portion for constituting a first common liquid chamber for supplying the liquid to said first liquid flow channel;

an element substrate having a plurality of heating elements arranged for producing a bubble in the liquid by applying heat to the liquid; and a separation wall disposed between said grooved member and said element substrate, for composing a part of a wall for said second liquid flow channel corresponding to said heating element, and having the movable member, which is displaceable toward said first liquid flow channel by the pressure caused by the bubble produced at the position opposed to said heating element.

6. A liquid discharge head according to claim 3, wherein the check valve provided on the liquid supply passage to said first liquid flow channel and the check valve provided on the liquid supply passage to said second liquid flow channel have different characteristics.

7. A liquid discharge head according to any one of claims 1 and 2 through 4, wherein any of said check valves operates with a pressure difference between liquids on either side of said check valve.

8. A liquid discharge head according to claim 4 or 5, wherein said check valve is formed integrally with said separation wall.

9. A liquid discharge head comprising a first liquid flow channel communicating to a discharge port, a second liquid flow channel having a bubble producing area for producing a bubble in the liquid by applying heat to the liquid, and a movable member, disposed between said first liquid flow channel and said bubble producing area, with a free end on the discharge port side, for displacing said free end toward said first liquid flow channel due to a pressure caused by the bubble produced within said bubble producing area to conduct the pressure to the discharge port side of said first liquid flow channel, wherein a valve prevents the liquid on the side of said liquid flow channels and the liquid on the opposite side from said liquid flow channels from mixing within a liquid supply passage leading to either one of said first and second liquid flow channels.

10. A liquid discharge head comprising a first liquid flow channel communicating to a discharge port, a second liquid flow channel having a bubble producing area for producing a bubble in the liquid by applying heat to the liquid, and a movable member, disposed between said first liquid flow channel and said bubble producing area, with a free end on the discharge port side, for displacing said free end toward said first liquid flow channel due to a pressure caused by the bubble produced within said bubble producing area to conduct the pressure to the discharge port side of said first liquid flow channel, wherein a valve on the liquid supply passage to said first liquid flow channel and a valve on the liquid supply passage to said second liquid flow channel prevent the liquid from mixing within a liquid supply passage leading to said first and second liquid flow channels.

11. A liquid discharge head according to claim 9, further comprising:

a grooved member having integrally the discharge port for discharging the liquid, a channel which is part of the first liquid flow channel directly communicating to and corresponding to the discharge port, and a recess portion for constituting a first common liquid chamber for supplying the liquid to said first liquid flow channel;

an element substrate having a plurality of heating elements arranged for producing a bubble in the liquid by applying heat to the liquid; and a separation wall, disposed between said grooved member and said element substrate, for composing a part of a wall for said second liquid flow channel corresponding to said heating element, and having the movable member which is displaceable toward said first liquid flow channel by the pressure caused by the bubble produced at the position opposed to said heating element.

12. A liquid discharge head according to claim 10, further comprising:

a grooved member having integrally the discharge port for discharging the liquid, a channel which is part of the first liquid flow channel directly communicating to and corresponding to the discharge port, and a recess portion for constituting a first common liquid chamber for supplying the liquid to said first liquid flow channel;

an element substrate having a plurality of heating elements arranged for producing a bubble in the liquid by applying heat to the liquid; and a separation wall disposed between said grooved member and said element substrate, for composing a part of a wall for said second liquid flow channel corresponding to said heating element, and having the movable member which is displaceable toward said first liquid flow channel by the pressure caused by the bubble produced at the position opposed to said heating element.

13. A liquid discharge head according to claim 10, wherein the valve provided on the liquid supply passage to said first liquid flow channel and the valve provided on the liquid supply passage to said second liquid flow channel have different characteristics.

14. A liquid discharge head according to any one of claims 9 through 12, wherein any of said check valves operates with a pressure difference between liquids on either side of said check valve.

15. A liquid discharge head comprising discharge ports for discharging liquid, liquid flow channels each having a heating element for applying heat to the liquid to produce a bubble in the liquid, and a supply passage for supplying the liquid onto said heating element from the upstream side of said heating element along said heating element, and a movable member, provided toward said heating element, with a free end on the discharge port side, for displacing said free end due to a pressure caused by the bubble produced to conduct the pressure to the discharge port side, wherein a valve, disposed in said liquid supply passage, can be opened or closed based on the bubble produced by the heating element.

16. A liquid discharge head comprising a first liquid flow channel communicating to a discharge port, a second liquid flow channel having a bubble producing area for producing a bubble in the liquid by applying heat to the liquid, and a movable member, disposed between said first liquid flow channel and said bubble producing area, with a free end on the discharge port side, for displacing said free end toward said first liquid flow channel due to a pressure caused by the bubble produced within said bubble producing area to conduct the pressure to the discharge port side of said first liquid flow channel, wherein a valve, disposed in a liquid supply passage leading to each of said liquid flow channels, can be opened or closed based on the bubble produced by the heating element.

17. A liquid discharge head comprising:

a grooved member having integrally a plurality of discharge ports for discharging the liquid, a plurality of first liquid flow channels directly communicating to and corresponding to respective discharge ports, a second liquid flow channel having a bubble producing area for producing a bubble in the liquid, and a recess portion for constituting a first common liquid chamber for supplying the liquid to said plurality of first liquid flow channels;

an element substrate having a plurality of heating elements arranged for producing the bubble in the liquid by applying heat to the liquid; and a separation wall, disposed between said grooved member and said element substrate, for composing a part of a wall for said second liquid flow channel corresponding to said heating element, and having a movable member which is displaceable toward said first liquid flow channels by a pressure due to a bubble produced at the position opposed to said heating element, wherein a valve, disposed in a liquid supply passage leading into said liquid flow channels, can be opened or closed based on the bubble produced by the heating element.

18. A liquid discharge head according to any one of claims 15, 16, or 17, wherein said valve opens only when the bubble has disappeared.

19. A liquid discharge head according to any one of claims 15, 16, or 17, wherein said valve opens only when liquid is supplied into any of said liquid flow channels.

* * * * *